US010711788B2

(12) United States Patent
Mayleben

(10) Patent No.: US 10,711,788 B2
(45) Date of Patent: Jul. 14, 2020

(54) INTEGRATED SUMP PUMP CONTROLLER WITH STATUS NOTIFICATIONS

(71) Applicant: Wayne/Scott Fetzer Company, Westlake, OH (US)

(72) Inventor: Philip Anthony Mayleben, Brookville, IN (US)

(73) Assignee: Wayne/Scott Fetzer Company, Westlake, OH (US)

( * ) Notice: Subject to any disclaimer, the term of this patent is extended or adjusted under 35 U.S.C. 154(b) by 509 days.

(21) Appl. No.: 15/382,328

(22) Filed: Dec. 16, 2016

(65) Prior Publication Data

US 2017/0175746 A1 Jun. 22, 2017

Related U.S. Application Data

(60) Provisional application No. 62/433,772, filed on Dec. 13, 2016, provisional application No. 62/268,811, filed on Dec. 17, 2015.

(51) Int. Cl.
*F04D 15/02* (2006.01)
*F04D 15/00* (2006.01)
(Continued)

(52) U.S. Cl.
CPC ..... *F04D 15/0218* (2013.01); *F04D 13/068* (2013.01); *F04D 13/086* (2013.01); *F04D 13/14* (2013.01); *F04D 15/0088* (2013.01)

(58) Field of Classification Search
CPC .... F04D 15/0218; F04D 13/068; F04D 13/14; F04D 15/0088
(Continued)

(56) References Cited

U.S. PATENT DOCUMENTS 734,978 A 7/1903 Simpson
791,666 A 6/1905 Wishart
(Continued)

FOREIGN PATENT DOCUMENTS

CA 2420650 9/2004
CN 201307521 9/2009
(Continued)

OTHER PUBLICATIONS

Fundamentals of Fluid Mechanics, 5th Edition (Wiley), 2006, p. 442.*
(Continued)

*Primary Examiner* — Dominick L Plakkoottam
*Assistant Examiner* — Connor J Tremarche
(74) *Attorney, Agent, or Firm* — Fitch, Even, Tabin & Flannery LLP

(57) ABSTRACT

A sump pump system having a primary pump, a fluid level sensor, and a primary controller electrically connected to the primary pump for activating the pump when the fluid level sensor indicates a predetermine fluid level has been reached, the primary controller having a primary interface for communicating with a secondary pump. In some forms, the system includes a secondary pump having a secondary controller electrically connected to the secondary pump and having a secondary interface, the primary and secondary interfaces allowing the primary and secondary pump controllers to communicate with one another and allowing at least one of the primary and secondary pump controllers to assume control of both the primary and secondary pump. Related methods are further described herein.

19 Claims, 55 Drawing Sheets

(51) Int. Cl.
*F04D 13/14* (2006.01)
*F04D 13/08* (2006.01)
*F04D 13/06* (2006.01)

(58) Field of Classification Search
USPC ..... 417/4
See application file for complete search history.

(56) References Cited

U.S. PATENT DOCUMENTS 957,633 A 5/1910 Taub
1,196,925 A 9/1916 Boyer
1,858,246 A 5/1932 Mahan
2,017,033 A 10/1935 Mcguffin
2,044,921 A 6/1936 Swanland
2,225,840 A 12/1940 Newton
2,488,506 A 11/1949 Bernhardt
2,789,575 A 4/1957 Miller
2,810,345 A * 10/1957 Englesson ..... F04D 13/14 415/61
2,856,956 A 10/1958 Smolensky
2,948,661 A 8/1960 O'neill, Jr.
3,025,962 A 3/1962 Williams
3,072,141 A 1/1963 Wheeler, Jr.
3,113,285 A 12/1963 Edwards
3,130,154 A 4/1964 Heskett
3,154,652 A 10/1964 Gilman
3,208,472 A 9/1965 Scaramucci
3,399,399 A 8/1968 Apfelbaum
3,521,659 A 7/1970 Seger
3,563,213 A 2/1971 Hambric
3,563,382 A 2/1971 Regent
3,586,038 A 6/1971 Jahrstorfer
3,610,698 A 10/1971 Gachot
3,634,842 A 1/1972 Niedermeyer
3,656,134 A 4/1972 Brown
3,705,602 A 12/1972 Mollerfors
3,726,606 A 4/1973 Peters
3,814,544 A 6/1974 Roberts et al.
3,824,852 A 7/1974 Otto
3,828,806 A 8/1974 Glos
3,872,419 A 3/1975 Groves
3,875,051 A 4/1975 Kovarik
3,882,476 A 5/1975 Lofgren
3,908,441 A 9/1975 Virloget
3,932,853 A 1/1976 Cannon
3,941,507 A 3/1976 Niedermeyer
3,951,568 A 4/1976 Carlson
3,974,848 A 8/1976 Wheatley
4,108,574 A 8/1978 Bartley
4,117,860 A 10/1978 Carlin
4,119,860 A 10/1978 Gooley
4,137,527 A 1/1979 Tennenhouse
4,144,517 A 3/1979 Baumoel
4,187,503 A 2/1980 Walton
4,202,036 A 5/1980 Bowditch
4,203,324 A 5/1980 Baumoel
4,222,711 A 9/1980 Mayer
4,228,427 A 10/1980 Niedermeyer
4,230,578 A 10/1980 Culp
RE30,532 E 3/1981 Buckner
4,262,216 A 4/1981 Johnston
4,291,261 A 9/1981 Johnston
4,296,633 A 10/1981 Hakansson
4,302,641 A 11/1981 Johnston
4,369,438 A 1/1983 Wilhelmi
4,437,811 A 3/1984 Iwata
4,456,432 A 6/1984 Mannino
4,484,862 A 11/1984 Jensen
4,529,854 A 7/1985 Johnston
4,551,068 A 11/1985 Boudreaux
4,563,274 A 1/1986 Rothon
4,572,934 A 2/1986 Johnston
4,594,153 A 6/1986 Weis
4,598,742 A 7/1986 Taylor
4,600,844 A 7/1986 Atkins
4,630,245 A 12/1986 Dam
4,631,001 A 12/1986 Keech
4,652,802 A 3/1987 Johnston
4,715,966 A 12/1987 Bowman
4,718,457 A 1/1988 Luger
4,738,584 A 4/1988 Price
4,792,660 A 12/1988 Cooley
4,808,077 A 2/1989 Kan
4,820,131 A 4/1989 Johnson
4,904,878 A 2/1990 Gipp
4,945,491 A 7/1990 Rishel
4,961,018 A 10/1990 Akhter
5,015,152 A 5/1991 Greene
5,052,222 A 10/1991 Stoepfel
5,055,000 A 10/1991 Akhter
5,059,954 A 10/1991 Beldham
5,063,778 A 11/1991 Jorritsma
5,087,801 A 2/1992 Johnston
5,142,108 A 8/1992 Johnston
5,145,323 A 9/1992 Farr
5,145,337 A 9/1992 Kirkland
5,155,311 A 10/1992 Utke
5,155,472 A 10/1992 Dam
5,159,318 A 10/1992 Kronberg
5,178,520 A 1/1993 Strelow
5,181,841 A 1/1993 Kirkland
5,201,294 A 4/1993 Osuka
5,205,725 A 4/1993 Pattison
5,234,319 A 8/1993 Wilder
5,238,369 A 8/1993 Farr
5,283,569 A 2/1994 Nelson
5,306,885 A 4/1994 Utke
5,312,594 A 5/1994 Heller
5,314,313 A 5/1994 Janesky
5,319,973 A 6/1994 Crayton
5,365,516 A 11/1994 Jandrell
5,449,274 A 9/1995 Kochan
5,464,327 A 11/1995 Horwitz
5,483,227 A 1/1996 Kuo
5,503,533 A 4/1996 Potter
5,549,456 A 8/1996 Burrill
5,566,079 A 10/1996 Jun
5,570,413 A 10/1996 Ahlberg
5,655,561 A 8/1997 Wendel
5,672,050 A 9/1997 Webber
5,696,493 A 12/1997 Einck
5,742,500 A 4/1998 Irvin
5,747,824 A 5/1998 Jung
5,764,034 A 6/1998 Bowman
5,859,589 A 1/1999 McGrew
5,900,546 A 5/1999 Wilkins
5,908,047 A 6/1999 Nakamura
5,909,352 A 6/1999 Klabunde
5,923,102 A 7/1999 Koenig
5,941,270 A 8/1999 Nogle
5,963,883 A 10/1999 Cunkelman
5,967,759 A 10/1999 Jurado
6,004,463 A 12/1999 Swett
6,012,020 A 1/2000 Gardell
6,029,444 A 2/2000 Nakamura
6,041,965 A 3/2000 Smith
6,138,750 A 10/2000 Ford
6,140,925 A 10/2000 Lee
6,173,739 B1 1/2001 Addo
6,203,282 B1 3/2001 Morin
6,232,883 B1 5/2001 Silva
6,237,625 B1 5/2001 Randolph
6,260,004 B1 7/2001 Hays
6,289,735 B1 9/2001 Dister
6,318,406 B1 11/2001 Conley
6,322,325 B1 11/2001 Belehradek
6,323,774 B1 11/2001 Mitchell
6,364,620 B1 4/2002 Fletcher
6,366,053 B1 4/2002 Belehradek
6,375,430 B1 4/2002 Eckert
6,397,874 B1 6/2002 Featheringill
6,420,668 B1 7/2002 Lee
6,443,715 B1 9/2002 Mayleben
6,462,666 B1 10/2002 Einck

(56) References Cited

U.S. PATENT DOCUMENTS

| | | | |
|---|---|---|---|
| 6,464,531 | B2 | 10/2002 | Eckert |
| 6,469,641 | B1 | 10/2002 | Lash |
| 6,481,973 | B1 | 11/2002 | Struthers |
| 6,489,895 | B1 | 12/2002 | Apelman |
| 6,499,961 | B1 | 12/2002 | Wyatt |
| 6,510,736 | B1 | 1/2003 | Van Ee |
| 6,552,647 | B1 | 4/2003 | Thiessen |
| 6,565,325 | B2 | 5/2003 | Belehradek |
| 6,578,634 | B2 | 6/2003 | Newman |
| 6,632,072 | B2 | 10/2003 | Lipscomb |
| 6,649,839 | B2 | 11/2003 | Eckert |
| 6,675,826 | B1 | 1/2004 | Newman |
| 6,676,382 | B2 | 1/2004 | Leighton |
| 6,683,535 | B1 | 1/2004 | Utke |
| 6,812,848 | B2 | 2/2004 | Candela |
| 6,703,930 | B2 | 3/2004 | Skinner |
| 6,711,908 | B2 | 3/2004 | Ferragut |
| 6,766,835 | B1 | 7/2004 | Fima |
| 6,941,785 | B2 | 9/2005 | Haynes |
| 7,002,481 | B1 | 2/2006 | Crane |
| 7,009,510 | B1 | 3/2006 | Douglass |
| 7,009,511 | B2 | 3/2006 | Mazar |
| 7,021,068 | B2 | 4/2006 | Ferragut |
| 7,030,767 | B2 | 4/2006 | Candela |
| 7,032,435 | B2 | 4/2006 | Hassenflug |
| 7,042,352 | B2 | 5/2006 | Kates |
| 7,053,765 | B1 | 5/2006 | Clark |
| 7,064,677 | B2 | 6/2006 | Newman |
| 7,075,425 | B2 | 7/2006 | Capano |
| 7,083,392 | B2 | 8/2006 | Meza |
| 7,117,120 | B2 | 10/2006 | Beck |
| 7,142,107 | B2 | 11/2006 | Kates |
| 7,153,418 | B2 | 12/2006 | Mauro, Sr. |
| 7,167,087 | B2 | 1/2007 | Corrington |
| 7,182,101 | B2 | 2/2007 | Alacqua |
| 7,183,741 | B2 | 2/2007 | Mehlhorn |
| 7,230,528 | B2 | 3/2007 | Kates |
| 7,209,048 | B1 | 4/2007 | Pace |
| 7,218,237 | B2 | 5/2007 | Kates |
| 7,218,511 | B1 | 5/2007 | Strozyk |
| 7,228,129 | B1 | 6/2007 | Ward |
| 7,264,449 | B1 | 9/2007 | Harned |
| 7,292,139 | B2 | 11/2007 | Mazar |
| 7,292,898 | B2 | 11/2007 | Clark |
| 7,298,278 | B2 | 11/2007 | Miller |
| 7,298,281 | B2 | 11/2007 | Cupples |
| 7,306,008 | B2 | 12/2007 | Tornay |
| 7,307,538 | B2 | 12/2007 | Kochan |
| 7,308,322 | B1 | 12/2007 | Discenzo |
| 7,309,216 | B1 | 12/2007 | Spadola |
| 7,319,853 | B2 | 1/2008 | Luebke |
| 7,342,504 | B2 | 3/2008 | Crane |
| 7,397,360 | B2 | 7/2008 | Corrington |
| 7,406,842 | B2 | 8/2008 | Oh |
| 7,411,494 | B2 | 8/2008 | Kates |
| 7,417,552 | B1 | 8/2008 | Vaskovic |
| 7,423,541 | B2 | 9/2008 | Miller |
| 7,429,842 | B2 | 9/2008 | Schulman |
| 7,431,569 | B2 | 10/2008 | Griffiths |
| 7,458,782 | B1 | 12/2008 | Spadola |
| 7,493,770 | B2 | 2/2009 | Christianson |
| 7,528,711 | B2 | 5/2009 | Kates |
| 7,539,549 | B1 | 5/2009 | Discenzo |
| 7,544,041 | B2 | 6/2009 | Mayleben |
| 7,544,046 | B2 | 6/2009 | Beyer |
| 7,558,699 | B2 | 7/2009 | Beck |
| 7,561,057 | B2 | 7/2009 | Kates |
| 7,572,108 | B2 | 8/2009 | Koehl |
| 7,578,657 | B2 | 8/2009 | Kowalak |
| 7,583,198 | B2 | 9/2009 | Kates |
| 7,612,510 | B2 | 11/2009 | Koehl |
| 7,612,529 | B2 | 11/2009 | Kochan |
| 7,626,508 | B2 | 12/2009 | Kosuge |
| 7,668,694 | B2 | 2/2010 | Anderson |
| 7,671,754 | B2 | 3/2010 | Heilmann |
| 7,672,262 | B2 | 3/2010 | McCoy |
| 7,686,587 | B2 | 3/2010 | Koehl |
| 7,686,589 | B2 | 3/2010 | Stiles, Jr. |
| 7,704,051 | B2 | 4/2010 | Koehl |
| 7,746,243 | B2 | 6/2010 | Chen |
| 7,751,159 | B2 | 7/2010 | Koehl |
| 7,755,318 | B1 | 7/2010 | Panosh |
| 7,768,413 | B2 | 8/2010 | Kosuge |
| 7,778,633 | B2 | 8/2010 | Ward |
| 7,789,850 | B2 | 9/2010 | Roger |
| 7,791,467 | B2 | 9/2010 | Mazar |
| 7,798,781 | B2 | 9/2010 | Parsons |
| 7,802,453 | B2 | 9/2010 | Oh |
| 7,815,420 | B2 | 10/2010 | Koehl |
| 7,817,031 | B2 | 10/2010 | Kates |
| 7,821,215 | B2 | 10/2010 | Koehl |
| 7,831,282 | B2 | 11/2010 | Luebke |
| 7,845,913 | B2 | 12/2010 | Stiles, Jr. |
| 7,857,600 | B2 | 12/2010 | Koehl |
| 7,869,978 | B2 | 1/2011 | Anderson |
| 7,874,808 | B2 | 1/2011 | Stiles |
| 7,889,087 | B2 | 2/2011 | Boss |
| 7,893,812 | B2 | 2/2011 | Kates |
| 7,893,827 | B2 | 2/2011 | Kates |
| 7,893,828 | B2 | 2/2011 | Kates |
| 7,900,647 | B2 | 3/2011 | Tornay |
| 7,936,264 | B2 | 5/2011 | Kates |
| 7,956,735 | B2 | 6/2011 | Jackson |
| 7,976,284 | B2 | 7/2011 | Koehl |
| 7,979,240 | B2 | 7/2011 | Fielder |
| 7,982,602 | B2 | 7/2011 | Kates |
| 7,983,877 | B2 | 7/2011 | Koehl |
| 7,990,091 | B2 | 8/2011 | Koehl |
| 8,004,415 | B2 | 8/2011 | Boss |
| 8,019,479 | B2 | 9/2011 | Stiles |
| 8,031,079 | B2 | 10/2011 | Kates |
| 8,036,829 | B2 | 10/2011 | Gibbs |
| 8,043,070 | B2 | 10/2011 | Stiles, Jr. |
| 8,055,401 | B2 | 11/2011 | Aldrich |
| 8,059,010 | B2 | 11/2011 | Guazzelli |
| 8,060,078 | B2 | 11/2011 | Ward |
| 8,068,026 | B1 | 11/2011 | Delerno |
| 8,075,304 | B2 | 12/2011 | Cox |
| 8,096,001 | B2 | 1/2012 | Stimpson |
| 8,099,195 | B2 | 1/2012 | Imes |
| 8,120,500 | B2 | 2/2012 | Tokhtuev |
| 8,128,340 | B2 | 3/2012 | Racer |
| 8,130,093 | B2 | 3/2012 | Mazar |
| 8,130,107 | B2 | 3/2012 | Meyer |
| 8,165,781 | B2 | 4/2012 | Johnson |
| 8,180,489 | B2 | 5/2012 | Quinn |
| 8,180,593 | B2 | 5/2012 | Anderson |
| 8,183,995 | B2 | 5/2012 | Wang |
| 8,185,260 | B2 | 5/2012 | Delaloye |
| 8,223,032 | B2 | 7/2012 | Van Gorp |
| 8,226,371 | B2 | 7/2012 | Kochan |
| 8,242,920 | B1 | 8/2012 | Mostowfi |
| 8,249,826 | B1 | 8/2012 | Anderson |
| 8,297,937 | B2 | 10/2012 | Johnson |
| 8,332,055 | B2 | 12/2012 | Veillette |
| 8,334,763 | B2 | 12/2012 | Jackson |
| 8,335,593 | B2 | 12/2012 | Johnson |
| 8,350,710 | B2 | 1/2013 | Logan |
| 8,378,833 | B2 | 2/2013 | Miller |
| 8,380,355 | B2 | 2/2013 | Mayleben |
| 8,393,352 | B2 | 3/2013 | Porter-Coote |
| 8,395,498 | B2 | 3/2013 | Gaskill |
| 8,412,473 | B2 | 4/2013 | Woltring |
| 8,417,483 | B2 | 4/2013 | Anderson |
| 8,451,113 | B2 | 5/2013 | Mazar |
| 8,465,262 | B2 | 6/2013 | Stiles, Jr. |
| 8,467,908 | B2 | 6/2013 | Broniak |
| 8,469,675 | B2 | 6/2013 | Stiles, Jr. |
| 8,500,413 | B2 | 8/2013 | Stiles, Jr. |
| 8,504,180 | B2 | 8/2013 | Imes |
| 8,528,611 | B2 | 9/2013 | Wilson |
| 8,540,493 | B2 | 9/2013 | Koehl |
| 8,558,677 | B2 | 10/2013 | Shuster |
| 8,573,952 | B2 | 11/2013 | Stiles, Jr. |

(56) References Cited

U.S. PATENT DOCUMENTS 8,579,600 B2 11/2013 Vijayakumar
8,583,333 B2 11/2013 Rennie
8,585,377 B2 11/2013 Kamen
8,602,744 B2 12/2013 Ward
8,602,745 B2 12/2013 Stiles, Jr.
8,641,385 B2 2/2014 Koehl
8,651,824 B2 2/2014 Ward
8,665,111 B2 3/2014 Wang
8,704,678 B2 4/2014 Wang
8,801,389 B2 8/2014 Stiles, Jr.
8,816,860 B2 8/2014 Ophardt
8,840,376 B2 9/2014 Stiles, Jr.
8,875,729 B1 * 11/2014 Bramble ..... E03F 5/22 137/362
8,892,263 B1 11/2014 Morris
8,954,336 B2 2/2015 Blomquist
8,956,130 B2 2/2015 Buzit
8,967,183 B2 3/2015 Oakner
8,971,958 B2 3/2015 Frikart
8,976,031 B2 3/2015 Ophardt
9,002,528 B1 4/2015 Morris
9,039,383 B2 5/2015 Okamoto
9,051,930 B2 6/2015 Stiles, Jr.
9,091,262 B2 7/2015 Runkle
9,157,434 B2 10/2015 Leonard
9,181,895 B2 11/2015 Roberts
9,206,913 B2 12/2015 Rankin
9,217,577 B2 12/2015 Oakner
9,260,943 B2 2/2016 Eriksson
9,278,237 B2 3/2016 Cook
9,289,110 B2 3/2016 Woolford
9,324,049 B2 4/2016 Thomeer
9,328,727 B2 5/2016 Koehl
9,350,710 B2 5/2016 Herle
9,371,829 B2 6/2016 Koehl
9,383,244 B2 7/2016 Bishop
9,394,899 B2 7/2016 Garvey
9,399,992 B2 7/2016 Koehl
9,404,500 B2 8/2016 Stiles, Jr.
9,439,050 B2 9/2016 Ward
9,441,632 B2 9/2016 Bishop
9,492,071 B2 11/2016 Woolford
9,499,412 B1 11/2016 McKinney
9,500,193 B2 11/2016 Knight
9,511,184 B2 12/2016 Woolford
9,551,344 B2 1/2017 Stiles, Jr.
9,556,887 B2 1/2017 Carpenter
9,603,990 B2 3/2017 Woolford
9,605,680 B2 3/2017 Stiles, Jr.
9,637,941 B2 5/2017 Bright
9,638,193 B2 5/2017 Bishop
9,656,017 B2 5/2017 Greene
9,670,692 B2 6/2017 Oshmyansky
9,670,918 B2 6/2017 Mueller
9,696,360 B2 7/2017 Rothbart
9,703,275 B2 7/2017 Ersavas
9,709,431 B1 7/2017 Kinney
9,770,114 B2 9/2017 Brosnan
9,777,723 B2 10/2017 Wiegman
9,777,733 B2 10/2017 Stiles, Jr.
9,796,320 B2 10/2017 McGuffin
9,889,246 B2 2/2018 Woolford
9,927,479 B2 3/2018 Rothbart
9,932,984 B2 4/2018 Stiles, Jr.
2001/0002597 A1 6/2001 Addo
2002/0072270 A1 6/2002 Eckert
2002/0076331 A1 6/2002 Eckert
2002/0102162 A1 8/2002 Belehradek
2002/0158776 A1 10/2002 Lash
2002/0176782 A1 11/2002 Batchelder et al.
2003/0049134 A1 3/2003 Leighton
2003/0076744 A1 4/2003 Zick
2003/0184444 A1 10/2003 Collings
2004/0260425 A1 12/2004 Giacaman
2005/0009511 A1 1/2005 Bostrom
2005/0034383 A1 2/2005 Allen
2005/0099311 A1 5/2005 Eskins
2005/0158177 A1 7/2005 Mehlhorn
2005/0184879 A1 8/2005 McPherson
2005/0235306 A1 10/2005 Fima
2005/0281679 A1 * 12/2005 Niedermeyer ..... F04D 15/029 417/36
2006/0007008 A1 1/2006 Kates
2006/0008355 A1 1/2006 Low
2006/0078435 A1 4/2006 Burza
2006/0096648 A1 5/2006 Guerrier
2006/0125646 A1 6/2006 McPherson
2006/0176000 A1 8/2006 Schulman
2006/0226997 A1 10/2006 Kochan
2006/0240818 A1 10/2006 McCoy
2006/0272830 A1 12/2006 Fima
2007/0022994 A1 2/2007 Moskun
2007/0103324 A1 5/2007 Kosuge
2007/0175633 A1 8/2007 Kosmala
2007/0224050 A1 9/2007 Ward
2007/0252717 A1 11/2007 Fielder
2007/0258827 A1 11/2007 Gierke
2008/0031751 A1 2/2008 Littwin
2008/0031752 A1 2/2008 Littwin
2008/0197999 A1 8/2008 Henderson
2008/0229819 A1 9/2008 Mayleben et al.
2008/0233983 A1 9/2008 Park
2008/0298978 A1 12/2008 Schulman
2008/0299961 A1 12/2008 Muller
2009/0081050 A1 3/2009 Moore
2009/0129940 A1 5/2009 Stevens
2009/0162211 A1 6/2009 Kochan
2009/0173060 A1 7/2009 Lortet
2009/0192731 A1 7/2009 De Jesus
2009/0208345 A1 8/2009 Moore
2009/0234513 A1 9/2009 Wiggins
2009/0243863 A1 10/2009 Lease
2009/0249128 A1 10/2009 Heckman
2009/0269217 A1 10/2009 Vijayakumar
2009/0299535 A1 12/2009 Delaloye
2010/0001867 A1 1/2010 Rodrigue
2010/0085198 A1 4/2010 Boss
2010/0110792 A1 5/2010 Lutze
2010/0111716 A1 5/2010 Gibbs
2010/0117604 A1 5/2010 Zeier
2010/0127848 A1 5/2010 Mustapha
2010/0180811 A1 7/2010 Sotiriou
2010/0197364 A1 8/2010 Lee
2010/0197855 A1 8/2010 Blom
2010/0215511 A1 8/2010 Eller
2011/0025501 A1 2/2011 Kates
2011/0085917 A1 4/2011 Ward
2011/0085919 A1 4/2011 Williams
2011/0110794 A1 * 5/2011 Mayleben ..... F04B 23/021 417/53
2011/0150676 A1 * 6/2011 Buzit ..... F04D 9/008 417/410.1
2011/0175740 A1 7/2011 Miner
2011/0195664 A1 8/2011 Keirstead
2011/0215919 A1 9/2011 Hernandez
2011/0273288 A1 11/2011 Kochan
2011/0306931 A1 12/2011 Kamen
2011/0311370 A1 12/2011 Sloss
2011/0311402 A1 12/2011 Steynberg
2012/0126990 A1 5/2012 Chan
2012/0141301 A1 6/2012 Van Der Spek
2012/0251333 A1 10/2012 Irwin
2012/0252430 A1 10/2012 Imes
2012/0260729 A1 10/2012 Bayley
2012/0295567 A1 11/2012 Tropper
2012/0325460 A1 12/2012 Lisk
2012/0328453 A1 12/2012 Lisk
2013/0071260 A1 3/2013 Worden
2013/0080800 A1 3/2013 Veillette
2013/0109404 A1 5/2013 Husney
2013/0154851 A1 6/2013 Gaskill
2013/0203359 A1 8/2013 Seiler
2013/0241727 A1 9/2013 Coulombe
2013/0243614 A1 9/2013 Moon

(56) References Cited

U.S. PATENT DOCUMENTS

| | | | | |
|---|---|---|---|---|
| 2013/0252601 | A1 | 9/2013 | Yu | |
| 2013/0259707 | A1 | 10/2013 | Yin | |
| 2013/0271279 | A1 | 10/2013 | Mazar | |
| 2014/0099213 | A1 | 4/2014 | Adams | |
| 2014/0107499 | A1 | 4/2014 | Dunsirn | |
| 2014/0119946 | A1 | 5/2014 | Boese | |
| 2014/0119947 | A1 | 5/2014 | Bishop | |
| 2014/0120901 | A1 | 5/2014 | Ward | |
| 2014/0199180 | A1* | 7/2014 | Schoendorff | F04B 51/00 417/53 |
| 2014/0202243 | A1 | 7/2014 | Leonard | |
| 2014/0248162 | A1 | 9/2014 | Beaudin | |
| 2014/0262130 | A1 | 9/2014 | Yenni | |
| 2014/0262134 | A1 | 9/2014 | Arensmeier | |
| 2014/0266755 | A1 | 9/2014 | Arensmeier | |
| 2014/0314062 | A1 | 10/2014 | Loebs | |
| 2014/0316819 | A1 | 10/2014 | Dunsirn | |
| 2014/0356197 | A1 | 12/2014 | Hotovec | |
| 2014/0371925 | A1 | 12/2014 | Butler | |
| 2015/0044060 | A1 | 2/2015 | Kochan | |
| 2015/0064021 | A1 | 3/2015 | Laing | |
| 2015/0095100 | A1 | 4/2015 | Vittal | |
| 2015/0100169 | A1 | 4/2015 | McKinney | |
| 2015/0110642 | A1 | 4/2015 | Dahouk | |
| 2015/0143891 | A1 | 5/2015 | Cummings | |
| 2015/0143892 | A1 | 5/2015 | Cummings | |
| 2015/0143893 | A1 | 5/2015 | Cummings | |
| 2015/0143894 | A1 | 5/2015 | Cummings | |
| 2015/0143895 | A1 | 5/2015 | Cummings | |
| 2015/0143896 | A1 | 5/2015 | Cummings | |
| 2015/0143897 | A1 | 5/2015 | Cummings | |
| 2015/0143900 | A1 | 5/2015 | Cummings | |
| 2015/0144818 | A1 | 5/2015 | Cummings | |
| 2015/0147190 | A1 | 5/2015 | Cummings | |
| 2015/0154369 | A1 | 6/2015 | Blomquist | |
| 2015/0316063 | A1 | 11/2015 | Bishop | |
| 2015/0316908 | A1 | 11/2015 | Eller | |
| 2015/0322951 | A1 | 11/2015 | Bishop | |
| 2015/0322953 | A1 | 11/2015 | Boese | |
| 2015/0330861 | A1 | 11/2015 | Alsaleem | |
| 2015/0362925 | A1 | 12/2015 | Uy | |
| 2015/0376874 | A1 | 12/2015 | Breedlove | |
| 2016/0002942 | A1 | 1/2016 | Orlando | |
| 2016/0038675 | A1 | 2/2016 | Estes | |
| 2016/0082166 | A1 | 3/2016 | Guthrie | |
| 2016/0130796 | A1 | 5/2016 | Chen | |
| 2016/0231721 | A1 | 8/2016 | Lakshmanan | |
| 2016/0242369 | A1 | 8/2016 | Caceres | |
| 2016/0245279 | A1 | 8/2016 | Pal | |
| 2016/0249154 | A1 | 8/2016 | Addy | |
| 2016/0356026 | A1 | 12/2016 | Engler | |
| 2016/0359785 | A1 | 12/2016 | Ward | |
| 2017/0057667 | A1 | 3/2017 | Ward | |
| 2017/0078396 | A1 | 3/2017 | Haas | |
| 2017/0107992 | A1 | 4/2017 | Cheng | |
| 2017/0122325 | A1 | 5/2017 | Seman, Jr. | |
| 2017/0130978 | A1 | 5/2017 | Edwards | |
| 2017/0145666 | A1 | 5/2017 | Kochan, Jr. | |
| 2017/0170979 | A1 | 6/2017 | Khalid | |
| 2017/0175746 | A1 | 6/2017 | Mayleben | |
| 2017/0184657 | A1 | 6/2017 | Neti | |
| 2017/0193789 | A1 | 7/2017 | Economy | |
| 2017/0209338 | A1 | 7/2017 | Potucek | |
| 2017/0214349 | A1 | 7/2017 | Priem | |
| 2017/0235318 | A1 | 8/2017 | Bright | |
| 2017/0241422 | A1 | 8/2017 | Munk | |
| 2017/0272844 | A1 | 9/2017 | Bergqvist | |
| 2017/0350427 | A1 | 12/2017 | Leinonen | |

FOREIGN PATENT DOCUMENTS

| | | | | |
|---|---|---|---|---|
| EP | 0501459 | A2 | 9/1992 | |
| EP | 1497558 | B1 | 1/2005 | |
| EP | 1826408 | A2 | 8/2007 | |
| EP | 1880328 | A1 | 1/2008 | |
| EP | 1910683 | A1 | 4/2008 | |
| EP | 2025881 | A2 | 2/2009 | |
| EP | 2025943 | A2 | 2/2009 | |
| EP | 1426604 | | 9/2010 | |
| EP | 2509017 | A2 | 10/2012 | |
| EP | 2511889 | A2 | 10/2012 | |
| EP | 2712599 | A1 * | 4/2014 | A61H 9/005 |
| EP | 2850319 | A1 | 3/2015 | |
| EP | 2984346 | A1 | 2/2016 | |
| EP | 3059982 | A1 | 8/2016 | |
| EP | 3089623 | A1 | 11/2016 | |
| EP | 3135911 | A1 | 3/2017 | |
| EP | 3155790 | A1 | 4/2017 | |
| EP | 3177342 | A1 | 6/2017 | |
| FI | 20146077 | | 6/2016 | |
| GB | 2451876 | | 2/2009 | |
| GB | 2541682 | | 3/2017 | |
| JP | H04272472 | | 9/1992 | |
| WO | 1999032816 | | 7/1999 | |
| WO | 2003029134 | | 4/2003 | |
| WO | 2003089791 | | 10/2003 | |
| WO | 2003099705 | | 12/2003 | |
| WO | 2005055694 | | 6/2005 | |
| WO | 2005083619 | | 9/2005 | |
| WO | 2006096075 | | 9/2006 | |
| WO | 2006096854 | | 9/2006 | |
| WO | 2006105017 | | 10/2006 | |
| WO | 2006108304 | | 10/2006 | |
| WO | 2007012178 | | 2/2007 | |
| WO | 2007085783 | | 8/2007 | |
| WO | 2007107815 | | 9/2007 | |
| WO | 2009146003 | | 12/2009 | |
| WO | 2010092238 | | 8/2010 | |
| WO | 2010099426 | | 9/2010 | |
| WO | 2010144782 | | 12/2010 | |
| WO | 2012065160 | | 5/2012 | |
| WO | 2012074274 | | 6/2012 | |
| WO | 2012161744 | | 11/2012 | |
| WO | 2013041616 | | 3/2013 | |
| WO | 2013130155 | | 9/2013 | |
| WO | 2013171245 | | 11/2013 | |
| WO | 2014035610 | | 3/2014 | |
| WO | 2014066551 | | 5/2014 | |
| WO | 2014066688 | | 5/2014 | |
| WO | 2014169275 | | 10/2014 | |
| WO | 2015028038 | | 3/2015 | |
| WO | 2015047594 | | 4/2015 | |
| WO | 2015061050 | | 4/2015 | |
| WO | 2015103301 | | 7/2015 | |
| WO | 2015132278 | | 9/2015 | |
| WO | 2015165676 | | 11/2015 | |
| WO | 2015175737 | | 11/2015 | |
| WO | 2015175814 | | 11/2015 | |
| WO | 2015187536 | | 12/2015 | |
| WO | 2015191336 | | 12/2015 | |
| WO | 2015196174 | | 12/2015 | |
| WO | 2016022775 | | 2/2016 | |
| WO | 2016059112 | | 4/2016 | |
| WO | 2016087056 | | 6/2016 | |
| WO | 2016092150 | | 6/2016 | |
| WO | 2016137848 | | 9/2016 | |
| WO | 2016137849 | | 9/2016 | |
| WO | 2016178683 | | 11/2016 | |
| WO | 2016189546 | | 12/2016 | |
| WO | 2016205100 | | 12/2016 | |
| WO | 2016205101 | | 12/2016 | |
| WO | 2017064553 | | 4/2017 | |
| WO | 2017083141 | | 5/2017 | |
| WO | 2017161126 | | 9/2017 | |
| WO | 2017173463 | | 10/2017 | |
| WO | 2017174149 | | 10/2017 | |

OTHER PUBLICATIONS

International Search Report issued in International Application No. PCT/US2013/066692, dated May 7, 2014, 5 pp.

(56) References Cited

OTHER PUBLICATIONS

Wayback Machine, NexPump.com, Internet Advertising of New "Ai Extreme" Series, Mar. 2, 2012, 2 pp.
Patent Cooperation Treaty, International Searching Authority, Notification of Transmittal of the International Search Report and the Written Opinion of the International Searching Authority, or the Declaration issued in International Application No. PCT/US2017/066175, dated Mar. 29, 2018, 8 pp.
Blue Angel Pump Company, Blue Angel Catalog, 2018, 34 pp.
Blue Angel Pump Company, Blue Angel Catalog, Oct. 2015, 39 pp.
Wayne Water Systems, Wayne Catalog, Oct. 2014, 52 pp.
Wayback Machine, Wayne/Scott Fetzer Company, waynepumps.com, Pumps on sale or publicly available more than 1 year prior to the filing of the instant application, Feb. 5, 2014, 1 p.

* cited by examiner

2 OPTO ISOLATORS

INTEGRATED SUMP PUMP CONTROLLER WITH STATUS NOTIFICATIONS

CROSS-REFERENCE TO RELATED APPLICATIONS

This application claims the benefit of U.S. Provisional Application No. 62/433,772, filed Dec. 13, 2016 and U.S. Provisional Application No. 62/268,811, filed Dec. 17, 2015, both of which are incorporated herein by reference in their entirety.

FIELD OF TECHNOLOGY

The present disclosure generally describes sump pump systems and related methods. More specifically, the present disclosure describes sump pumps that integrate a backup battery powered pumping system and a controller that provides status notification options, as well as related methods.

BACKGROUND

Sumps are low pits or basins designed to collects undesirable liquids such as water around the foundation of a home. Water that seeps into the home from the outside can flow into the sump to prevent water from spreading throughout the home. If too much water seeps into the sump, a sump pump can be employed to move the water from the sump to a location outside the house.

A typical electric basement sump pump includes a pump to remove water from the sump basin, and various switches and related components that turn the pump on and off when appropriate, based on the water levels in the sump. Electric sump pumps are generally powered via an AC power source that plugs into a home's AC power supply.

Sump pump systems can also be equipped with audible alarm and/or user notification systems that transmit messages via text, e-mail, or a phone call to a user in the event of pump malfunction, power outage, or high water (flooding) conditions.

SUMMARY

The present disclosure describes sump pumps that integrate a backup powered sump pump system into a primary powered sump pump. The present disclosure also describes sump pumps that integrate control and notification systems that determine when to activate the backup DC powered sump pump system, and notify home owners regarding the operating status of the integrated pumping system. In addition to various exemplary embodiments, the present disclosure further covers methods related to the aforesaid embodiments.

BRIEF DESCRIPTION OF THE DRAWINGS

Described herein are embodiments of systems, methods and apparatus for addressing shortcomings of known sump pumps.

This description includes drawings, wherein.

Figure 1A:
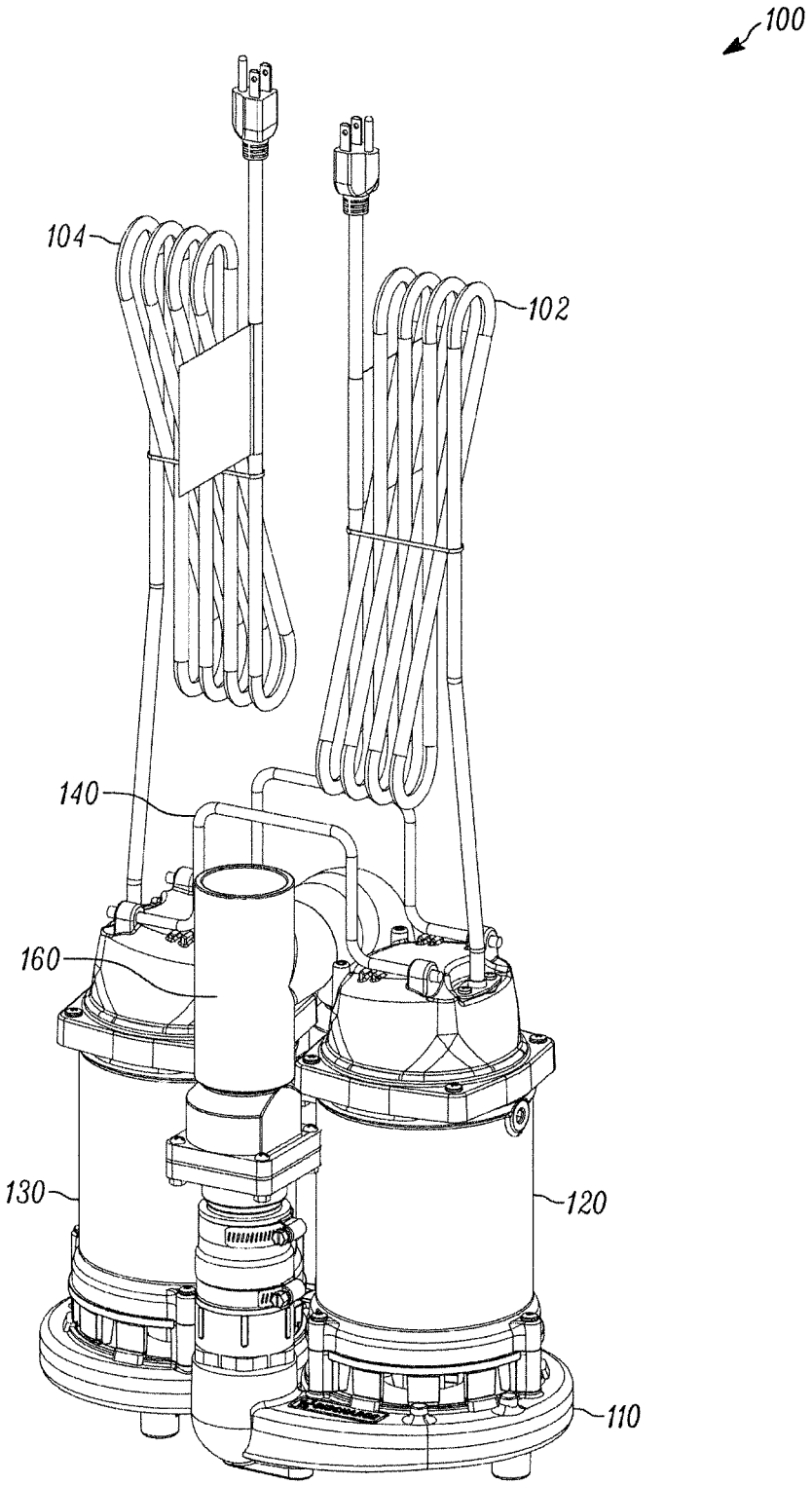
FIG. 1A shows an isometric view of an example tandem sump pump assembly described herein.
Figure 1B:
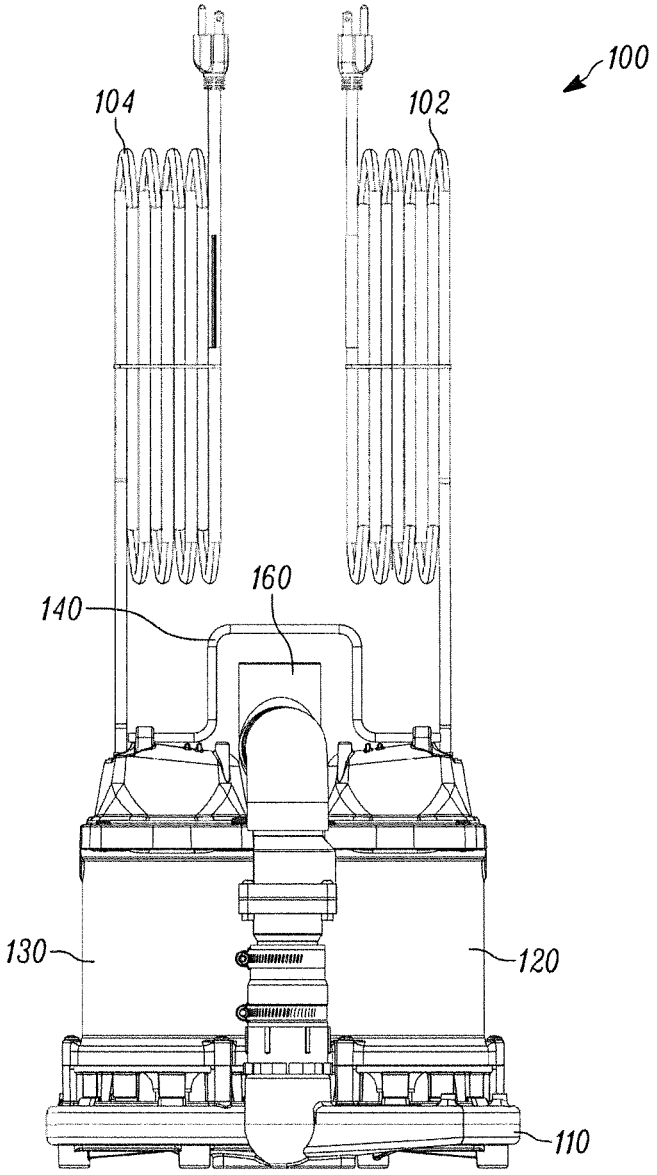
FIGS. 1B and 1C show front and rear elevation views, respectively, of the tandem sump pump assembly of FIG. 1.
Figure 1C:
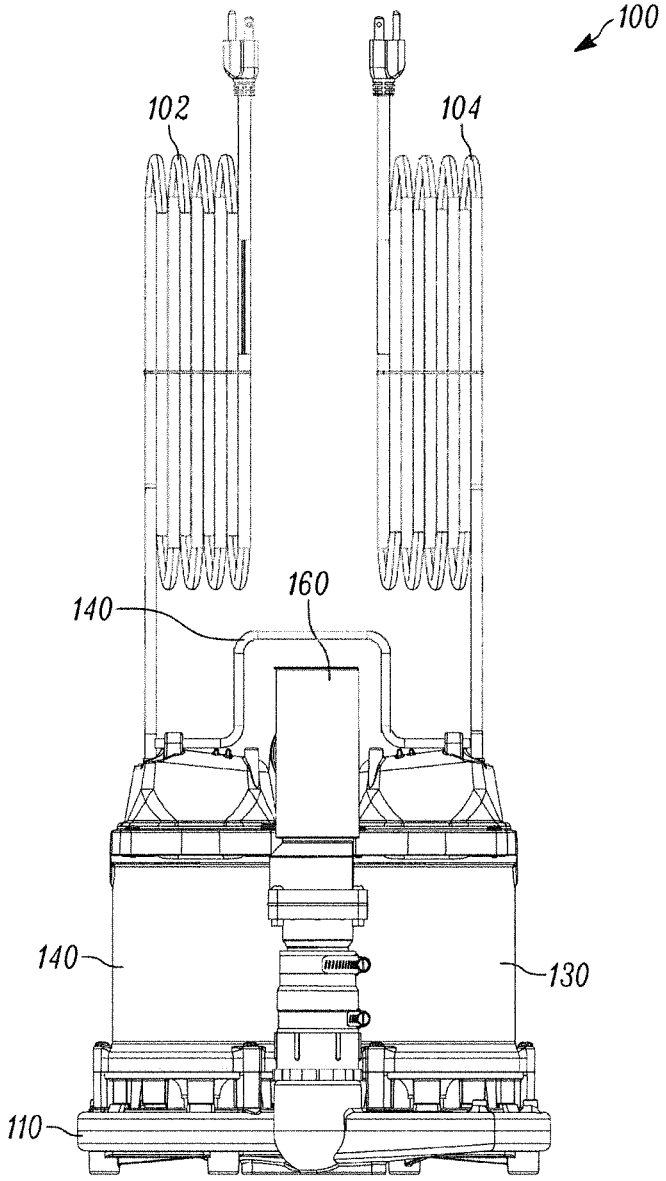
Figure 1D:
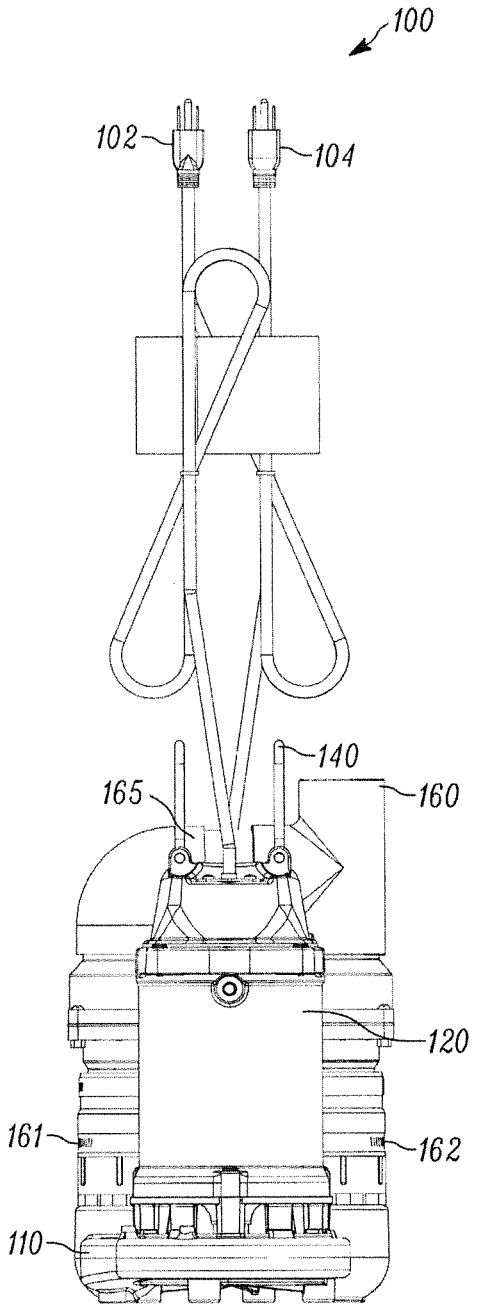
FIGS. 1D and 1E show right and left elevation views, respectively, of the tandem sump pump assembly of FIG. 1.
Figure 1E:
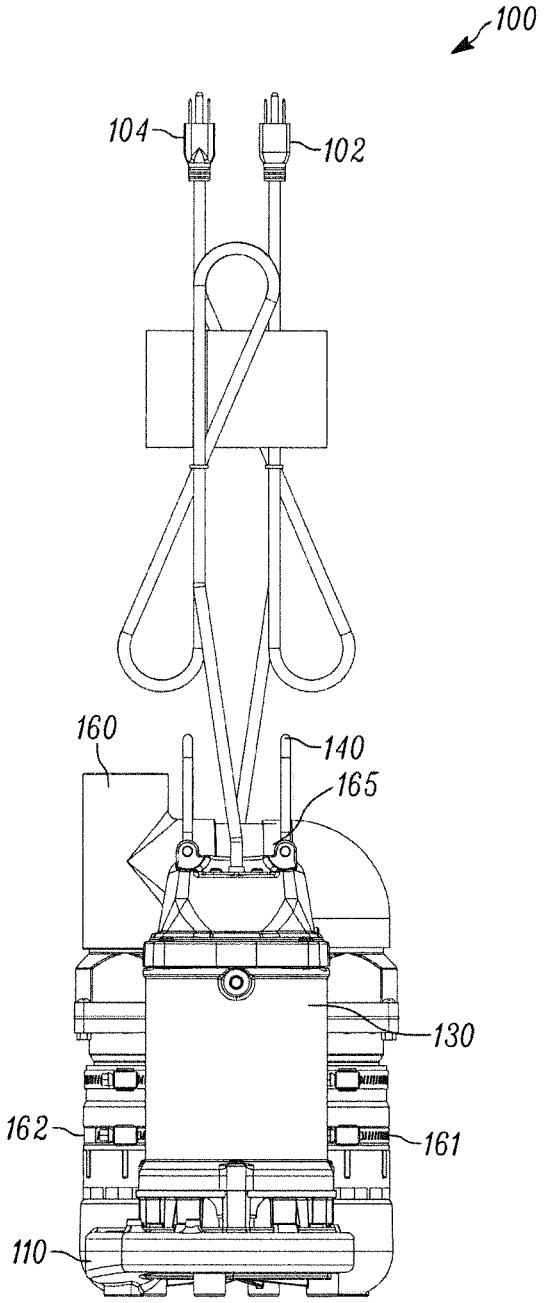
Figure 1F:
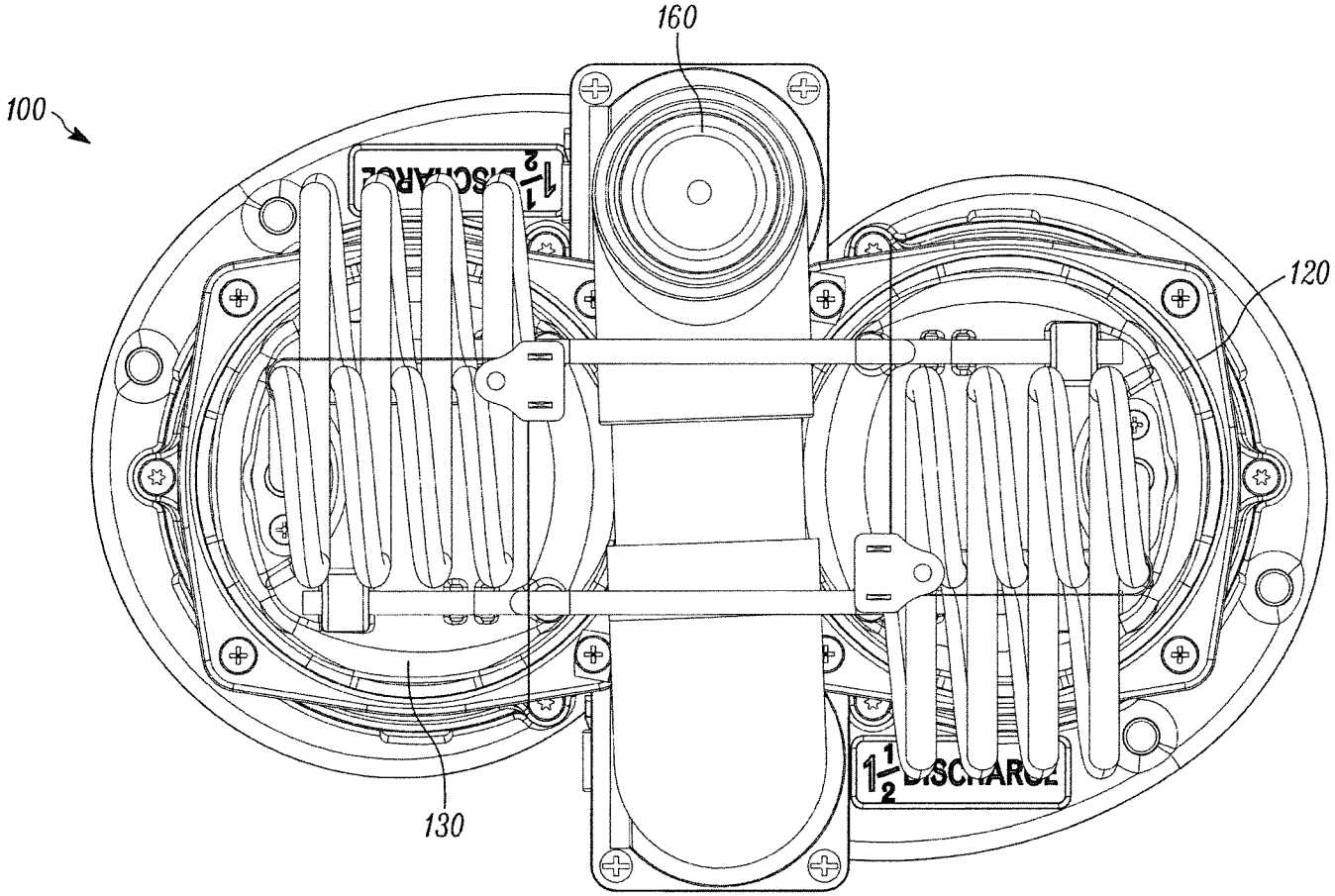
FIGS. 1F and 1G show top and bottom plan views, respectively, of the tandem sump pump assembly of FIG. 1.

Corresponding reference characters in the attached drawings indicate corresponding components throughout the several views of the drawings. In addition, elements in the figures are illustrated for simplicity and clarity and have not necessarily been drawn to scale. For example, the dimensions of some of the elements in the figures may be exaggerated relative to other elements to help to improve understanding of various embodiments. Also, common but well-understood elements that are useful or necessary in a commercially feasible embodiment are often not depicted or described in order to facilitate a less obstructed view of the illustrated elements and a more concise disclosure.

DETAILED DESCRIPTION

Sump pumps are often most useful during storms. That is because storms bring in large amounts of water that can lead to flooding. However, storms can also result in a home losing power. In such a situation, an AC powered sump pump will be unable to operate. Accordingly, for security purposes, home owners also install a battery back-up system that can supply power to a DC pump to remove water from the sump basin in the event of an AC power outage or primary pump malfunction.

Figure 7:
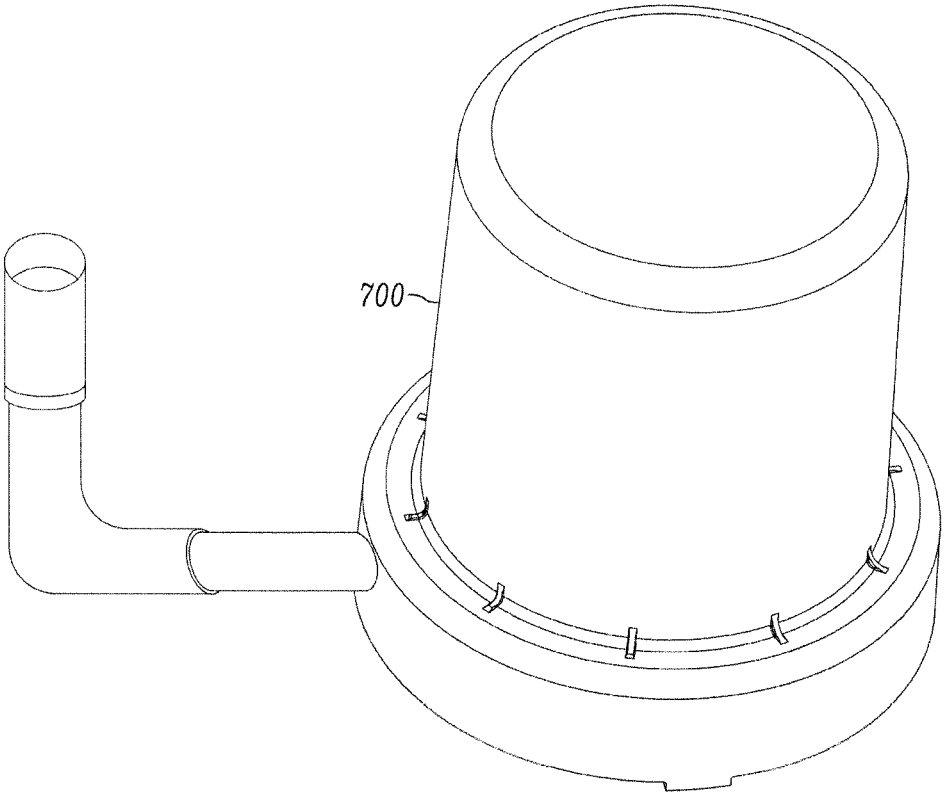
PRIOR ART FIGURE 7
FIG. 7 is an example of a conventional DC powered backup sump pump.

Such a battery back-up system may include a DC powered pump to remove water from the sump basin, float level switches and related components to turn the pump on & off based on water levels, and a 12-volt DC battery with a charging system and related electrical connections. An example of such a conventional pump 700 is shown in FIG. 7.

Combining a primary AC powered sump pump system with a separate backup DC powered sump pump system can present several drawbacks. For example, as the complexity of these primary & back-up pump systems increase, the overall reliability can be impacted by the number of switches and electrical connections.

Additionally, the ability of the system to transmit messages during power outages can be compromised or limited in function, as the notification systems generally rely on home functionality (e.g., land line circuits) that are also inoperable during power outages. Thus, these systems cannot take advantage of the latest communication technologies.

Further, sump systems with two pumps and multiple float switches are often too large to fit into the smaller diameter sump pits found in older homes. As a result, such homes with smaller sump pits are not able to take advantage of the benefits of a conventional backup DC sump pump system or require homeowners to purchase items to help place the pumps in a staggered manner in the sump pit which is not convenient.

The present disclosure describes sump pumps that integrate a backup DC powered sump pump system into a primary AC powered sump pump. The present disclosure also describes sump pumps that integrate control and notification systems that determine when to activate the backup DC powered sump pump system, and notify home owners regarding the operating status of the integrated pumping system.

FIG. 1A shows an isometric view of an example tandem sump pump assembly 100. As shown in the Figure, the sump pump assembly 100 includes a first pump 120 and a second pump 130. FIGS. 1B-G show front, rear, right, left, top, and bottom views of the tandem pump assembly 100, respectively.

In the form shown, the first pump 120 is a primary pump powered via an AC power supply 102 and the second pump 130 is a backup pump powered by a DC power supply 104, such as a battery. However, it should be understood that in alternate embodiments the pumps can be setup in any desired configuration. For example, in some embodiments, pump 130 could be the primary AC pump and pump 120 could be the backup DC pump. In other embodiments, both pumps 120 and 130 could be AC pumps powered via an AC power supply, or DC pumps powered by a DC power supply. In still other embodiments, pumps 120, 130 could be any combination of AC/DC pumps desired.

Figure 1G:
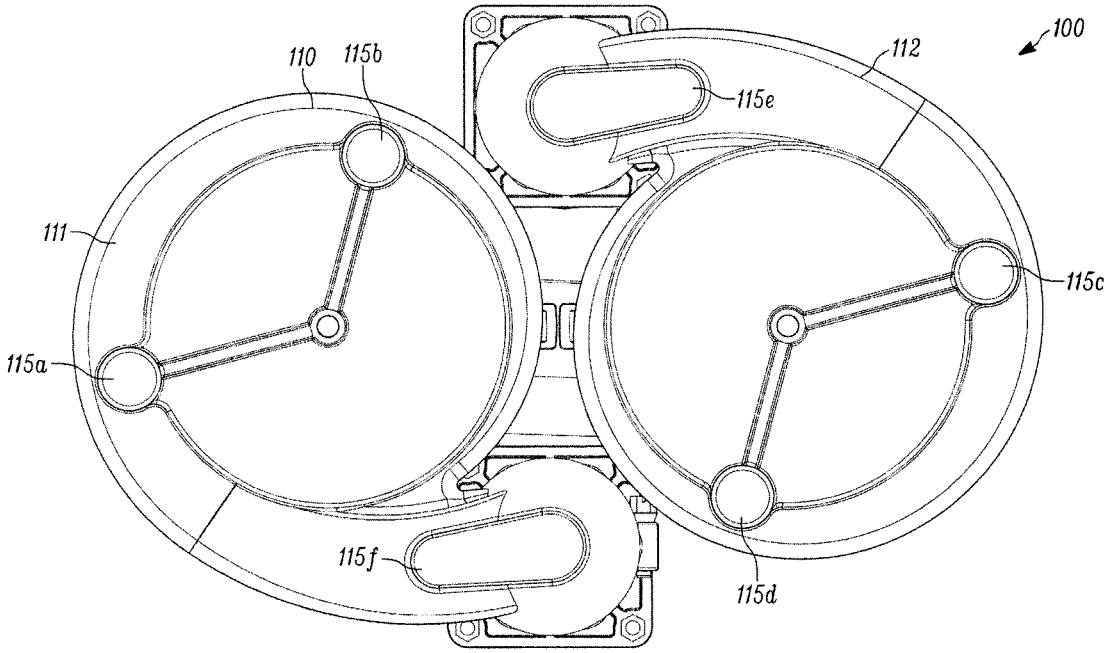

Turning back to the embodiment illustrated in FIGS. 1A-G, in a preferred form, the system 100 includes two separate check valves 161 and 162 that inhibit backflow into each of the separate pumps, but that ultimately discharge into a common discharge outlet 160. In addition, the pump assembly comprises a twin volute 110, that serves as the volute for both pumps 120, 130 of the assembly. In some examples, the twin volute 110 comprises two separate volutes 111 and 112 (e.g., one for each pump) that are not in fluid communication with one another as shown in FIG. 1G. In some examples, the twin volutes 111 and 112 can be arranged in a space saving and attached configuration as shown in FIG. 1G. In this form, the volutes 111, 112 are shown to have a "yin-yang" configuration (or semi-yin-yang configuration), which allows the pump to save space. This space saving configuration allows the assembly 100 to fit into smaller sump pits. In some examples the volutes 111 and 112 may be similar or even identical in size. In other examples, one volute (e.g., volute 112) may be larger or even significantly larger than the other as will be discussed further below regarding alternate embodiments.

While the embodiment shown in FIGS. 1A-G illustrate the volutes being connected to one another to make the tandem system 100 easier to place in the sump pit together as a stable assembly, it should be understood that in alternate embodiments the pumps and pump components may be configured so as not to be connected to one another except by the common discharge piping to simplify servicing so that one pump may be removed and worked on or replaced without requiring removal of the other pump, if desired (which will also be discussed further below regarding alternate embodiments).

Figure 6:
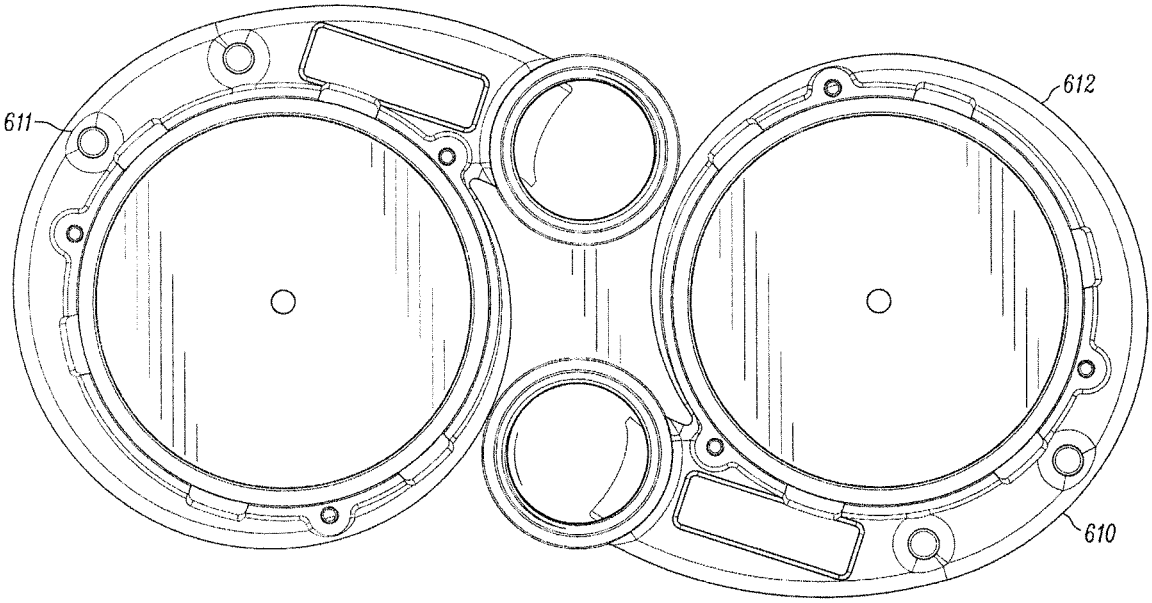
FIG. 6 shows a top view of an exemplary configuration of a twin volute component of a tandem sump pump assembly.

Turning back to the embodiment illustrated, FIG. 1G shows the twin volute 110 as two separate volutes 111 and 112 that are separable from one another, but interconnected or connected to one another via a fastener or connector. That is, they are not formed as part of a single piece, but are instead held together by way of a fastener or connector. In alternate forms, the volutes may be held together with assembly 100 via attachment to the pump assembly 100 (e.g., via attachment to their respective pumps which are then connected to one another via the common discharge piping). Pads 115*a-f* on the bottom surface of the twin volute can help support the stability of the system 100. In some embodiments, however, the twin volute 110 can be a single piece that may be formed, for example, from a single molded or cast material. FIG. 6 shows an example of a twin volute 610 formed as a single component.

In some examples, the independent volutes 111/611 and 112/612 of the twin volute 110/610 are not in fluid communication, even if the volutes are formed as a single component, as shown in FIG. 6. That is, they are discrete or individual volute chambers or fluid passages with no fluid path connecting the two volute chambers or fluid passages. In other examples, however, the twin volute 110/610 may include a single or common volute chamber or fluid passage such that the volute for each of pumps 120 and 130 are one in the same or at least in fluid communication with one another.

Referring again to FIGS. 1A-G, the assembly 100 includes an integrated handle 140 that allows for both pumps to be carried together, and lowered into a sump or a pit in a basement. This integrated handle 140 allows for easy installation or simplified out-of-box drop-in setup. In a preferred form, the handle 140 works together with the common discharge piping to interconnect the pumps 120, 130 so that the system can easily be installed or removed as one assembly.

As mentioned above, in a preferred form, the assembly 100 has a single discharge outlet 160, such that each of the first pump 120 and the second pump 130 pump fluid toward the common discharge outlet 160. The discharge outlet 160 can connect to a discharge pipe via a check valve. Because the assembly utilizes one discharge outlet for two pumping units, the assembly can be installed in a quicker manner. That is, an installer need only connect a discharge pipe to a single outlet, which can save considerable time in the installation process. Each pump 120 and 130 can pump fluid toward the discharge outlet 160 through respective check valves 161 and 162, which are connected via cross-over piping 165. Thus, this discharge piping helps interconnect the pumps 120, 130 to one another so that they may be placed as an interconnected assembly.

In some aspects, the discharge outlet 160, cross-over piping 165, and check valves 161 and 162 can be moved higher up above the sump pumps 120 and 130. For example, some embodiments may utilize a length of tube or pipe such that check valves 161, 162, and discharge outlet 160 are raised higher, so that they extend out of the sump pit. FIGS. 13A-G present an example of a tandem sump pump assembly 1300 with cross-over pipe 1365 extended at a height above the sump pumps 1320 and 1330 and above the sump pit. For example, discharge outlet 1360 and the two check valves 1361 and 1362 are elevated far above the assembly and connected via a crossover 1365 pipe significantly above the sump pumps 1320 and 1330 when compared with the embodiment of FIGS. 1A-G. That is, the cross-over pipe 1365, the primary pump check valve 1361, and the secondary pump check valve 1362 are positioned at a height sufficiently high above the primary 1320 and secondary pumps 1330 so that when the tandem sump pump unit 1300 is placed in a sump pit, the primary pump check valve 1361, and the secondary pump check valve 1362 are accessible for maintenance and repair without having to enter the sump pit or remove the tandem sump pump unit from the sump pit. In this manner, an operator can effectively disconnect one pump from outside the sump without having to turn the system off, as the check valves will be more readily within reach. That is, within reach from outside of the sump pit without having to enter the pit, or without having to remove both pumps from the sump pit. One pump can be thus replaced and/or repaired while the other pump continues to operate. That is, one pump can be disconnected from the system and then pulled up from the sump while the other pump continues to operate. In such embodiments, the assembly 1300 may employ separate or dis-connectable volutes rather than the common volute 1310 described above.

Figure 15:
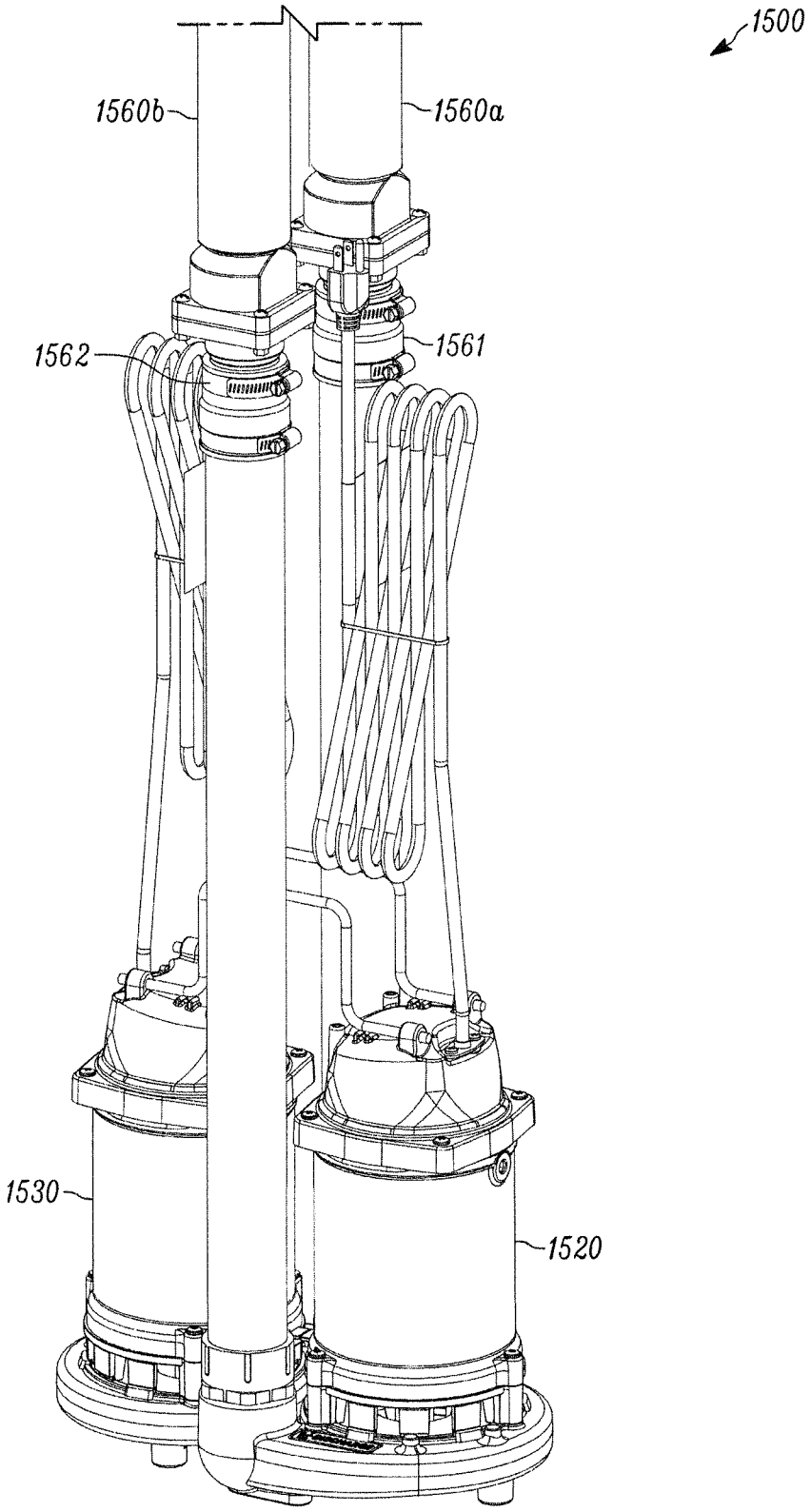
FIG. 15 shows an example of a tandem sump pump system that utilizes two separate discharge lines without a crossover pipe in accordance with examples described herein.

FIG. 15 provides another example of a tandem sump pump system 1500 that utilizes two separate discharge lines 1660*a* and 1660*b* without a crossover pipe. That is, the pump system 1500 includes a first pump 1520 and a second pump 1530 that each utilize a separate discharge line 1560*a* and 1560*b*, respectively. In this example, unlike that of FIGS. 13A-G, no crossover pipe connects the primary check valve 1561 and the secondary check valve 1562 to direct the pumped fluid to a common discharge line. Instead, each pump 1520 and 1530 pumps toward its own discharge outlet. This dual outlet configuration provides redundancy advantages in that, if one discharge line becomes clogged or blocked by debris, vermin, or the like, the other discharge outlet will remain operational. Further, employing separate discharge lines allows the system to omit the individual check valves, if desired (e.g., primary check valve 1561 and secondary check valve 1562 can be optional). This can provide added cost savings and a simplified design. Additionally, using separate discharge lines as shown in FIG. 15 can reduce system pressure drop, which allows the pumps to operate at a higher flow rate. In some examples, the check valves 1562 and 1561 (along with other components) can be made from stainless steel. In other examples, the check valves can be made from a plastic material or other metals.

Figure 14:
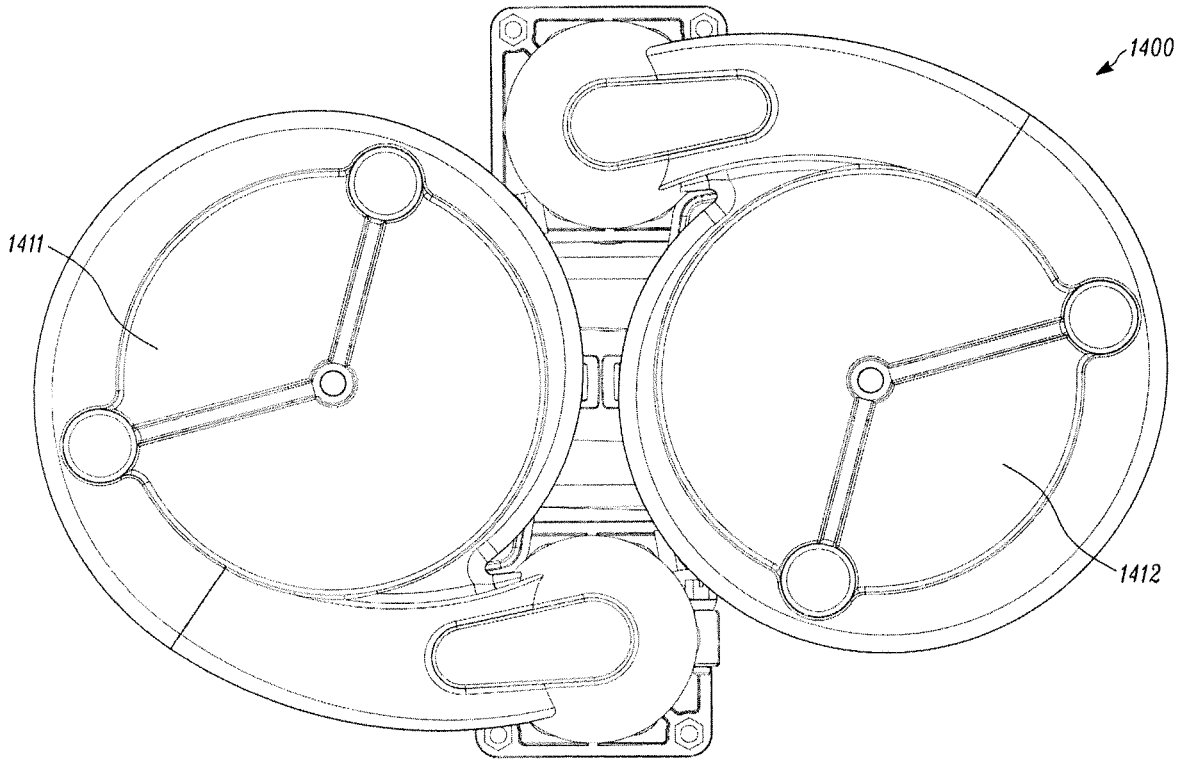
FIG. 14 is a bottom view of an exemplary embodiment of a sump pump assembly where the two sump pumps are of different sizes in accordance with examples described herein.

In FIGS. 1A-G the sump pumps 120 and 130 are generally depicted as being the same size. It is contemplated that in some embodiments the sump pumps can be different in size, shape, or operation. FIG. 14 is a bottom view of an example sump pump assembly 1400 with such a configuration. That is, the first sump pump volute 1411 (which can be, for example, a primary pump, such as an AC powered pump) may be larger than the second sump pump volute 1412 (which can be, for example, a backup pump, such as a DC powered pump). It should be understood that smaller volutes are typically associated with smaller pumps and smaller pump housings. Accordingly, it should be understood that the assembly 1400 of FIG. 14 could include two pumps of different sizes.

Figure 2A:
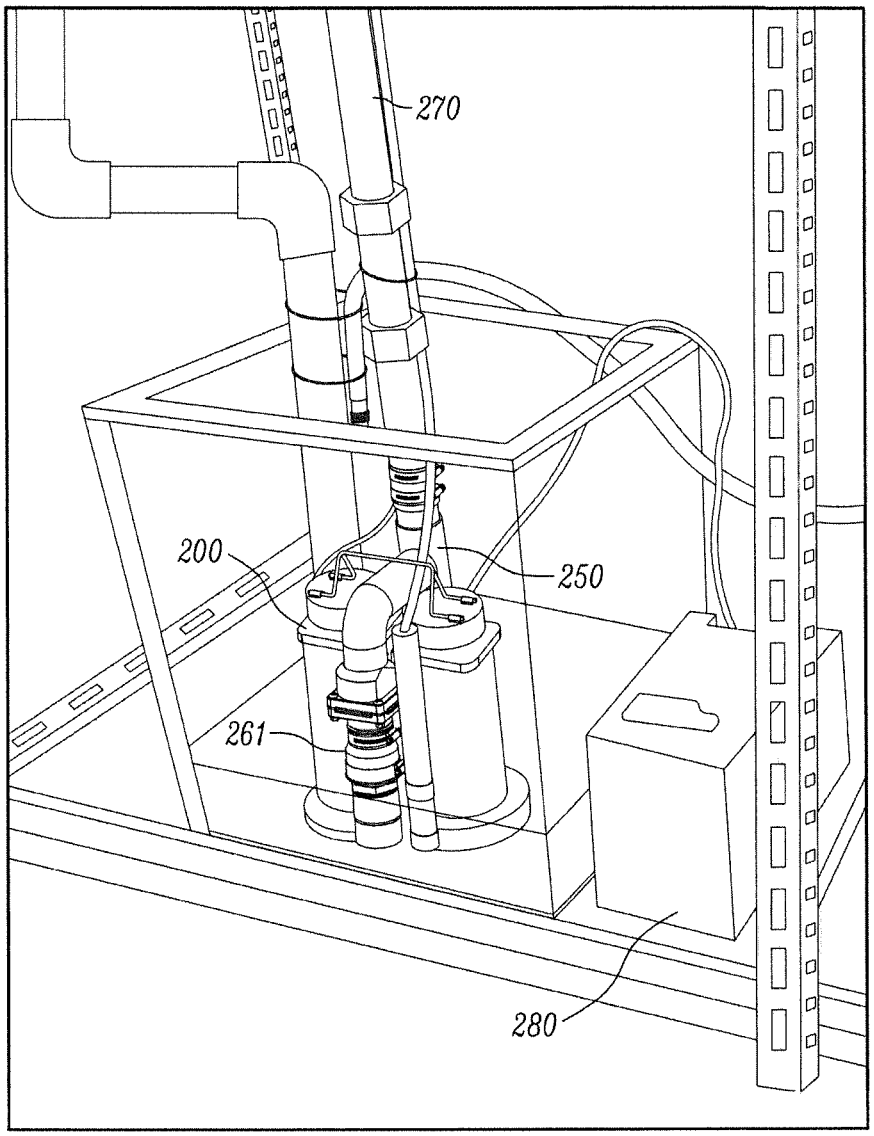
FIG. 2A shows an example of a tandem sump pump assembly connected to a discharge pipe with an integrated control/power module.
Figure 2B:
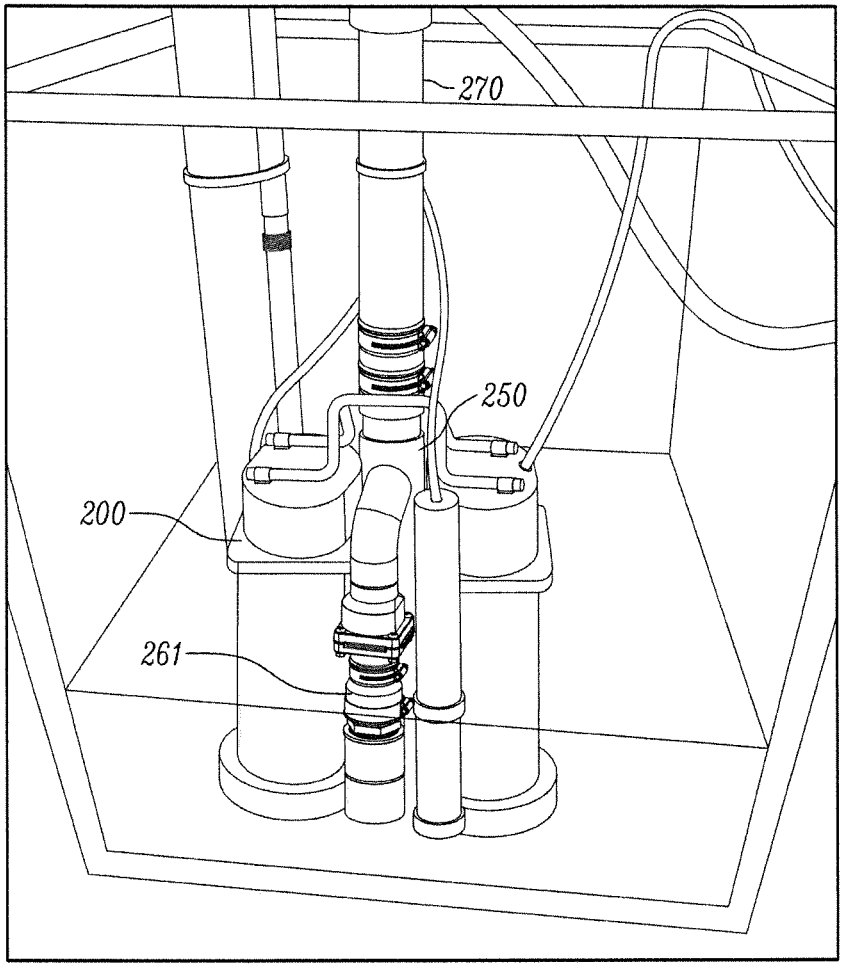
FIG. 2B is an up close view of the tandem sump pump assembly of FIG. 2A.

FIG. 2A shows an example of a tandem sump pump assembly 200 connected to a discharge pipe 270 via check valves 261, 262 (262 is not shown, but is similar in type and location to check valve 162). FIG. 2A shows an expanded view that includes an integrated control/power module 280. FIG. 2B is an up close view of the tandem sump pump assembly of FIG. 2A. As shown, a rubber coupling connects the discharge outlet 250 of the assembly 200 to the discharge pipe 270, and is secured via conventional hose clamps. This configuration allows the assembly 200 to be placed in the sump pit and then secured to existing plumbing if needed. However, in alternate embodiments, the discharge piping may be configured in a variety of different ways (see an exemplary embodiment of this in FIG. 13A which will be discussed later).

As shown in FIG. 2A, the system also includes a control/power system 280. In some examples the control/power system will be an integrated module, as shown in the embodiment of FIG. 2A, where the control circuit and power circuit are included as a part of the same component. In other forms, the control circuit and power circuit may be integrated into a controller further removed from the sump pit area, such as the control unit 510 illustrated in FIGS. 5A-B. This integrated design moves the pump motor switch operation "out of the water", thereby increasing reliability. That is, because the sump control system enclosure can also accommodate the battery charging electronics, the charging components are moved away from the harsh environment of the battery box and into an area more convenient for viewing & operation by the home owner. This can be useful, for example, for sealed sump units with Radon abatement systems. The lower profile of the pump embodiment of FIGS. 1A-G (as compared to the high crossover/easy servicing embodiment of FIGS. 13A-G) may also be more desirable in such sealed sump units because of the ability to contain the tandem assembly within the sealed pit.

In other embodiments, the power controller and the communication module may be separate modules, so that either module can be removed, uninstalled, replaced or otherwise separately provided from the other module. For example, in FIGS. 5A-B, a system is illustrated having separate control and communication modules. By offering a separate modular arrangement, the system can take advantage of improvements in power and/or communication technologies, without requiring replacement of the other power/communication equipment. Moreover, the interchangeability of the power and control systems allows the systems to be adapted for different pumps and equipment that may operate on different power configurations. For example, with this configuration the systems can be adapted to be used with 10 amp pumping systems, or 4 amp pumping systems, or other pumping systems having differing operating parameters or employing various different electrical configurations. In yet other forms, the system may be configured with separate pump control, power control and communications modules so that any of these modules may be repaired, replaced or updated without requiring change to the other modules.

Returning to the embodiment of FIGS. 2A-B, the integrated control/power system 280 can include a central control system, (also referred to as a controller) in electrical communication with the sump pump system (e.g., systems 100 or 200 of FIGS. 1A-B and 2A-B). That is, the controller can be in electrical communication with a primary sump pump that is powered by an AC power supply and a backup sump pump that is powered by a DC power supply. Via the controller, the control/power system 280 can be configured to control operation among the primary sump pump and the backup sump pump. Again, as mentioned above, the system could be setup to use two DC pumps or two AC pumps as desired, however, in a preferred form, the system will be configured with at least one DC pump, which would be needed for power outages as discussed above.

The control/power system 280 also includes a charging module configured to charge the DC power supply and a battery that provides power to the pump system in the event of a power outage to the home. The charging module can operate to charge the battery when AC power is on to ensure that the battery is fully charged in the event of a power outage or other problem with the AC power source.

In some forms, the controller can serve as the controller for the entire sump pump system. In other forms, different controllers may be used for different responsibilities or, alternatively, may be setup in a redundant manner as will be discussed further below. In still other forms, other fallback designs may be used to help the system operate at least in a minimal capacity even if the controller fails. These will be discussed further below with respect to other embodiments.

Figure 3:
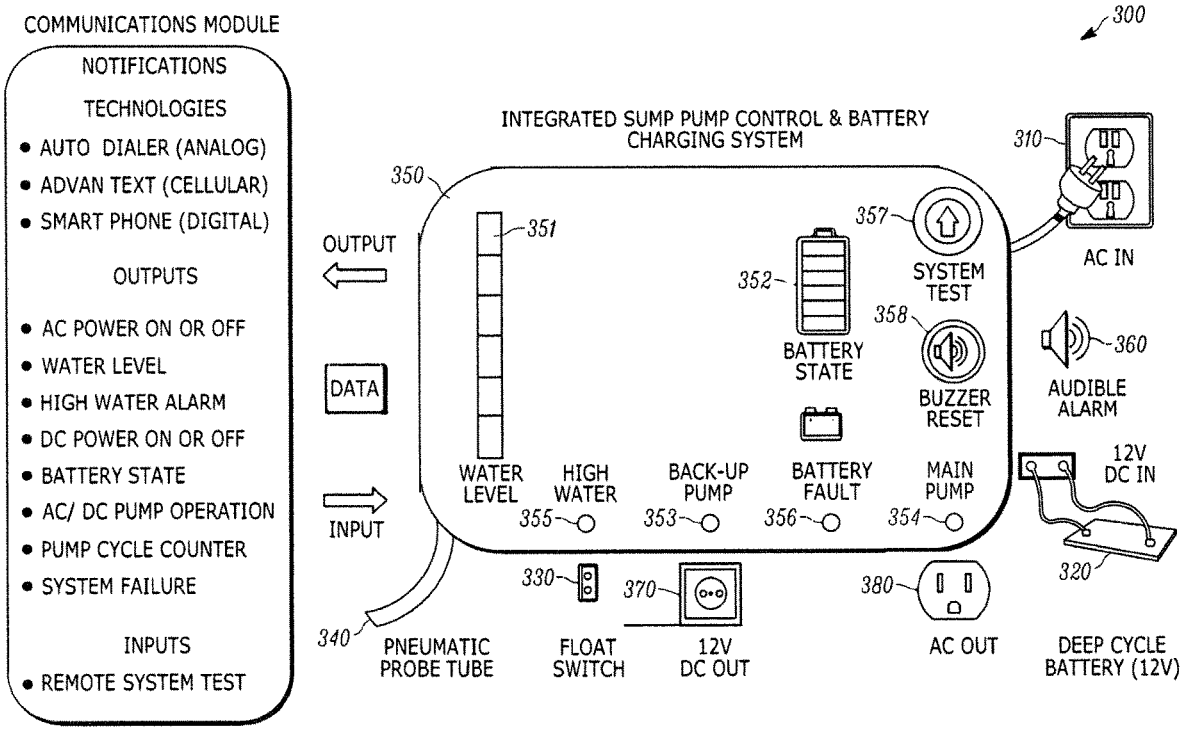
FIG. 3 is a diagram demonstrating various functionality of an integrated sump pump control and battery charging system described herein.

FIG. 3 is a diagram demonstrating various functionality of an integrated sump pump control and battery charging system 300. In some examples, the system 300 is connected to an AC power source 310 (e.g., a 120V power outlet) and, thus, includes an AC input (e.g., a power cord and plug, etc.), a DC power source 320 (e.g., a battery or battery hookup), or a combination of both. Fluid level inputs can be supplied by single or multiple input mechanisms such as float switches 330, relative displacement (tilt) switches, pneumatic pressure switches 340 (e.g., probe tubes) or the like. In the form illustrated, the auxiliary float switch 330 is meant to connect to a high water float switch or water level sensor to identify a high water or flood condition via display 355. In this way, the auxiliary float switch 330 serves as a redundant fluid level sensor to back up the pneumatic pressure tube sensor 340. The system 300 can also include an audible alarm 360 that can be used to produce a signal or warning. For example, audible alarm 360 may include a speaker arrangement, a buzzer, a siren, a beeping device, or the like. In some forms, the controller or system 300 further includes an output to connect to a home security system to trigger an alarm or notification condition via the home security system.

In some forms, the system 300 may include an interface 350 that displays information pertaining to the operating status of the system. For example, the interface 350 may display information pertaining to the water level 351, the battery status 352, and the operation status of the backup pump 353 or main pump 354. The interface 350 may also include high water warning icons 355, battery fault icons 356, or control switches that execute functionality, like a system test switch 357 (e.g., that activates a system test protocol) and a buzzer switch 358 (e.g., that shuts off or mutes a buzzer). In the form illustrated, the visual displays 351, 355, 353, 356 and 354 coincide with the inputs 340, 330, 370, 320 and 380, respectively, and utilize colors to relay information regarding system status or water status. For example, green colors appearing in conjunction with the water level sensor 351, back-up pump indicator 353, battery indicator 356, and main pump indicator 354 indicate the system is running properly. Conversely, red colors appearing in conjunction with water level sensor 351, high water indicator 355 and battery fault and state indicator 356 indicate a potential or current problem with the system (e.g., low battery, no battery, etc.) or undesirable high water level situation. In the form illustrated, the system 300 is setup modularly so that system 300 serves as the pump controller and nearby notification module, but is also connected to a communications or remote notification module to provide further notification to remote locations such as remote user locations via an analog or digital auto dialer unit, a cellular or digital notification unit, etc. FIG. 3 depicts some exemplary data that may be communicated between the communications module and system or controller 300 such as AC system power status, water level, alarm conditions, DC system power status, battery state, pump operation, pump cycle count, system failures and remote diagnostic or testing features.

Some examples described herein may employ a controller that monitors and assesses battery state of health, and/or battery state of charge properties. Conventional battery test methods for pumping devices often involve discharging, or at least partially discharging the battery. But this can cause problems, in particular, with how power or heat generated during the test is dissipated. Accordingly, certain aspects described herein may employ battery testing and assessment techniques that use conductance measurements. Conductance describes the ability of a battery to conduct current. At low frequencies, the conductance of a battery is an indicator of battery state-of-health showing a linear correlation with a battery's timed-discharge capacity. Accordingly, information obtained from the conductance test can be used as a predictor of battery end-of-life. In one aspect, a controller may be equipped to utilize similar operating software that is used to test equipment related to other industries, such as automotive equipment, and may also use advanced monitoring systems that are associated with stationary power applications. That is, the testing algorithms used to monitor these other types of equipment could be incorporated into a control board of the controller. In this manner, the present controller can use conductance testing of the battery to determine state of health and/or state of charge, which has not been utilized in conventional battery back-up sump systems.

Figure 5A:
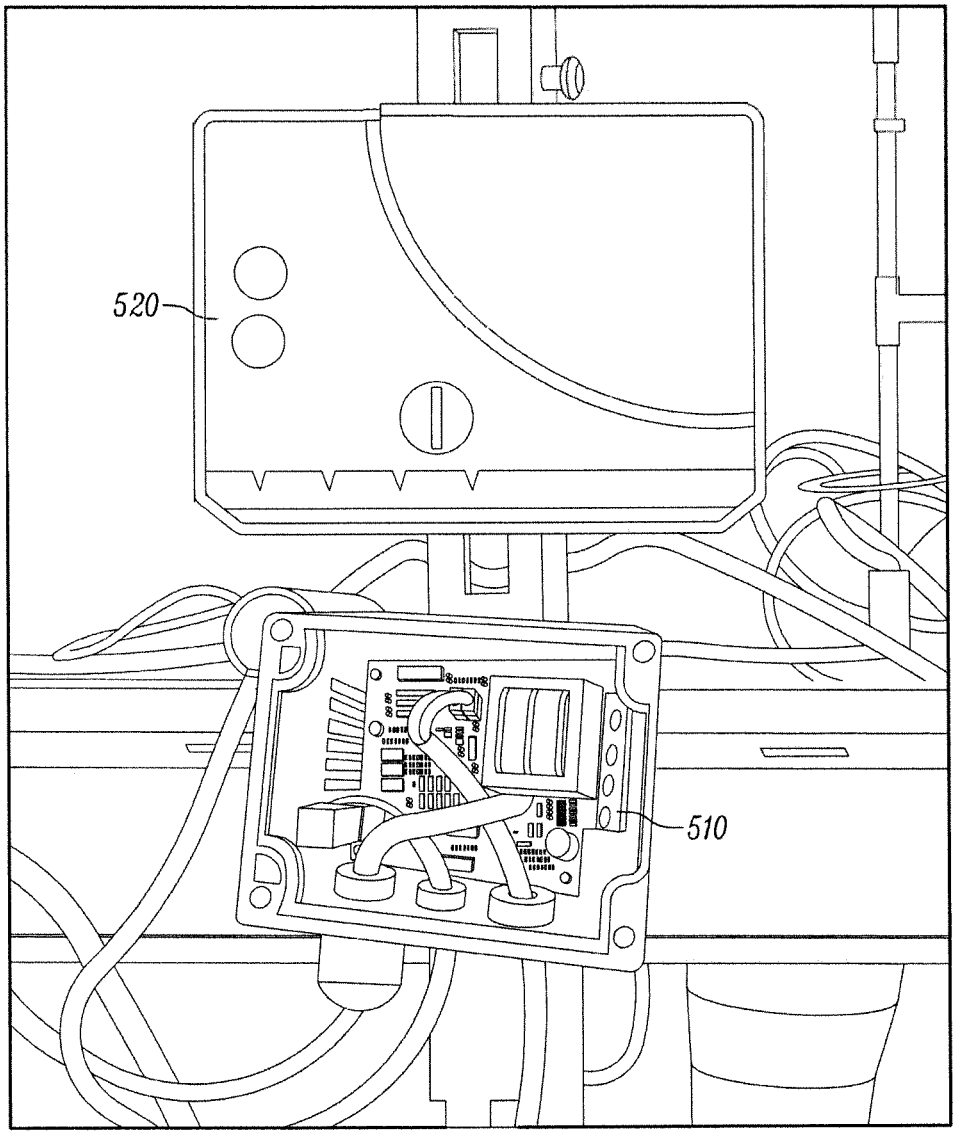
FIGS. 5A-B show examples of a warning notification and communication system described herein.
Figure 5B:
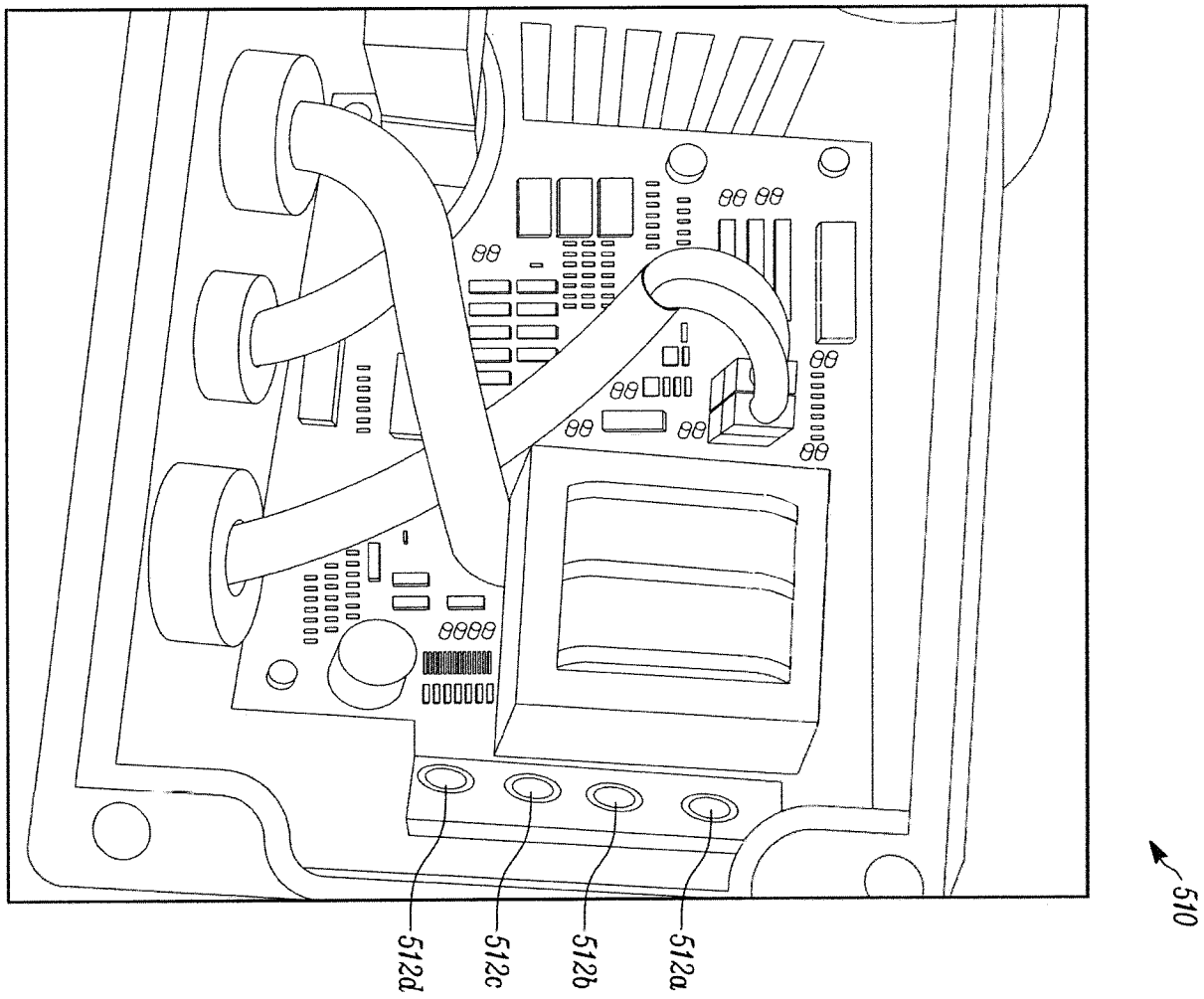

The present disclosure also describes warning and communication systems used in connection with pump systems. FIGS. 5A-B show examples of a warning notification and communication system. FIG. 5A shows an expanded view that includes a system controller such as notification module 510 and a communication module 520, and FIG. 5B shows a close up view of the notification module 510. As shown, the notification module 510 comprises a series of LED lights 512*n* that light up to indicate warnings or other information. For example, the LED lights 512 can represent operation of the backup pump, operation of the primary pump, a water level warning, a low battery level warning, a battery fault warning, etc. In some examples, the LEDs 512 can include a plurality of lights that sequentially light up to indicate an amount of water or fluid in the sump pit. For example, the LEDs 512 can illuminate in a way to indicate a "low" "medium" and "high" water level so that a quick glance at the display immediately indicates the amount of water in the sump pit (e.g., fewer illuminated LEDs means low fluid level, intermediate number of illuminated LEDs means higher fluid level, many illuminated LEDs means high fluid level, all on and strobing to indicate too high of a fluid level or too high of a level for too long of a period of time, etc.). The notification module 510 can also be equipped with a speaker or other audible equipment to generate sounds or audible alarms in certain situations. For example, the notification module can be configured to sound a buzzer or alarm when the water level is rising beyond a predetermined threshold or when the fluid level remains at or above a threshold level for too long a period of time, etc.

The communication module 520 can be configured to communicate notifications via a number of wireless or wired technologies. For example, the communication module 520 can be configured to send text alerts via a cellular network. Additionally and/or alternatively, the communication module can be configured to send signals via a network, such as the internet, via a hard wired or a Wi-Fi connection, a land-line connection, or another approach. In this manner, the communication module 520 can communicate and/or interact with a remote device, such as a smart phone, a tablet, a laptop or other computer.

In some embodiments, the module 280 could allow battery back-up to power the communication module 520 and other modules or components (e.g., an electronics module) during an AC power outage so that notifications, the application services described herein, and other features (e.g. cellular or digital notifications, such as text notifications, etc.) remain functional and/or operational.

Figure 8:
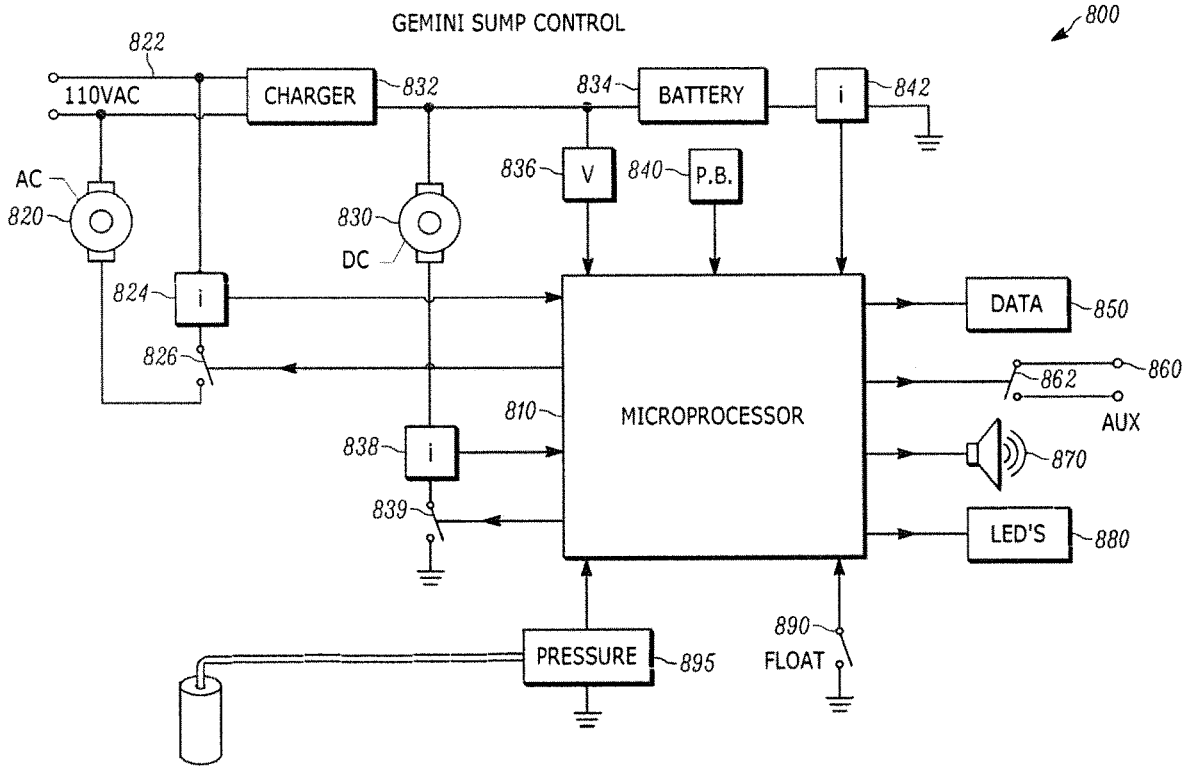
FIG. 8 is a schematic diagram of an example control system for a tandem sump pump system described herein.

FIG. 8 is a schematic diagram of an example control system 800 for any of the tandem sump pump systems described herein. The control system 800 (which can be the same as or similar to battery charging and control system 300 described above with respect to FIG. 3) includes a controller, such as microprocessor 810, in connection with a variety of equipment, sensors, and outputs. The system 800 includes an AC pump 820 represented by a motor symbol, which connects to an AC power supply 822 (e.g., a 110 V AC power supply) and can be used to operate one pump of a tandem sump pump system.

A current sensor 824 monitors the current drawn by the AC pump 820, and communicates with the microprocessor 810. In this manner, when current drawn by the pump 820 (e.g., by the pump motor) is above or below a threshold (e.g., signifying that the pump may be having issues), the microprocessor can take any of a number of pre-prescribed actions. For example, detection of low current usage may indicate the pump has no more water to remove and, thus, the controller may shut down the pump to avoid motor burnout. Detection of high current usage may indicate the pump is jammed and, thus, the controller may cycle the pump motor on and off to try and dislodge whatever is causing the bind or may shutoff the motor and trigger a notification of an error. The microprocessor may operate any of the number of outputs, such as the audio alarm 870, LED lights 880, or other functionality (such as sending a communication via the communication module) to indicate or relay such errors.

In a preferred form, the system 800 will be configured with a first switch for operating the primary pump and a second switch for operating the backup pump. For example, switch 826 can be used to control the supply of AC power to the system 800. In some examples, switch 826 can include any AC switch, such as a solid state relay (SSR) (e.g., an opto-triac or triac and alternistor, etc.). In the form illustrated, the switch 826 is an opto-triac coupler, which can be employed to block high voltage and voltage transients from the AC portion of the circuitry to other areas of the system 800, such as the DC portions of the circuitry. In this manner, the switch can help assure that a surge in the AC part of the system 800 will not disrupt or destroy the other parts of the system 800. In other examples, the switch 826 can include a DC switch if the circuit includes a transformer (e.g., an isolation transformer) and the pump being operated is instead a DC pump.

Returning back to FIG. 8, the system 800 also includes a DC pump 830 (again represented by a DC motor symbol) which can be used to operate a second pump of the tandem pump system. The DC pump 830 receives DC power from either a DC battery 834 (e.g., a 12 V battery), a battery charger 832 (e.g., a 12 V battery charger), or a combination thereof. For example, the system may be setup to cycle usage of the pumps between the first and second pump 820, 830 so that one does not wear out before the other. Thus, when the DC pump 830 is to be used, the battery charger 832 may simply be used as an AC-DC power adaptor to step the AC power supply down to DC power to operate the DC pump 830 without requiring power to be supplied by battery 834 so that the battery remains fully charged for use during AC power outage situations. The battery charger 832 is in communication with the AC power supply 822 and the battery 834, thereby ensuring that the battery 834 maintains a charge in the event of an AC power outage. The DC portion of the circuit also includes a current sensor 838 that monitors current drawn by the DC pump 830, and a switch 839 that opens and/or closes the DC portion of the circuit. In this manner, the switch 839 can control the supply of DC power to the DC pump 830 and the controller 800 can perform similar tasks to those discussed above with respect to the AC motor when detecting too little or too much current draw (e.g., shut off the pump if too little current is drawn indicating insufficient fluid presence, cycle on and off the pump to attempt to dislodge a blockage leading to too much current being drawn by the motor, turning off the motor if too much current is drawn by the DC motor, etc.).

The system 800 also includes a voltage supply 836 that supplies power from the DC battery 834 to the microprocessor 810 or as mentioned alternatively above from the battery charger 832 serving as an AC-DC adapter. With this configuration, the microprocessor 810 can still operate in the event of an AC power outage by drawing power from battery 834. Another current sensor 842 monitors the current drawn by the battery 834 to indicate to the controller 810 if a problem has occurred with the battery 834 (e.g., too low or high of a current being provided, etc.). In other aspects current sensors can be associated with other components of the system (e.g., the microprocessor 810) to monitor the current that the components are drawing and further notifying of other problems or errors in circuit or component operation.

The system 800 includes a push-button 840, which can be pressed, for example, by a user to activate one of a number of system tests. For example, the push-button 840 can be pressed to determine whether the battery 834 is sufficiently charged. The push-button 840 can also be used for one or more other functions, including, for example, to silence an alarm, deactivate a notification, re-set warning signals, start a test cycle, or the like.

The microprocessor 810 also operates in connection with a number of outputs. For example, the microprocessor 810 may communicate data and/or information via a data output 850. The data output 850 can include, a communication device that transmits text alerts, notifications, or other communications to a user via a remote device.

In some embodiments, the microprocessor may also include an auxiliary signal output 860, which can be another auxiliary alarm, such as a home security system and/or a communication/texting protocol system. The auxiliary signal output 860 can include a switch 862 that allows the auxiliary output 860 to be activated or deactivated as appropriate.

The microprocessor 810 can communicate with an audio alarm 870 that activates an audio signal in response to certain events, or a series of lights 880 (e.g., LEDs) that can execute various lighting sequences in response to certain events as described herein.

In some embodiments the microprocessor 810 is also in communication with a number of additional switches and sensors, including, for example, a float sensor 890, and a pressure sensor 895.

The system of FIG. 8 demonstrates various examples of redundancy and/or backup to ensure proper operation of the system in the event of failure of some of the components. For example, the system 800 includes redundant pumps 820 and 830, redundant battery sensors 836 and 842 for determining battery performance, redundant power supplies 822, 834, and redundant water level sensors 895, 890. FIG. 8 does not provide examples of controller and/or microprocessor redundancy. However, some examples described herein provide systems and/or methods to provide redundancy for a controller such that the system can continue to function in the event that the controller itself fails. This controller redundancy can be provided in a variety of different levels, including a dual processor level that ensures full operation of many or even all of the functionality of the system even when a primary controller fails. Alternatively, simpler or less expensive systems can also be provided that ensure operation of the pumps in the event of a controller failure, but without providing all of the other premium features of a more expensive dual processor system.

FIGS. 9-12 present examples of pumps and related systems that offer redundancy. For example, some systems include two pumps operated, managed, or otherwise controlled by a dual processor (e.g., a dual microprocessor). The dual processor can be configured so that one portion of the processor operates a first pump (e.g., a primary pump or an A/C powered pump) while a second portion of the processor operates a second pump (e.g., a backup pump or a D/C powered pump). In the event that one processor or processor portion goes down, the dual processor system can configure control so that the other operating processor assumes control of both pumps. In this manner, the system can continue to operate on all levels even in the event of a failure to one processor. In some examples, the dual processor can be, or can include two separate processors, with each processor portion comprising a separate processor device. In other examples, the dual processor is one chip or board configured to operate as a dual processor.

Figure 9:
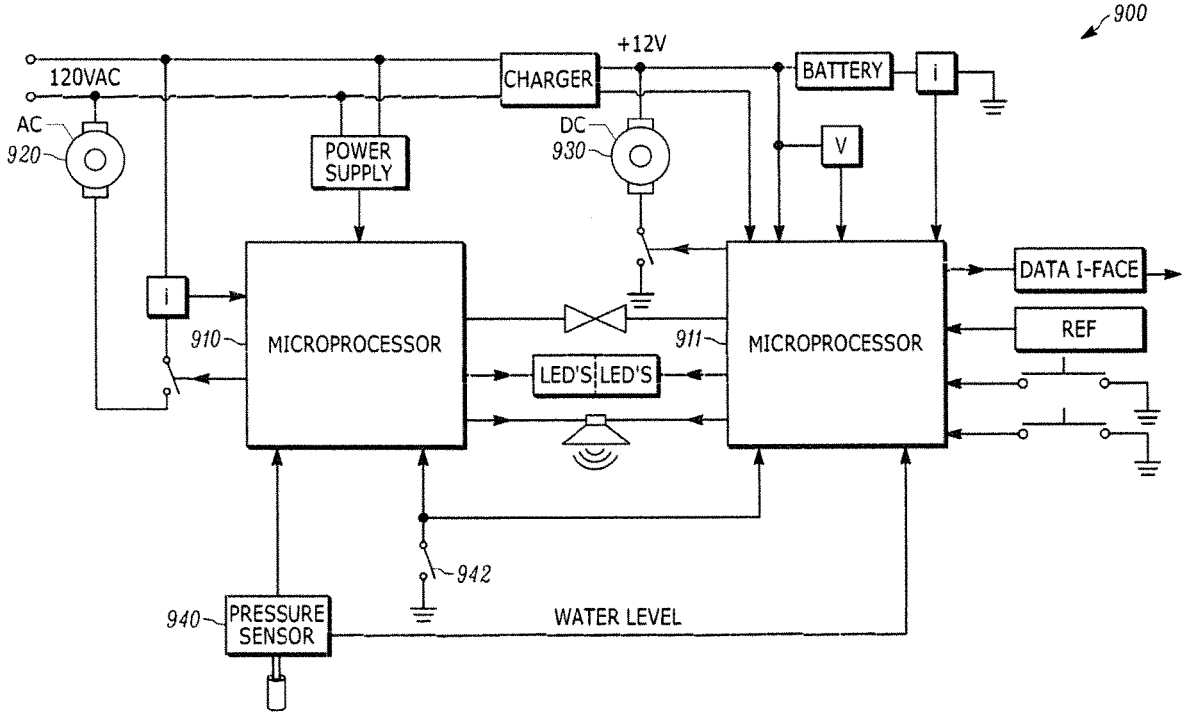
FIG. 9 is a schematic diagram of a dual processor redundant backup system for a sump pump system described herein.

FIG. 9 is a schematic diagram of a redundant control system 900 for a dual sump pump arrangement utilizing dual controllers, such as processors 910 and 911. In this embodiment, a first microprocessor 910 can be configured to control operation of a first pump, for example, an AC powered pump 920. The second microprocessor 911 can be configured to control a second pump, for example, a DC powered pump 930. Each microprocessor can be in communication with various sensors, and other audio/video alarms or functionality. Moreover, in the event that one microprocessor fails, the other microprocessor can assume the functionality of the first microprocessor. For example, if the first microprocessor 910 fails, the second microprocessor 911 can assume control of the primary pump 920, while also assuming the control of the signaling and other communication functionality described herein. Likewise, in the event that the second microprocessor 911 fails, the first microprocessor 910 can assume control of a backup sump pump 930, and other related functionality. Moreover, the system may utilize redundant water level sensors, such as a pressure sensor 940 and a high water float switch 942, each of which is in communication with each of the two microprocessors 910 and 911.

While utilizing a dual processor system such as that described with respect to FIG. 9, such a system can be more complicated and expensive. Accordingly, the present disclosure also describes examples where one processor is a simpler processor than the other. For example, one processor may be a scaled down or scaled back version of the other processor (e.g., a simplified controller) so that in the event of a failure, the simplified controller can perform some, but not all of the functionality of the primary processor. In this manner the system may be more cost effective and easier to operate on account of the simplified controller, but may still be able to perform the important tasks (e.g., prevent flooding) in the event of a primary processor failure so that the system can continue to operate in urgent situations. In some forms, the power supply for each of the controllers 910, 911 may be handled separately as well in yet another example of redundancy. For example, a separate transformer or step down/rectifier circuit may be used to supply power to the first controller 910 and the battery may be used to supply power to the second controller 911. In other forms, however, both may be powered from the same DC power source (e.g., such as the battery charger as an AC-DC adapter and, if AC power is not available, from the battery as discussed above).

Figure 10:
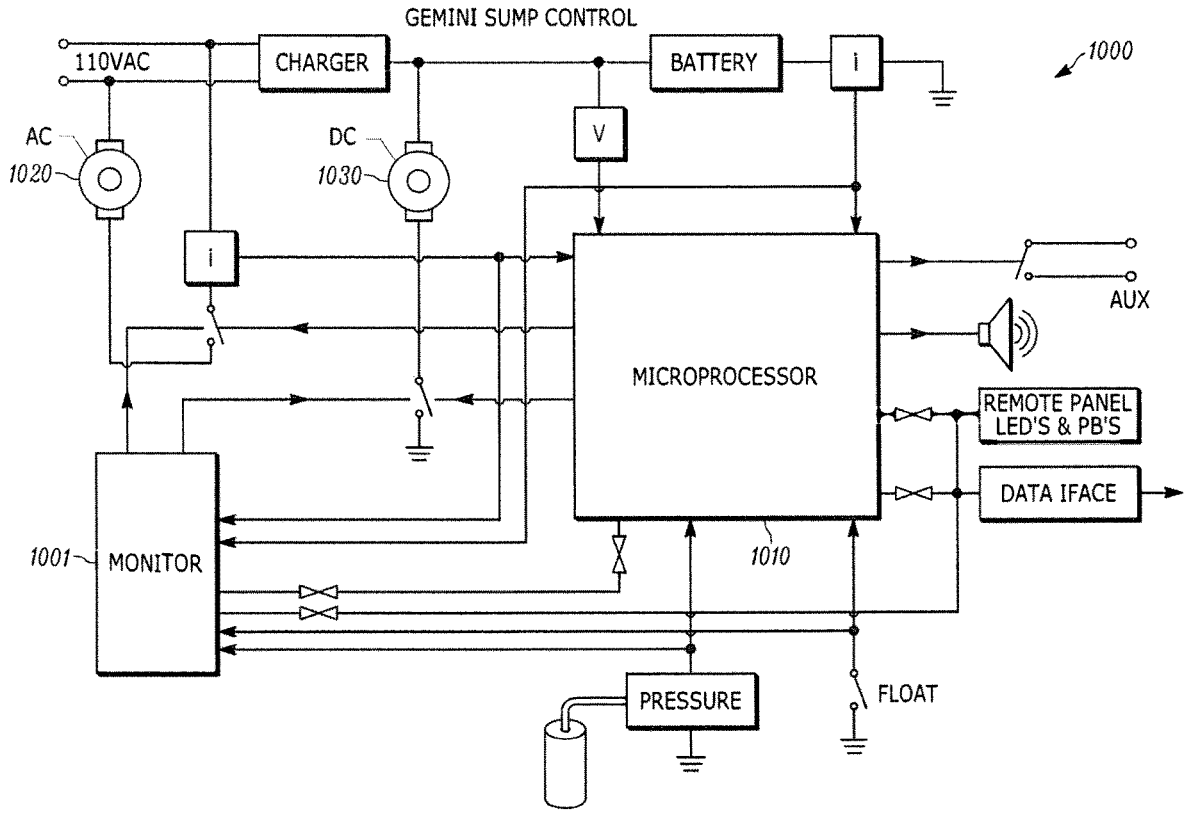
FIG. 10 is a schematic diagram of an alternate example of a redundant controller system as described herein.

FIG. 10 is a schematic of another example control system 1000 for a tandem sump pump system with redundant controller features. The control system 1000 includes a microprocessor 1010 in connection with a variety of equipment, sensors, and outputs, including a primary pump 1020 (e.g., an AC pump), and a secondary pump 1030 (e.g., a DC pump).

Unlike system 900 of FIG. 9 which includes dual controllers (e.g., processors 910 and 911) that can maintain all or virtually all of the functionality of the system (e.g., including the warning, transmission, and monitoring features, etc.) in the event that one microprocessor or controller fails, the system of FIG. 10 operates on a more efficient basis in the event that microprocessor 1010 fails. As such, the system 1000 may be simpler and more cost effective, but still allow the pumps 1020 and 1030 to continue to operate in the event of a failure while the primary microprocessor 1010 or controller is being repaired or replaced. In this manner, the system 1010 may employ a redundant controller, such as monitor 1001 that communicates, or is in communication with many of the system components. The monitor 1001 can be configured to essentially monitor microprocessor 1010 to ensure that it is operating effectively. When it detects that the microprocessor 1010 is not operating effectively, the monitor 1001 can assume control of one or both of the primary pump 1020 and backup pump 1030 so that the essential pumping operations continue to operate as necessary.

In some examples, the monitor 1001 can serve as another microprocessor that performs some of, but less than all of the functions of the microprocessor 1010. For example, the monitor 1001 may be able to control between operation of the two pumps 1020 and 1030, but not perform any of the alarm or communication functionality. In other aspects, however, the monitor 1001 performs only a small number of tasks, sufficient to keep the system 1000 operating efficiently while the microprocessor 1010 undergoes maintenance. For example, the monitor 1001 may be a simple logic circuit that includes a logic gate or logic gates (e.g., and/nand logic gates, or the like). Thus, the monitor 1001 allows the system 1000 to operate minimally, such that only the essential operations are performed while the other module is replaced and/or repaired. This control system 1000 provides a less expensive redundant system that allows the system to "limp home" in the event of a failure, thereby performing all necessary tasks.

Figure 11A:
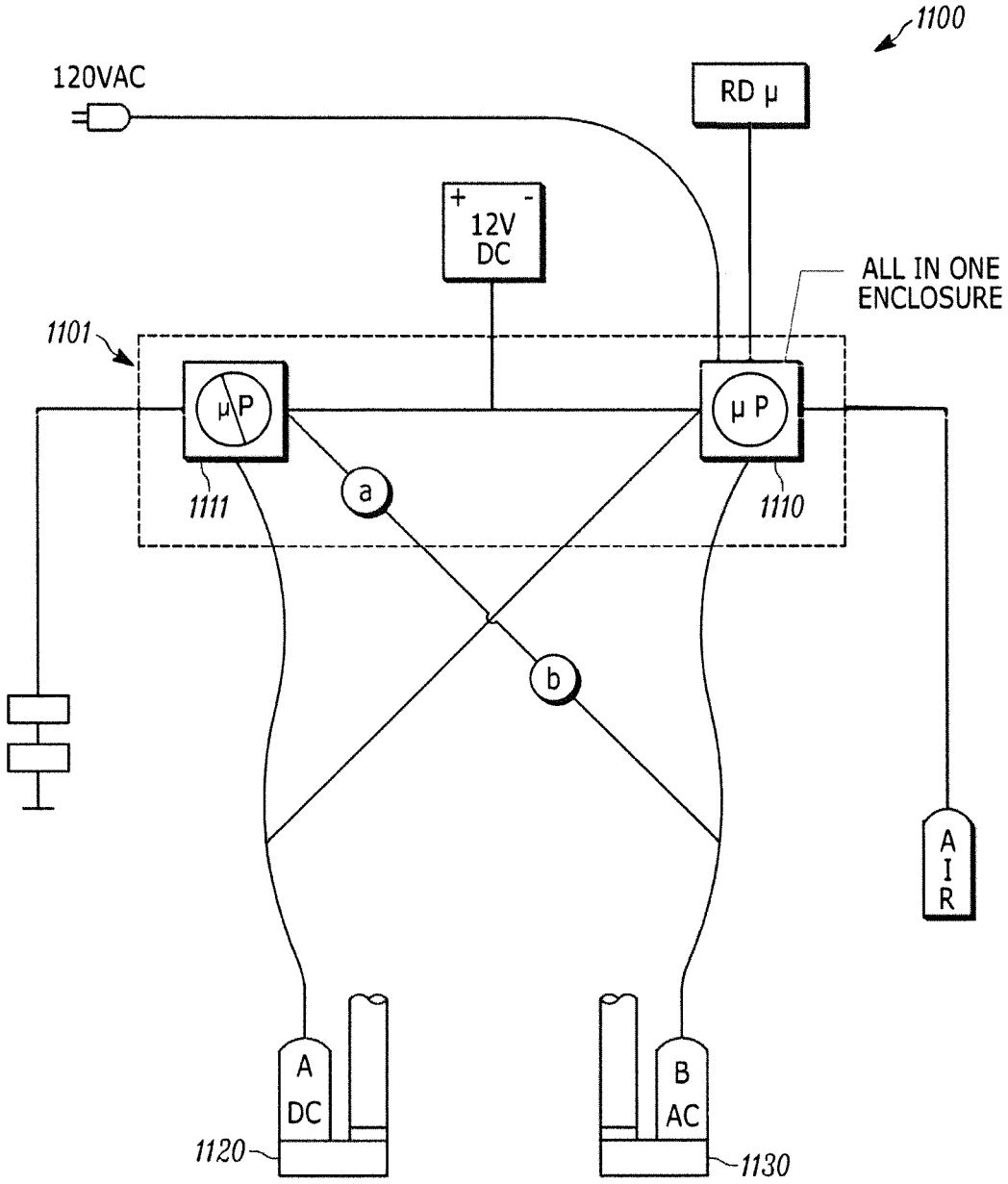
FIG. 11A is a schematic drawing of a redundant control system for a dual sump pump arrangement utilizing a processor and a software-free relay controller in accordance with examples described herein.

In still further configurations, a very minimal redundant controller or system may be used that includes a simple relay switch without software or processors in the redundant/backup control. FIG. 11A is a schematic drawing of a redundant control system 1100 for a dual sump pump arrangement utilizing a processor 1110 and a non-processor or logic based relay controller 1111. The controller can be a simple switch or a simple relay, without any software or logic required to operate same (e.g., a software free controller). The microprocessor based controller 1110 and the second or redundant controller 1111 can be provided in a single enclosure as a control unit 1101 or, as will be discussed further below, be modular to allow for one to operate the system while the other is serviced (e.g., repaired or replaced). In this manner, the simple relay second controller 1111 can be wired to assume management responsibilities for the pumps 1130 and 1120 of the system in the event that the primary microprocessor controller 1110 fails or malfunctions. In this manner, the pumps will either operate (be "on") or not (be "off") as controlled by the relay controller 1111, which can be based on one or more sensors, such as float sensors and/or pressure sensors. In a preferred form, the redundant controller 1111 will be capable of operating both the primary and secondary pumps. However, in alternate forms, the redundant controller 1111 may only be capable of operating one of the pumps (e.g., the secondary pump, but not the other).

Figure 11B:
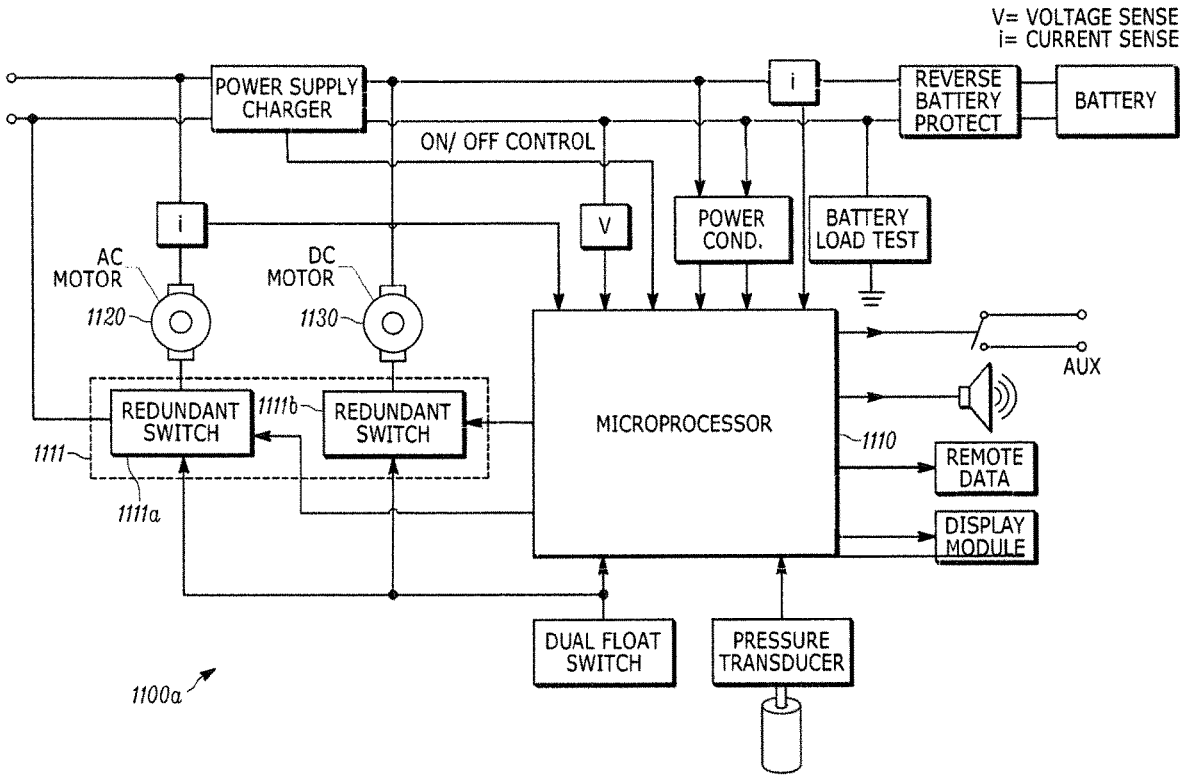
FIG. 11B is a more detailed schematic of a redundant control system for a dual sump pump arrangement utilizing a processor and a dual switch software-free relay controller in accordance with examples described herein.
Figure 11C:
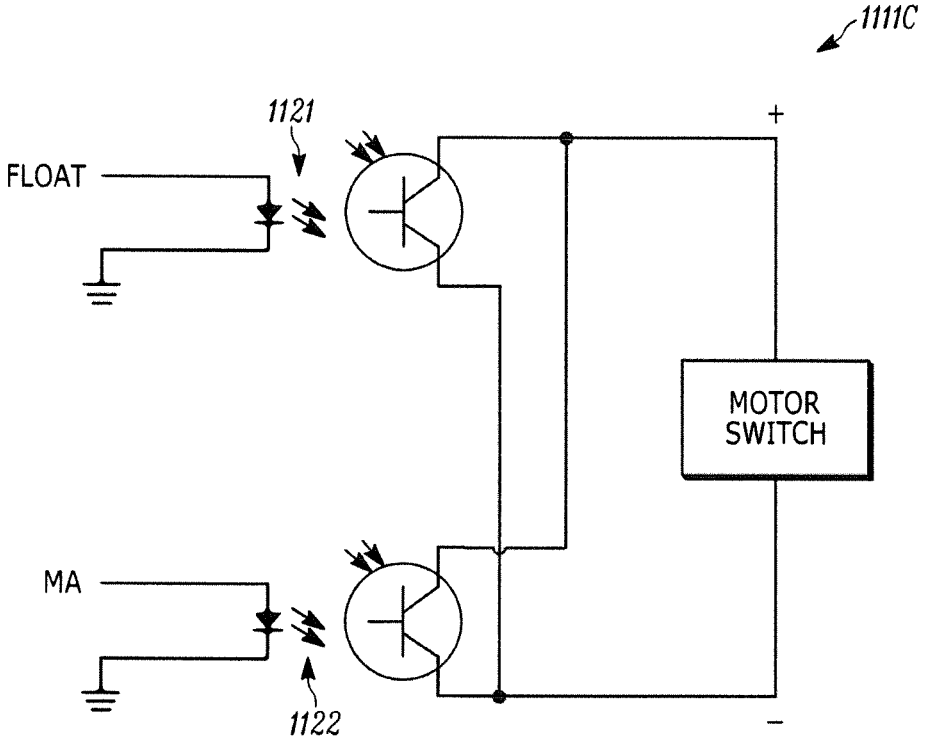
FIG. 11C is a sketch of a redundant switch used in accordance with examples of redundant control systems described herein.

FIG. 11B is a more detailed schematic of a redundant control system 1100*a* for a dual sump pump arrangement utilizing a processor and a dual switch software-free relay controller. Here, the simple relay second controller 1111 is shown in more detail as a dual redundant switch controller. That is, the second controller comprises a first redundant switch 1111*a* that operates the primary, or AC pump 1120, and a second redundant switch 1111*b* that operates the secondary, or DC pump 1130. The redundant switches for the controller system are two isolated switches with the outputs tied together and the inputs coming from two independent sources. Each switch 1111*a* and 1111*b* can take on a variety of forms. For example, in some forms, similar switches may be used for both the primary and backup pumps. In other forms, an AC switch may utilize components capable of isolating the DC portion of the circuit from the AC portion of the circuit (e.g., an opto-triac switch), while the DC powered switch may include a simple mechanical switch, an electrical switch such as a transistor (e.g., BJTs, FETs, etc.), or the like.

For each switch 1111*a* and 1111*b*, the two inputs relate to the microprocessor 1110 and the high water float switch 1190. If the microprocessor 1110 fails to operate properly, the float switch, when it operates, will turn on the switch output which will activate the AC switch 1111*a* (e.g., triac switch) or the DC switch 1111*b* (e.g., FET) to drive one or both pumps 1120, 1130. FIG. 15 is a sketch showing a simplified circuitry for a switch 1111*c* that could be used in such an embodiment. The switch 1511 includes a motor switch 1103 in circuit with two opto-isolators 1121 and 1122. However, it should be understood that the actual circuitry may be different for AC switch 1111*a* and DC switch 1111*b*.

Figure 12:
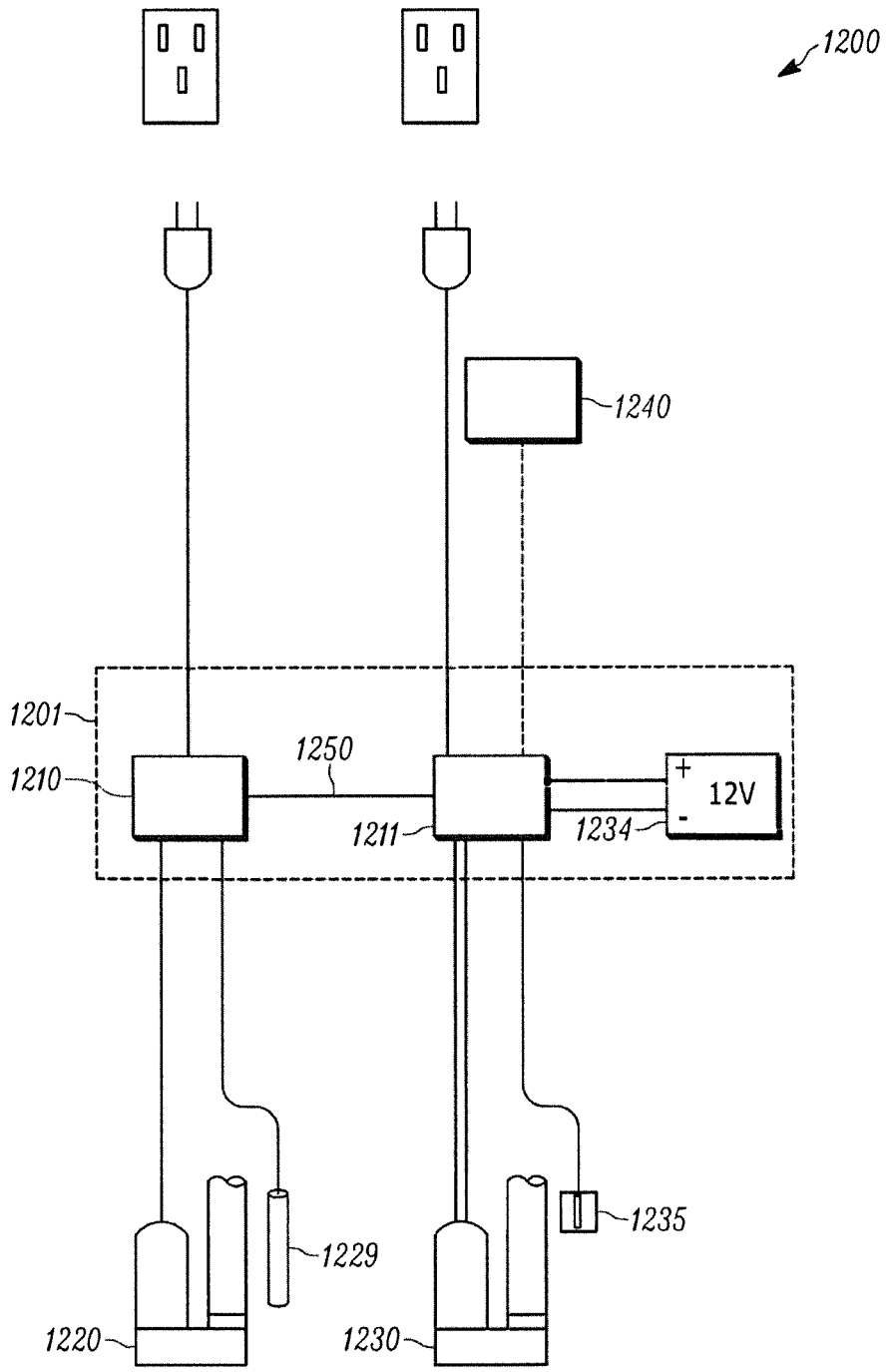
FIG. 12 is a schematic drawing of a system that allows two separate pumping systems to communicate with one another in accordance with examples described herein.
Figure 13A:
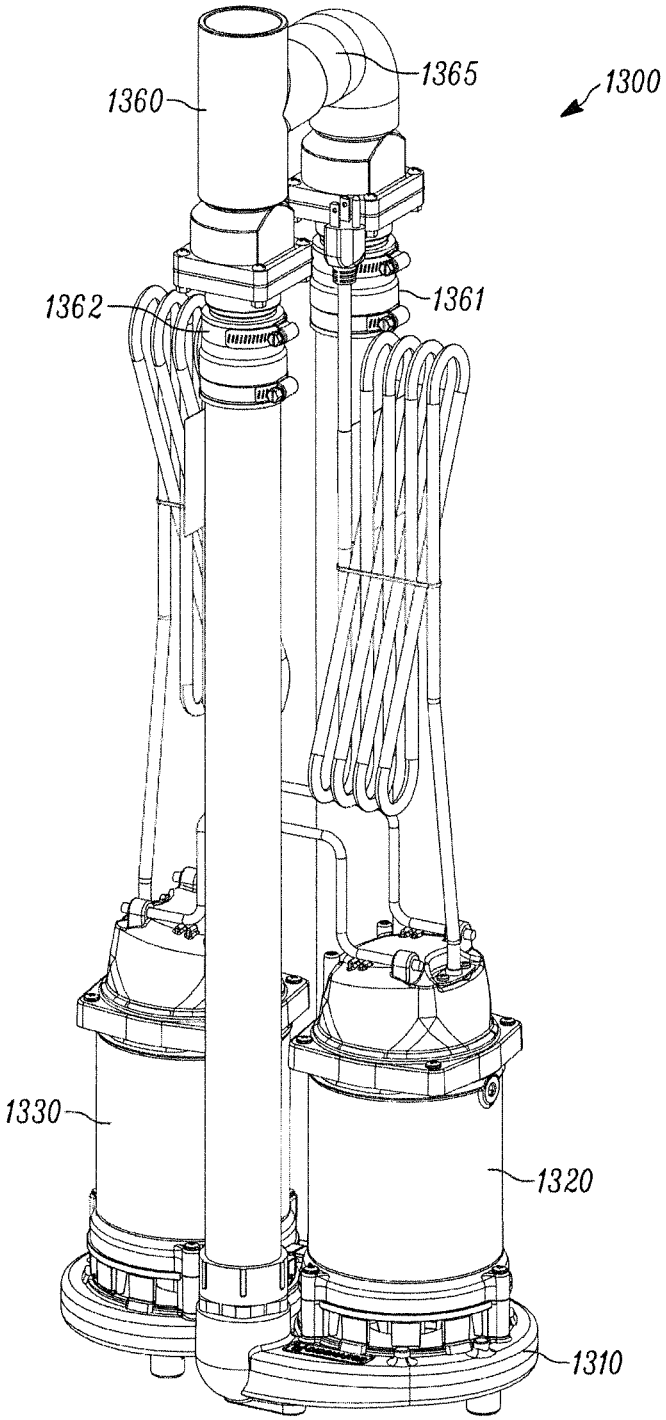
FIGS. 13A-G show various views of an alternate exemplary tandem sump pump assembly with cross-over piping and associated check valves extended at a height above the sump pumps and/or above the sump pit in order to simplify service of same in accordance with examples described herein.
Figure 13B:
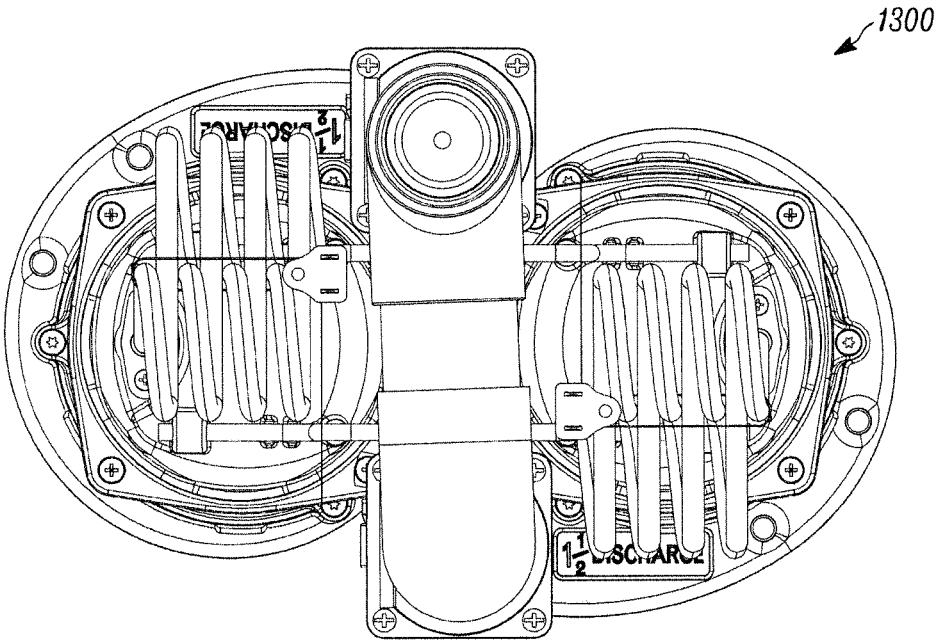
Figure 13C:
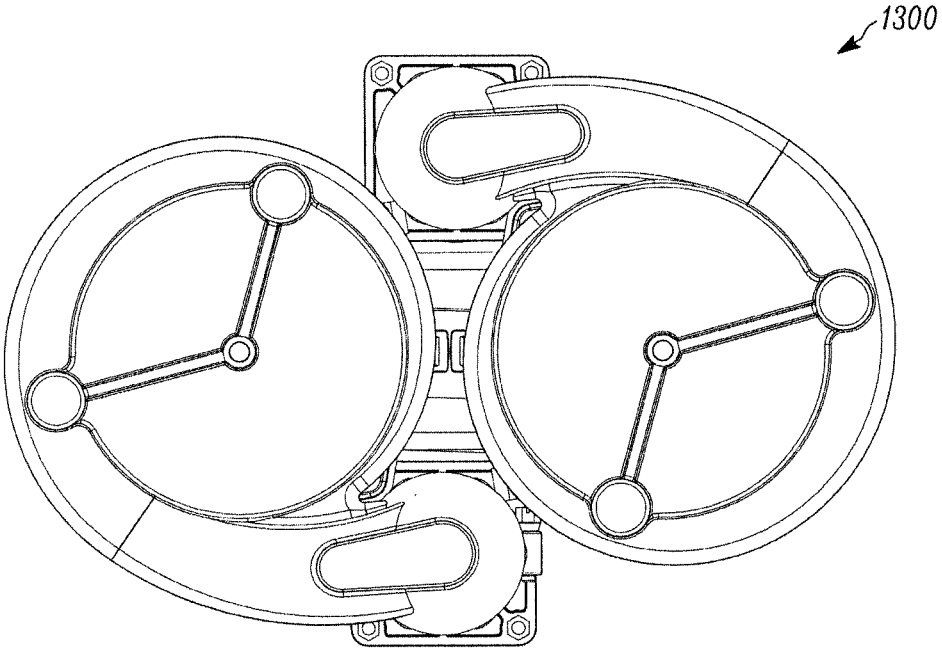
Figure 13D:
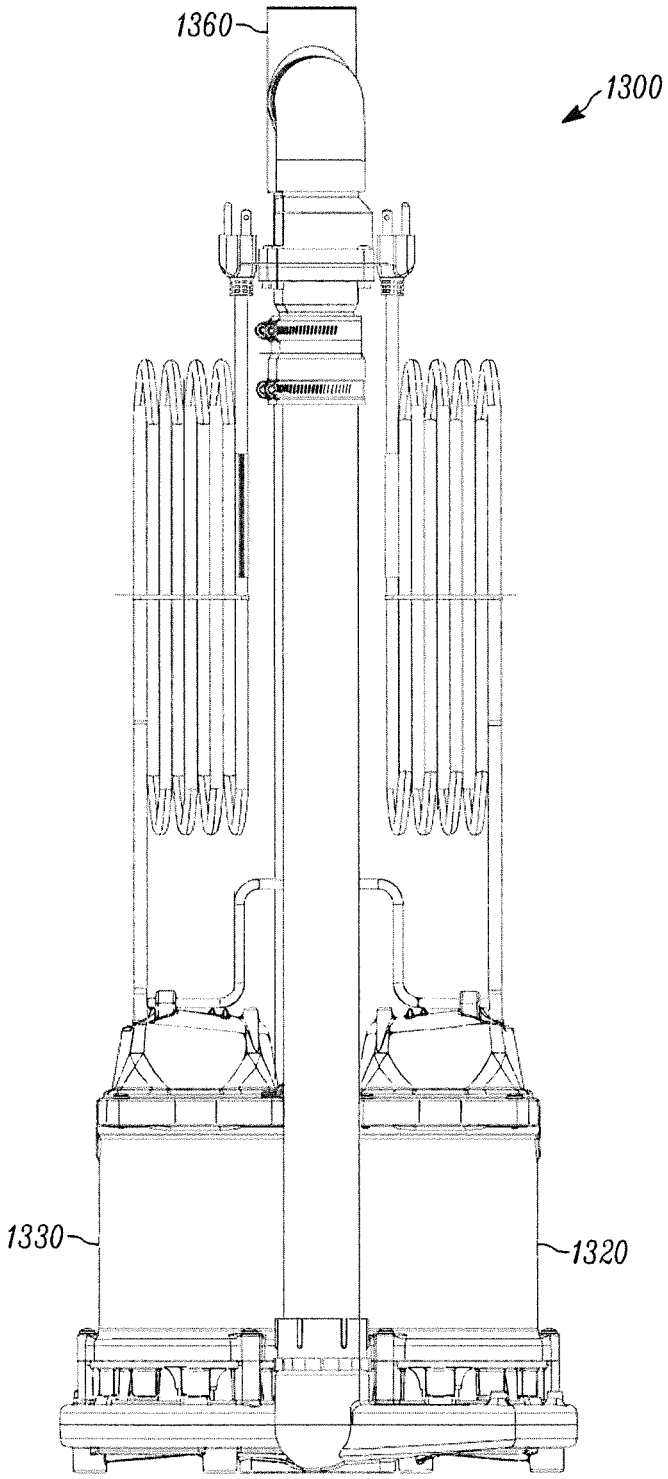
Figure 13E:
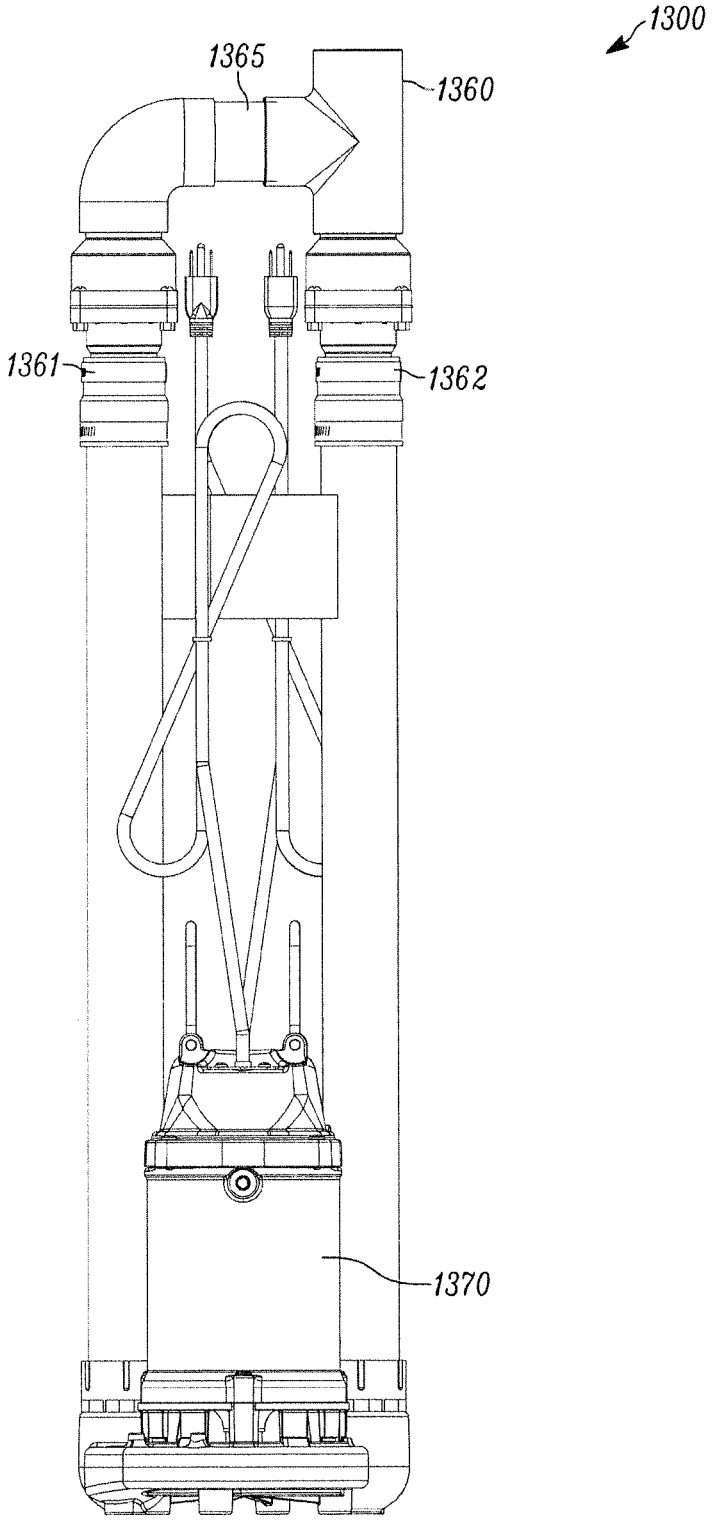
Figure 13F:
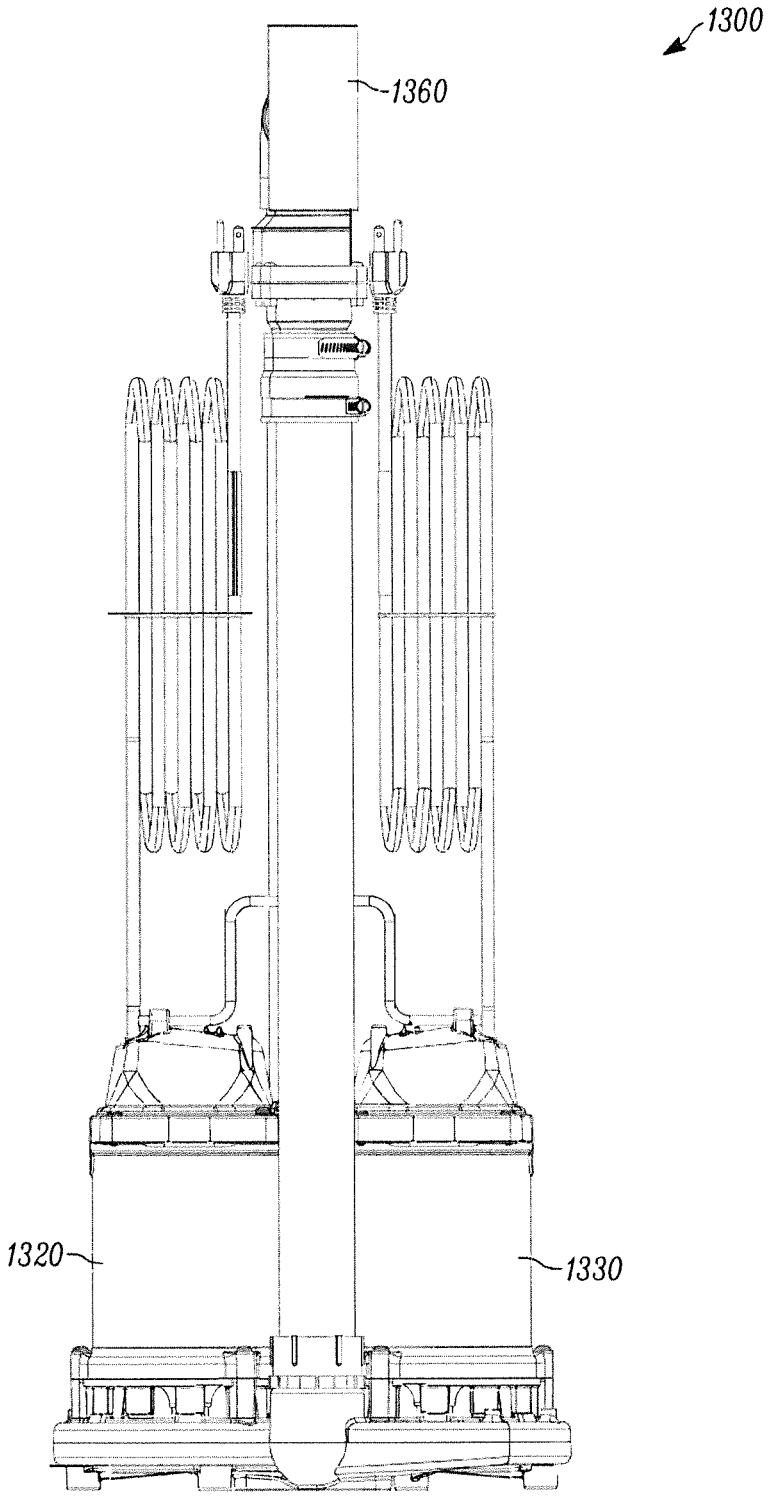
Figure 13G:
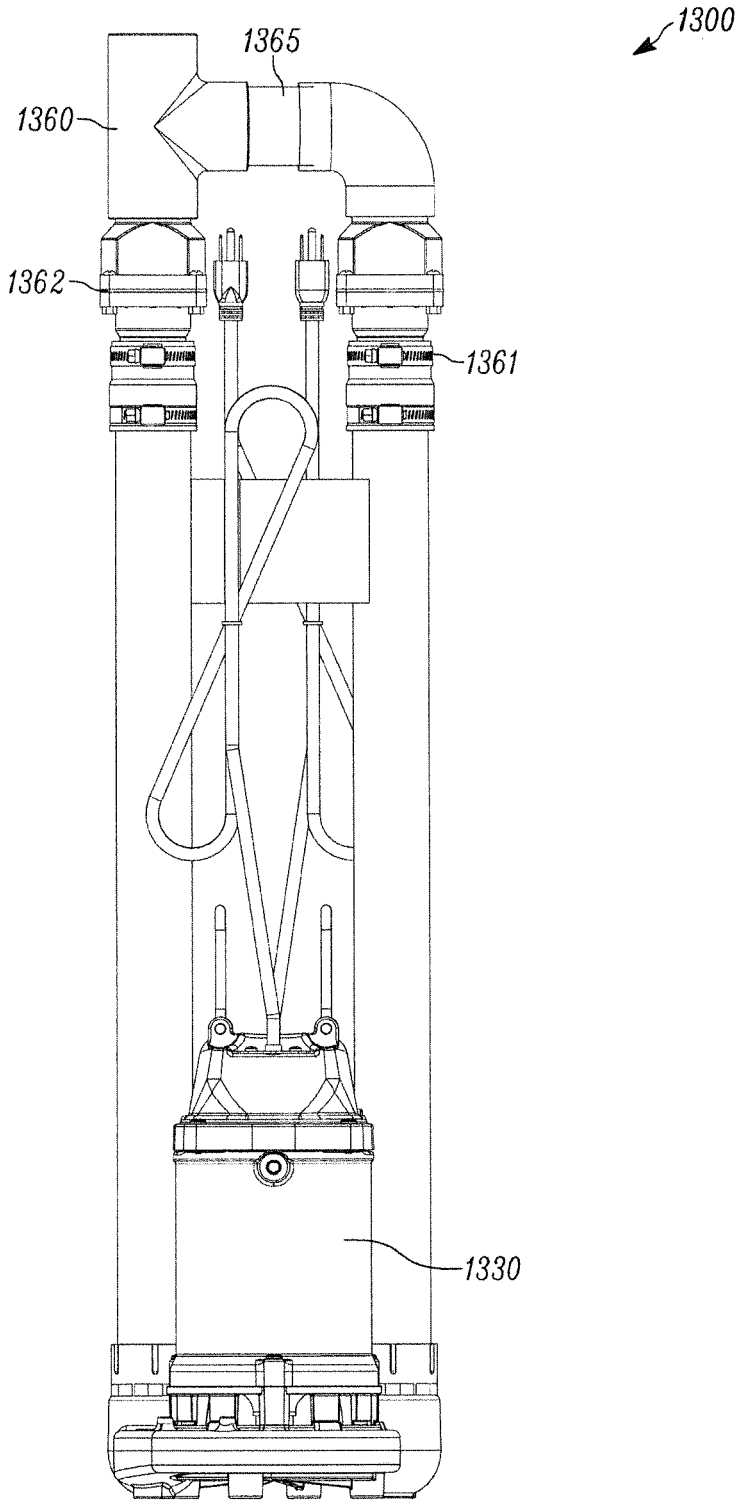

FIG. 12 is a schematic drawing of a system 1200 that allows two separate pumping systems 1220 and 1230 to communicate with one another. For example, in one form, the pump systems 1220 and 1230 may communicate with one another when placed proximate each other via a communication network 1250, which can be a wired connection or a wireless connection (e.g., radio frequency (RF), infrared (IR), Bluetooth (BT), Bluetooth Low Energy (BLE), near field communication (NFC), Wi-Fi, etc.). In the form illustrated, the systems 1220 and 1230 can communicate with one another and transmit operational status to a remote display unit 1240, such as a monitor or other display (e.g., a mobile phone, tablet, PDA, computer, or other network capable component).

The system 1200 can include a control unit 1201, which can be provided as a part of the system 1200, or as an independent, or replaceable component. The control unit 1201 can include a backup battery 1234, and two control modules 1210 and 1211. Alternatively, the two control modules 1210 and 1211 can be independent components that are installable separately with respect to respective pump systems 1220 and 1230. Each pump system 1220 and 1230 can include an AC pump or a DC pump, each of which can be associated with a sensor such as an air tube/pressure sensor 1224 or a float switch 1235. Each control module 1210 and 1211 can be used to operate the corresponding pumping system, while in turn communicating via network 1250 with the other module. The remote display unit 1240 can display the results of the communications between the two systems. For instance, the remote display unit 1240 may communicate via Bluetooth, 4 wire, or another similar technique with the control unit 1201. In this manner, the two systems can be configured to operate in tandem, though the systems may have originally been provided or purchased independently. For example, with this configuration, the primary or secondary pump may be able to take over the operational tasks of the other pump and, in a preferred form, even operate the other pump such as when a controller on one pump goes bad or fails. Ideally, in such a failed controller situation, the controller that assumes operational control of the system will be able to operate both pumps so that the pumps may be cycled on alternately (or alternately activated) to prevent one pump from dying before the other due to excessive use as compared to the other. Another benefit of having the controllers set up in this manner is to allow the controller that has assumed operational control to activate both pumps simultaneously or at least together at some point should fluid be rising at a rate that requires both pumps to operate in order to keep up with the rate the fluid is rising.

A benefit to having redundant systems as discussed in the embodiments above, is the ability to prevent flooding due to a system or component failure. However, as mentioned herein, another benefit to such redundancy is the ability to service one pump while allowing the other pump to continue to operate. Furthermore, as mentioned above, an advantage to having a redundant controller configuration is the ability to continue to offer pumping capabilities when failures occur. As also mentioned, it is desirable to configure the system so that a failed component (e.g., pump, controller, etc.) can be removed while the other component or remaining components continue to operate or offer pumping capabilities. As such, in a preferred form, the controllers may be configured so that separate circuits or circuit modules are utilized to allow a controller to be removed and serviced or replaced while the other controller remains in place and operational. Similarly, it is desirable to have all other modules of the system to offer redundancy and serviceability without disrupting at least partial operation of the system. Some preferred systems in accordance with this disclosure will also notify a user of any system or component failure or malfunction so that the systems or components may be serviced timely.

The present disclosure presents examples of a sump pump system that includes a primary sump pump, which can have an AC power supply, a backup sump pump having a DC power supply, and a controller. The controller can be in electrical communication with the primary sump pump and the backup sump pump, the controller configured to communicate wirelessly with at least one remote device.

In some examples, the controller can be configured to control other systems as a central control module (e.g., sewage or utility pumps or drainage pumps located elsewhere such as outside of home/building).

In some examples, the controller can be configured to communicate with other equipment in a home, such as HVAC equipment, telephone or communication equipment, refrigerators, freezers, ice makers washers, dryers, dishwashers, or other appliances, water meters, home security systems, or the like.

The controller can supply output signals to support multiple notification technologies (analog, cellular, digital, other). The system could be configured to send one-way "push" notifications only or, alternatively, provide two-way communication (e.g., remote actuation of pump, diagnostic check, etc.).

The control components of the system, such as system 300 of FIG. 3, can be configured in a variety of ways. For example, they can be combined with the battery charging electronics and mounted in a highly visible location in the surrounding area of the unit (e.g., on the basement wall for a sump pit, or on the discharge pipe near the sump pit, etc.). In some examples, the system 300 can also include a 12 V DC output 370 and/or an AC output 380. These outputs 370, 380 can be used to provide power to other ancillary devices or equipment, such as communication devices, signaling equipment, sensors, test equipment, light sources, etc.

The sump control system enclosure can also accommodate the battery charging electronics, thereby moving the charging components away from the harsh environment of the battery box and into an area more convenient for viewing & operation by the home owner (ref. sealed sump units with Radon sensors).

In some examples, the system includes a pressure switch that, along with the controller, can also operate both the first and second (e.g., AC and DC) pumps, thereby alleviating the use of multiple float-type switches in the sump pit so that the system is more compact and fits into smaller diameter pits found in many older homes.

In the event of high water intake, the central controller can operate both AC & DC (or two A/C) pumps simultaneously to remove a higher volume of water from the basement. The central controller could also alternate activation between pumps to effectively "exercise" each system to ensure operation and to balance the number of cycles on each unit.

The central control system can supply output signals to support multiple notification technologies (analog, cellular, digital, other). The system could be configured to send one-way "push" notifications only or, alternatively, provide two-way communication (e.g., remote actuation of pump, diagnostic check, etc.).

The controller can include a communication module and is thus configured to communicate wirelessly via a network. For example, the controller can be configured to communicate via a Wi-Fi signal or via a cellular network. In some examples, the controller can also monitor various events relating to the operation of the sump pump system. For example, the controller can be configured to monitor the operating status of the AC power supply, the power level of the DC power supply, the operating state of the primary and/or backup sump pump, problems during operation of the pump, a cycle count of the primary and/or backup pump; an electric current draw rate of the sump pump system, a water level at or around the sump pump, and the rate at which the water level is rising or falling in the sump.

The controller may be configured to perform diagnostic operations on at least one of the primary sump pump and the backup sump pump. The controller can also be configured in some examples to monitor and communicate in real-time information relating to the fluid level, the battery state, the current usage, and the on/off status of the equipment of the sump pump system. In some approaches, the controller includes a communication module, is configured to communicate notifications to a remote device, such as a smart phone, a tablet computer, or anther computing device. The communications module could be a separate unit or integrated into the control enclosures. The controller can be configured to communicate notifications at predetermined time intervals, or during predetermined time periods.

The controller can be configured to automatically communicate notifications in response to the detection of certain events. For example, the controller may be configured to communicate notifications relaying information pertaining to a power outage, a change in the operation state of the primary and/or backup sump pump (e.g., the backup pump turns on, off, or increases/decreases in pumping rate, frequency of operation, cycles, etc.), the detection of a battery level of the DC power supply below a predetermined threshold (e.g., the battery has less than 50%, 25%, 15%, 10%, or 5% power, etc.), a detected problem in the operation of the pump, a detected cycle count of the primary and/or backup pump exceeding a predetermined threshold (e.g., the pump has performed about 50% of the life expectancy of the pump), an electric current draw rate of the primary and/or or backup sump pump above a predetermined threshold, a detected water level rising above and/or falling below a predetermined threshold, and a detected water level rising and/or falling at a rate above and/or below a predetermined threshold (e.g., water is rising faster than the pumping system can pump). In some aspects, the controller is also configured to monitor and report on the brush life of the DC pump motor (or any pump motor) by determining the total "on" time (i.e., the total time in which the pump has been running) throughout the life of the pump. Thus, once the motor has been operated or cycled on for a predetermined amount of time associated with a certain percentage of motor brush wear, the system will provide a notice (e.g., audible and/or visual alarm, data notification such as text or alert, audible communication, etc.). This predetermined amount of wear can be any amount desired, (such as 75% wear, 80% wear, 90% wear, 95% wear, 100% wear, etc.), and may include multiple notices to increase the likelihood that the motor will be timely serviced before a failure occurs (e.g., such as by replacing the motor brushes before they reach or by the time they reach what is predicted to be 100% wear).

Some versions of the controller are configured to communicate notifications that offer coupons for new system in response to the controller detecting a life cycle count has exceeded a predetermined threshold. For example, when the controller detects that the pump has reached the midway point of the life expectancy of the pump (or its life expectancy), the controller may send coupons, reminders, or other notifications to alert a consumer to purchase a new pump and/or perform service or maintenance on the pump. In some aspects, the controller may communicate notifications that offer an extended warranty option for systems that the controller has detected a life cycle count that exceeds a predetermined threshold (e.g., indicating that the user may want to pay for such extended coverage given its system is detected to be working at usage levels that exceed normal usage guidelines or thresholds). In some approaches, the controller is configured to track unit parameters that provide insight into whether a warranty should be honored. For example, the controller can track whether warning notifications have been properly addressed and/or ignored by the pump owner. That is, the controller may determine that a sump pump system failure is a result of ignored notifications communicated by the controller, and use this information to determine if warranty status is still authorized.

In some forms, the controller can receive communication signals from a remote device, and perform functionality in response to the communication signals received from the remote device. For example, the controller can be configured to receive signals from a user operating an application on a remote device (e.g., a smart phone) that instruct the pump to turn on, turn off, activate a backup pump, etc. In response the controller will effect operations of the pump accordingly (e.g., self-test, self-diagnostics checks, etc.).

Some examples described herein also present a mobile application used in connection with a sump pump system. The application can be configured to operate on a remote device, such as a smart phone, a tablet computer, or the like ("app"). The mobile "app" may include an interface that can provide information to the user, and can allow the user to execute various functionality.

In some approaches, the app is configured to operate one or more of a variety of features. For example, the application can be configured to operate one or more of the following features/functions:

(1) display key system status parameters (water level, battery state, power on/off);
(2) perform diagnostic check/systems test;
(3) provide real-time fluid level feedback, battery state, current usage, on/off state, etc.; (the app can provide active feedback or a closed-loop controller concept);
(4) track real-time or time lapsed pump usage and prompts notifications at desired time periods;
(5) offer coupon for new system once predetermined life cycle count has been reached;
(6) offers extended warranty option when pump is approaching original warranty limit; and/or
(7) tracks unit parameters to provide insight on whether warranty should be honored or not (e.g., if system repeatedly advised user of problems and failure was due to user ignoring notifications).

It should be understood that reference to "real-time" as used herein may mean exactly that, i.e., real-time data, or it may include slightly time-delayed data that may be better described as nearly real-time or not old/historical data.

Figure 4A:
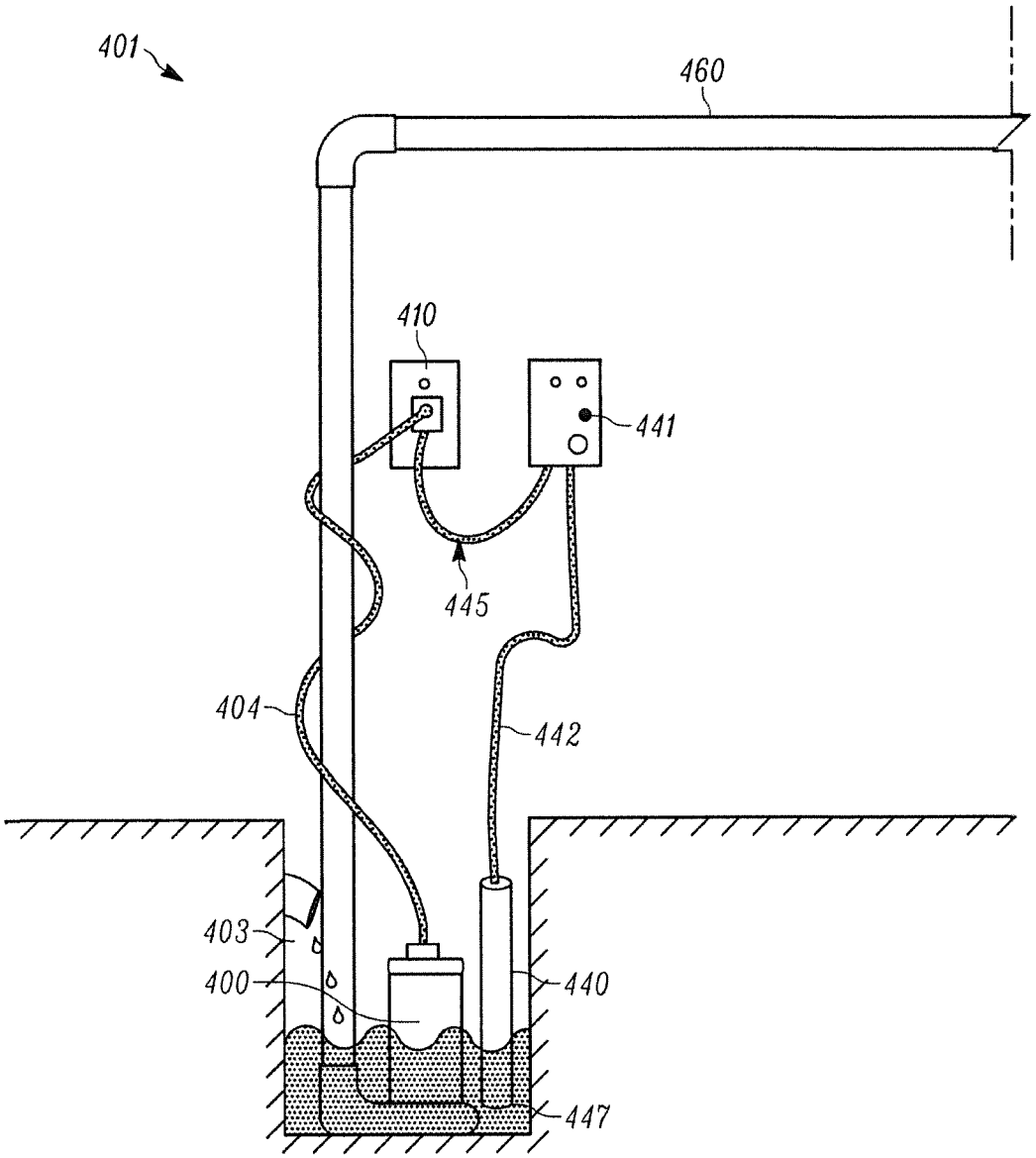
FIGS. 4A-B are sketches showing an example of a sump pump in a sump pit with a pressure tube.
Figure 4B:
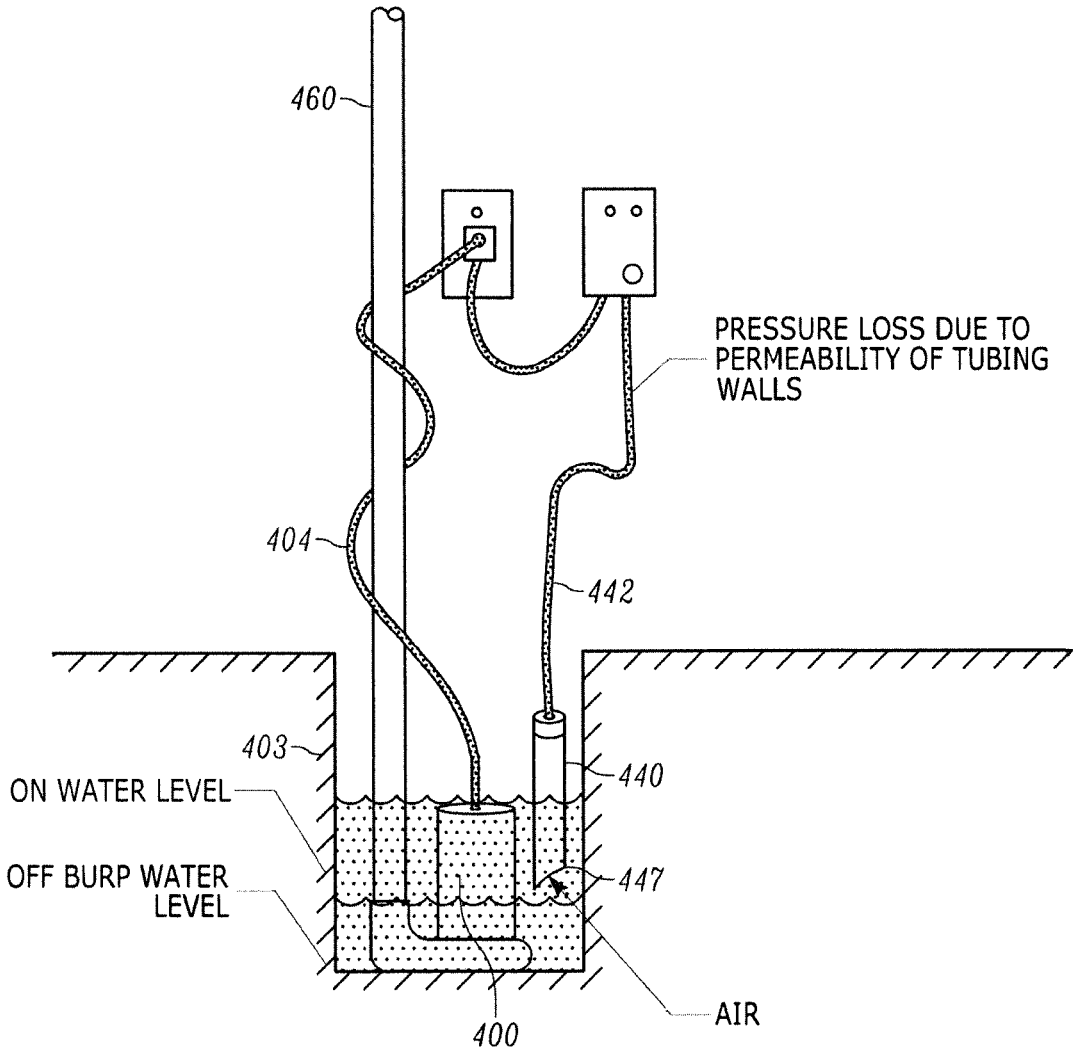

The system can be configured to execute/display/operate the same functions on a display associated with the unit itself (e.g., a display interface at or around the controller or integrated module) that are executed on the app. Some examples described herein also apply the use of a pneumatic pressure switch that eliminates and/or reduces the number of moving parts, which can result in an increase in system reliability. FIGS. 4A-B are sketches showing an example system 401 that uses a pneumatic pressure switch. The system 401 includes a sump pump 400 and a pressure tube 440 in a sump pit 403. The sump pump 400 is connected to a power source 410 (e.g., a 120 V AV 60 Hz outlet) via a sump pump power cord 404, and is configured to pump fluid out of the sump pit 403 through the pump discharge outlet 460. The pressure tube 440 has a pressure tube inlet 447, and is connected to a switch device 441 via a flexible tubing 442. The switch device 441 can be or can include a pressure transducer, a printed circuit board, a microprocessor, a triac switch, or the like. A piggyback cord 445 supplies electrical power to the switch 441 from the power source 410. The pneumatic pressure switch system 401 of FIGS. 4A and B can be configured to flush air after a predetermined period to recalibrate and eliminate problems with condensation build-up or tube leakage. In some examples, the pneumatic switch tube 440 could be of a basic plastic construction, or wholly or partially constructed from copper to help reduce the build-up of iron ochre. While it is known to use capacitive sensors in sump pump systems (see, e.g., U.S. Pat. No. 8,380,355, and U.S. application Ser. No. 13/768,899 (Mayleben et. al.), owned by Wayne/Scott Fetzer Company, both of which are hereby incorporated by reference in its entirety), such systems may evoke additional steps to ensure that the air tube is back to atmospheric pressure. The present disclosure describes systems that employ sensors that are adapted to operate so that the water level is held below an opening. In this manner the fluid level in the pit maintains a certain level with respect to the fluid level in the tube (e.g., the pit and tube fluid levels do not have to be equal or level with one another, but rather simply correlate with one another so that the level in the tube can be used to calculate a corresponding level of fluid within the pit). Further, in some examples, the systems will be configured to turn on after a predetermined time so that the air in the tube returns to atmospheric pressure.

Some examples described herein provide a variety of uses and functionality. One embodiment includes a pump volute design that supports close nesting of pumps. Another embodiment includes a water level sensing algorithm that receives inputs from an air tube to a PCB mounted pressure transducer. Though the air tube can be arranged in a variety of configurations, in some aspects the air tube may be arranged in a generally vertical orientation. Another embodiment includes the ability to remotely mount the sensing/switching electronics out of the sump pit. Some examples described herein provide an integrated water level sensing & DC battery charger electronics in one enclosure. Some aspects described herein provide a communications module that can receive & send data from the central control unit. Some examples include a mobile application that can receive push notifications showing system status. Still other examples, offer two-way data communications between App & central control to allow remote system test.

Some examples described herein present a redundant control system for a pumping system or pumping arrangement. The pumping arrangement has at least one pump, and can include a primary (e.g., an AC) pump and a secondary or backup pump (e.g., an AC backup pump or a DC pump). The redundant control system includes a primary controller that directs or manages operation of the at least one pump, and a secondary controller that controls operation of the at least one pump in the event that the primary controller is inoperable, unavailable, or otherwise non-functional. In some forms the primary controller controls operation of the primary pump and the secondary controller controls operation of the secondary or backup pump. In some examples, the secondary controller is configured to control operation of the first pump in the event that the primary controller is inoperable.

The controllers can be either AC powered, DC powered, or both. For example, the primary controller may be an AC powered controller and the secondary controller can be a DC powered controller, but also be provided with an AC supply that keeps the DC powered controller charged. The controllers can take on a variety of forms. For example, in one aspect, the primary controller may include or be a primary microprocessor. The secondary controller can also be a software executing apparatus, such as another microprocessor, a logic circuit, or the like. In certain embodiments the secondary controller can perform all of the functionality of the primary microprocessor. However, in other embodiments, the secondary controller is limited in functionality, and can only perform some of the duties of the primary controller. For example, the secondary controller may only be able to turn on and off the pumps of the pumping arrangement. In some aspects, the secondary controller is software-free utilizing a relay or a mechanical switch. In some aspects, the secondary controller includes a monitor configured to observe operation of the primary controller, and can assume operation of both the primary and secondary pumps, if required.

It should be understood that the presently described pumps, systems, controllers, and related equipment can be utilized in a variety of different methods or processes. That is, the present disclosure contemplates using the described pumps, systems, equipment, or the like in a variety of methods, processes, or techniques that utilize the advantages of the related equipment. For example, one method involves reducing the footprint (e.g., reducing the overall occupied space) of a two-pump pumping system. The method includes connecting a primary pump check valve and a secondary pump check valve to discharge outlet with a cross-over pipe that extends over the primary pump and the secondary pump, placing the two-pump pumping system into a sump pit, and connecting the discharge outlet to create a redundant system.

Another method involves activating a pump of a sump pump system. The method includes providing a primary controller electrically connected to a primary pump, whereby the primary controller has a primary interface for communicating with a primary and secondary pump. The primary interface is operated to activate the primary pump, a secondary pump, or both pumps, when the fluid level sensor indicates a predetermined fluid level has been reached.

Another method involves placing a two-pump pumping system into a sump pit. The two-pump pumping system includes a first pump having a first volute and a first discharge pipe segment, and also includes a second pump having a second volute and a second discharge pipe segment. The first and second discharge pipes are connected to one another to interconnect the first and second pumps to one another. The two-pump pumping system can then be placed into a sump pit as an integrated assembly. In such configurations, a check valve would be positioned in line with each pump discharge or in other forms an isolation valve like the one discussed further below could be used.

Yet another method involves pumping fluid from a sump pit with a two-pump pumping system. The method includes pumping fluid from the sump pit with the primary sump pump, and detecting one or more conditions associated with at the pumps and/or the sump pit (e.g., the fluid level in the sump pit). In response to detecting one or more predetermined conditions, the secondary pump is then activated to pump fluid from the sump pump. For example, when the method detects that water in the sump pit has exceeded a predetermined height, the secondary pump can activate to facilitate the pumping of the primary pump.

Other methods relate to the transmission of notifications that relate to a pumping system installed in a sump pit. First, one or more pumping conditions associated with at least the pumps or the sump pit are detected via one or more sensors. In response to detecting one or more conditions (which may be predetermined), a controller will transmit a signal, for example, to a remote device. The signal can include information or otherwise notify a user of the circumstances associated with the detected conditions.

As discussed above, some examples of the dual pumping system include dual pumps that are integrated via a shared volute or other structural designs that combine the volutes of two pumps into a common space. These pump volutes can be manufactured together as a single component, or they can be joined via components that inhibit separation of the two pumps. For example, the pumps may be cuffed or otherwise connected via a bracket or other structure.

Figure 16A:
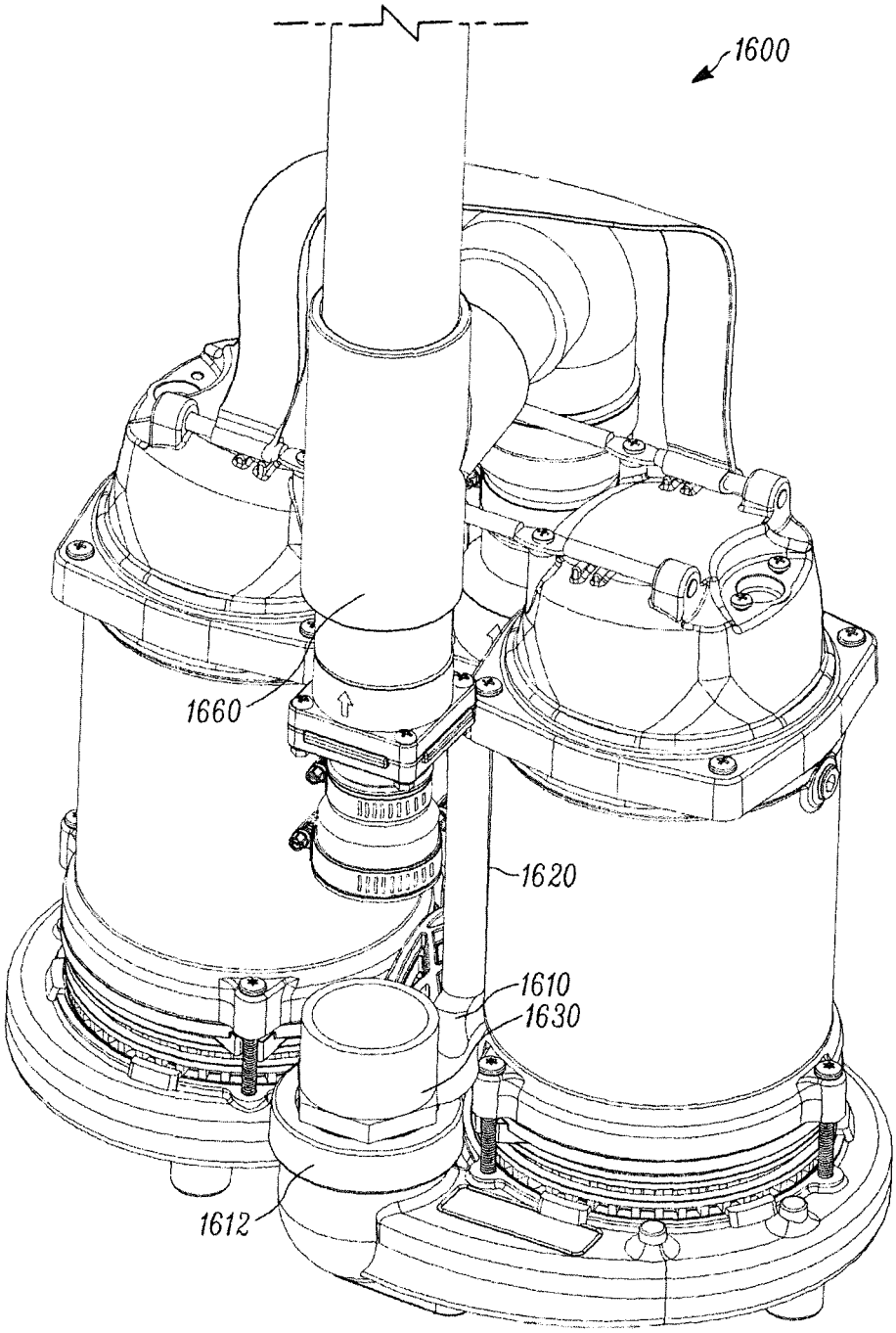
FIG. 16A shows an exemplary sump pump assembly with a bracket that cuffs the two pumps together in accordance with examples described herein.
Figure 16B:
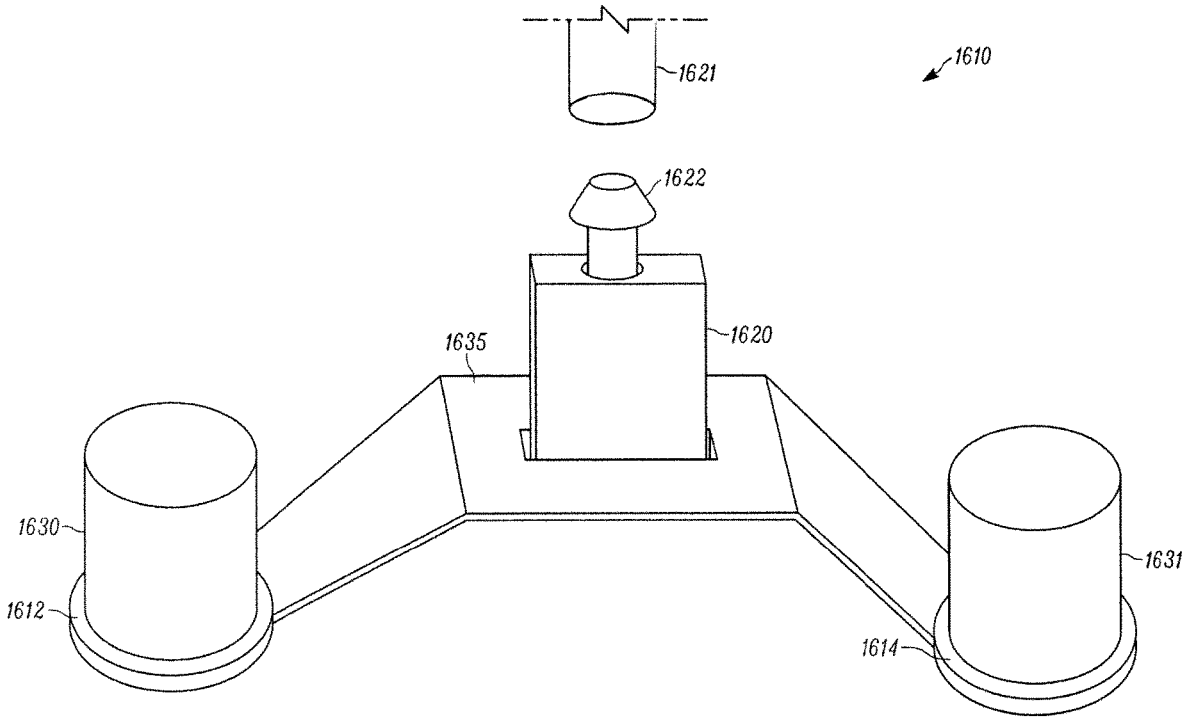
FIG. 16B shows the bracket of the assembly of FIG. 16A having a bridged configuration to support a pressure tube.

FIG. 16A shows an exemplary sump pump assembly 1600 with a bracket 1610 that cuffs the two pumps together in accordance with examples described herein. The bracket 1610 is shown removed from the pump assembly in FIG. 16B for clarity. In this example, the volutes for each pump have an outlet portion, which may comprise a collar 1630 and 1631 configured to attach to a discharge pipe 1660. The bracket 1610, may comprise annular portions 1612 and 1614 configured to surround the collars 1630 and 1631, respectively, thereby embracing or "handcuffing" the two pumps together. The brace can take on a variety of forms and configurations, but in some forms, the brace will extend between the two pumps, and will connect to each pump on opposing sides of the assembly 1600. In FIGS. 16A and B, the bracket 1610 is shown to have a bridge configuration with a raised portion 1635 between the two annular ends 1612 and 1614. This raised bridge portion 1635 raises up so as to support a pneumatic pressure tube 1620 box or housing, which can attach to a tube 1621 via a connector 1622, and function as a sensor to control operations of the pump assembly 1600.

Figure 17:
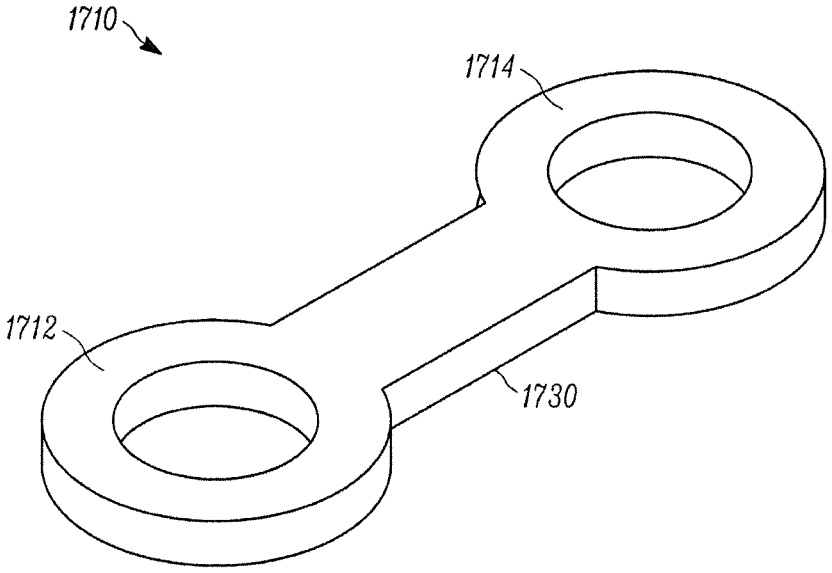
FIG. 17 shows an example of a flat, or planar bracket that could be used in accordance with a sump pump assembly described herein.

In other configurations, however, the bracket can have a straight, flat, or planar configuration, as shown in FIG. 17. In this example, the bracket 1710 has a dumbbell like shape, with two end portions 1712 and 1714 separated by a central portion 1730 that is planar with the ends 1712 and 1714. Such a configuration may provide added strength and stability to the assembly, reducing the number of points of weakness that may be present on a bridge shaped bracket, particularly in situations where the bridge is not used to support a pressure tube.

Figure 18:
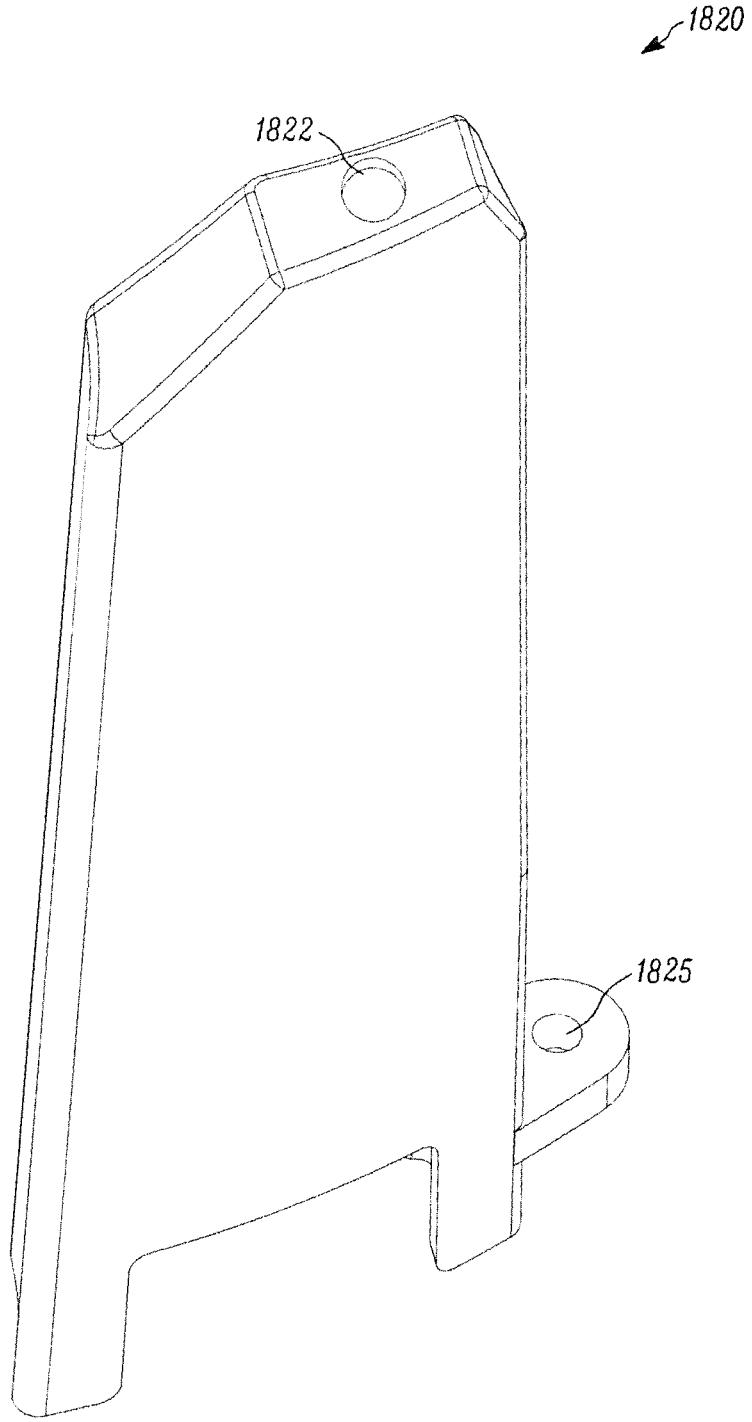
FIG. 18 shows an example of a pressure tube housing used in accordance with examples of sump pump systems described herein.

As discussed above, some pumping systems described herein include a pressure tube that can serve as a sensor to control the pumping of fluid by the system. The pressure tube can be installed or installable with respect to the system in a variety of different configurations. In FIGS. 16A and B, the pressure tube 1620 is held in between the two pumps, and supported by a bridge shaped bracket 1610. In other configurations, however, the pressure tube can be stored within a housing, such as the housing 1820 shown in FIG. 18. The housing 1820 can be configured to attach to the pump assembly along an outer periphery of the assembly. For example, the housing 1820 may include attachment mechanisms 1825 (such as holes or protrusions) that facilitate attachment to an upper surface of a volute of a pump assembly. In some forms, the housing 1820 may have a curved shape and be configured to correspond with the contour of the pump assembly to provide a more streamlined appearance. The housing 1820 may include an aperture 1822 that may be configured to hold and support a pressure tube.

The present application also describes examples of sump pump assemblies that utilize various check valve systems that control the flow of fluid out of the pump, and inhibit the flow of fluid back into the pumps. Many systems that utilize multiple pumps are configured to discharge both pumps through a common discharge pipe. This avoids the additional cost of routing a second line dedicated to the secondary or backup pumping unit. However, when this technique is employed, in particular with centrifugal pumps, it may be important to utilize check valves in the discharge lines of one or more of the pumps (and preferably both) to block or inhibit flow from one pump back into an inactive pump unless an isolation valve like the one discussed below is used.

Figure 19A:
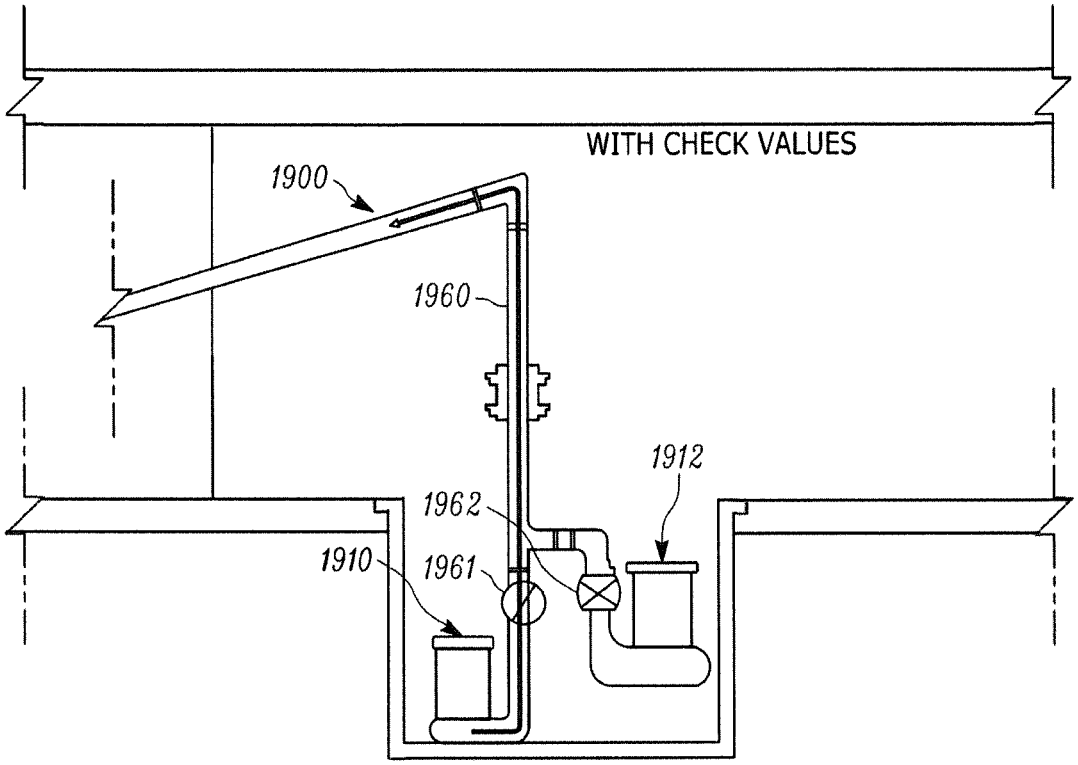
FIG. 19A shows an example of a sump pump system utilizing check valves for demonstrative purposes.
Figure 19B:
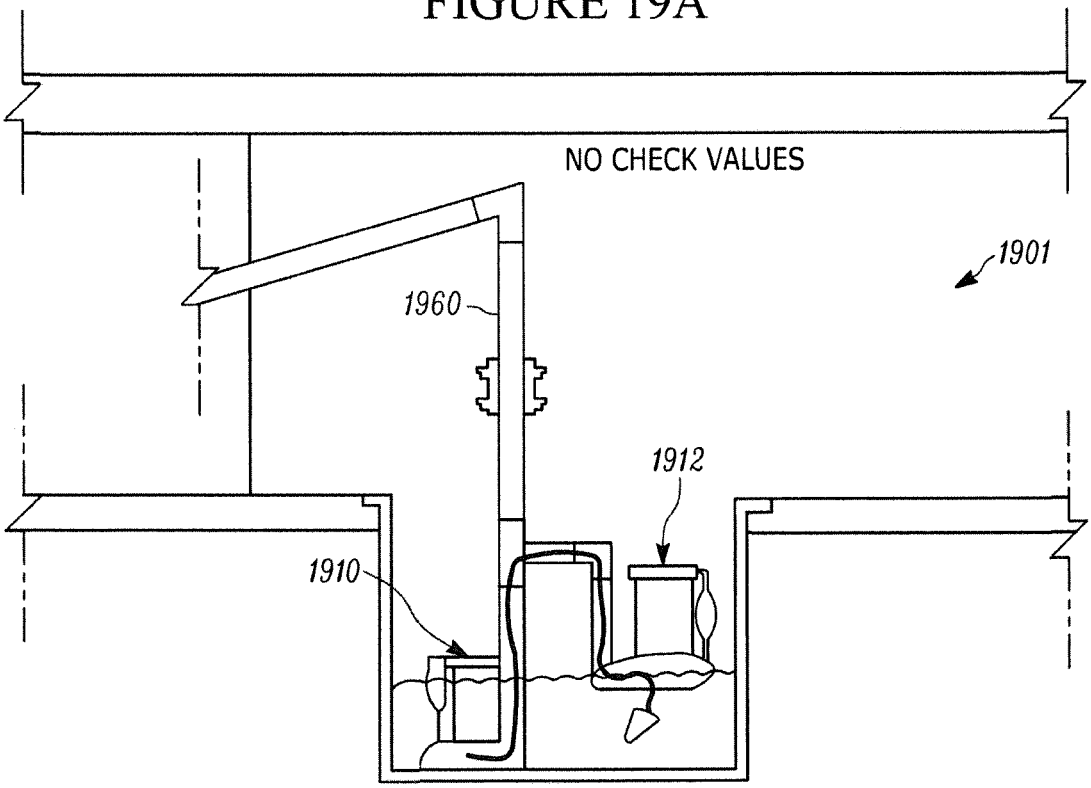
FIG. 19B shows an example of a sump pump system without check valves for demonstrative purposes.

FIGS. 19A and 19B demonstrate why check valves are preferred in dual pump systems with a shared discharge pipe. In FIG. 19A, the dual pump system 1900, which utilizes check valves, includes an active pump 1910 and an inactive pump 1912 that both pump through outlets toward a common discharge pipe 1960. In this system 1900, the flow path from each pump toward the discharge pipe 1960 includes a check valve 1961 and 1962. These check valves allow fluid from the pump to pass out of the pump, but inhibits fluid from passing backward into the pump. Thus, in FIG. 19A, fluid pumping out of the pump is directed out of the discharge pipe, and check valve 1962 stops fluid from recirculating into the inactive pipe.

FIG. 19B shows a dual sump pump system 1901 that does not utilize check valves. In this system, fluid from the active pump 1910 is pumped toward the discharge pipe 1960. But because the secondary or backup pump 1912 does not utilize a check valve, some or even all of the fluid pumped by the active pipe is recirculated back through the backup pump and back into the sump pit. Not only is this system ineffective and inefficient as the system essentially is recirculating fluid back into its own system, which can result in flooding the surrounding environment and/or be harmful to the inactive pump.

Figure 20:
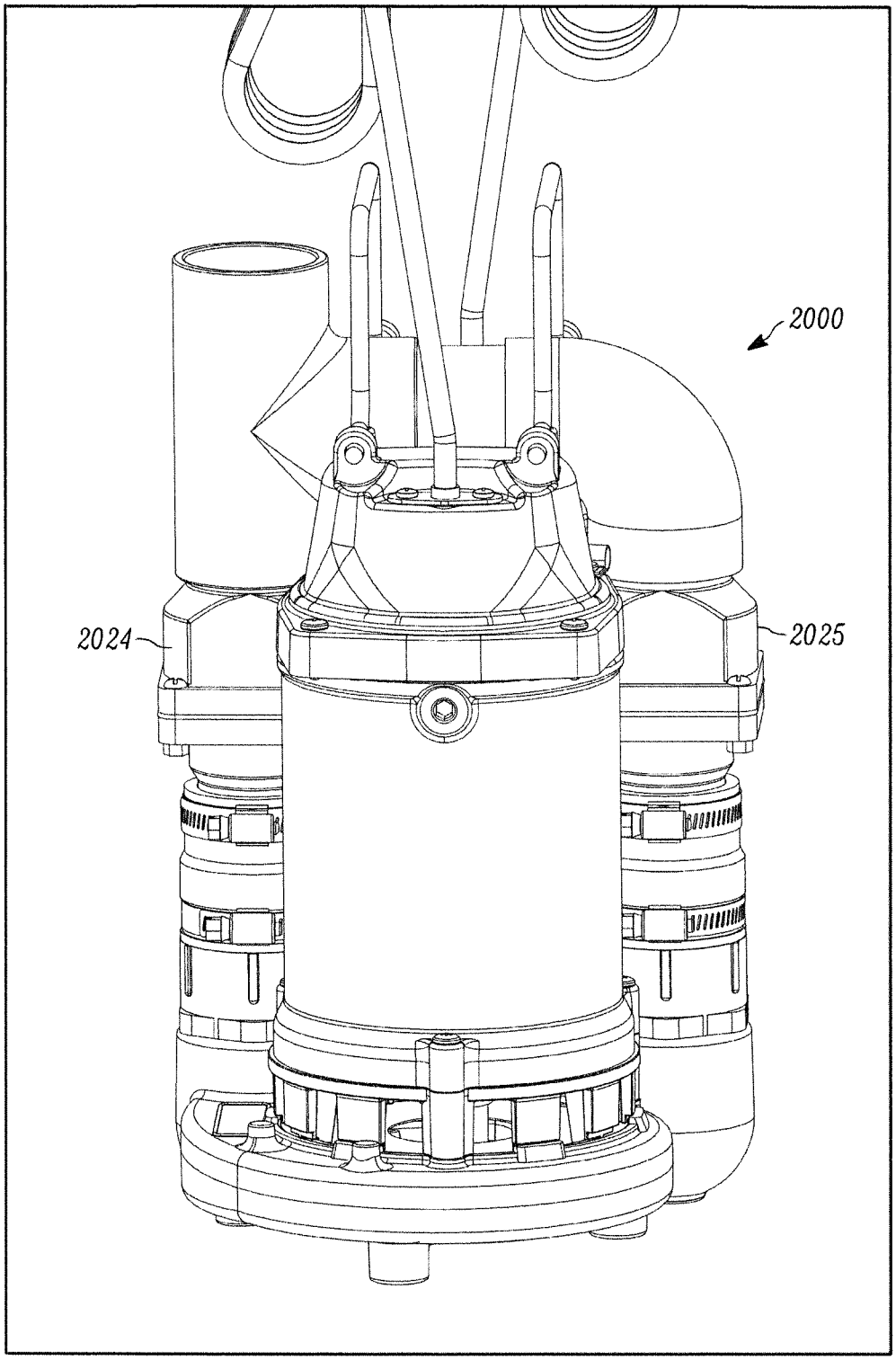
FIG. 20 shows an example of a sump pump assembly utilizing separate check valves for each pump in accordance with examples described herein.

Certain aspects described herein utilize a system that employs dual check valves in the outward flow path of each pump. FIG. 20 shows an example of a sump pump assembly 200 utilizing separate check valves 2024 and 2025, for in the outward flow path for each pump. This situation is similar to the one described in FIG. 19A. This dual check valve configuration is highly preferred for operation in pumping systems with a common discharge. However, in certain situations it may be desirable to reduce the number of check valves provided in a system without effecting the end result, such as by using an isolation valve. Accordingly, some aspects of this application relate to an isolation valve (also referred to as a diverter valve) that can conserve space and cost by providing a single valve that operates to the same effect of a dual check valve system. That is, the isolation valve can effectively allow each pump to pump fluid toward a common discharge pipe when they are active, while also inhibiting or preventing the recirculation of fluid back into an inactive pump. Such a system may be utilized to allow both pumps to pump fluid simultaneously, thereby allowing the system to operate in a maximum pumping mode when water levels rise to a particular level.

Figure 21:
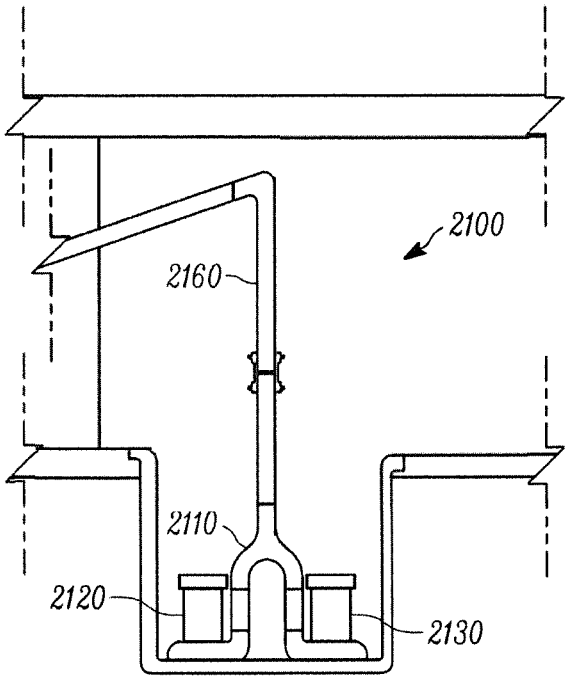
FIG. 21 shows an example of a dual sump pump system with an isolation valve in accordance with aspects described herein.

FIGS. 21-24 show various examples of isolation valves or single piece discharge units that can be used in place of a dual check valve system. FIG. 21 shows an example of a dual sump pump system 21 with an isolation valve 2110 that controls the flow from each of two pumps 2120 and 2130 toward a common discharge pipe 2160. This isolation valve 2110 can be used to stop or inhibit the backflow of fluid through an inactive pump, while simplifying the pump system and reducing the overall number of components and connections required. As shown, the isolation valve 2100 can also serve as a fork or junction that combines the two outward flow paths from each pump into a single flow path, which in turn flows into the common discharge pipe 2160. The embodiments with a single flap or flapper are diverters only and, in preferred forms, will still utilize a downstream check valve to ensure fluid does not recirculate. Conversely, the embodiments with two or dual flaps/flappers will preferably be sufficient to prevent recirculation of fluid so that downstream check valves are not needed.

Figure 22A:
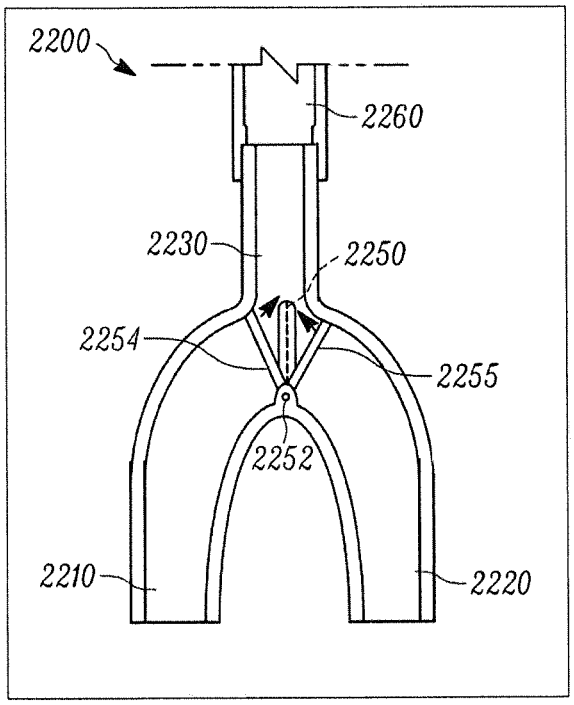
FIGS. 22A and 22B show a cross section of an isolation check valve in various states of operation in accordance with examples described herein.
Figure 22B:
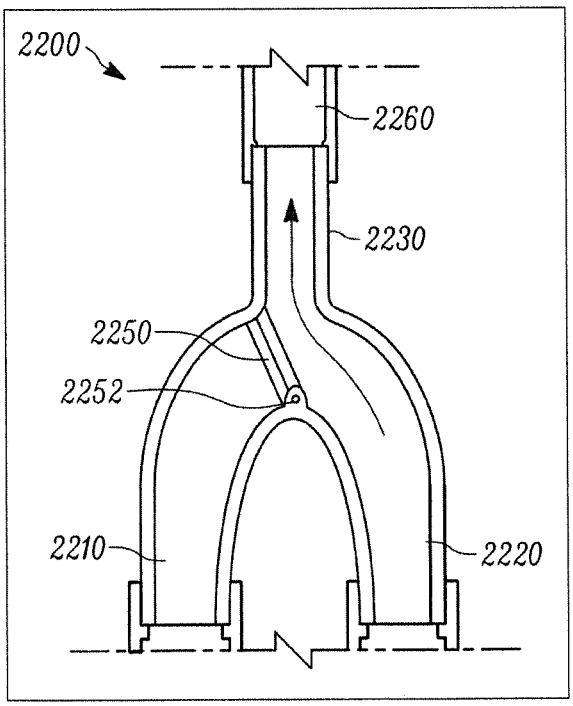

FIGS. 22A and 22B show a cross section of an isolation valve 220 in various states of operation. The isolation valve 2200 has an inverted U or Y shape, representing a fork or junction where two flow paths 2210 and 2220 from two separate pumps join together. Each flow path 2210 and 2220 flows through a junction toward an outer flow path 2300 in the valve 2200, which in turn connects to a common discharge pipe 2260. Within the junction, the valve 2200 includes a flapper 2250 that rotates about a hinge 2252 among a variety of configurations.

In one configuration, shown in FIG. 22B, the flapper is angled to the left, thereby blocking or obstructing the flow path 2210. In this configuration, the flow path 2220 is clear to pump fluid toward the discharge outlet 2230 while the other flow path 2210 is obstructed so that recirculated or pumped fluid will not flow back toward the pump. In another configuration, the flap 2250 may move to the right, thereby allowing flow from the flow path 2210 while preventing recirculated flow back down path 2220. In still other configurations, the flapper 2250 may be positioned in the center, thereby allowing outward flow from each flow path 2210 and 2260.

The flapper 2250 of FIG. 22A is shown as a 2-piece configuration, having a first flapper part 2254 on the left side configured to obstruct flow path 2210 and a second flapper part 2255 on the right side configured to obstruct flow path 2220. When one flow path is open, a flow path may flip a flapper part adjacent to the other flapper part. In preferred forms, this eliminates the need for having any check valves downstream.

The flapper 2250 may be configured to move based solely on the mechanical forces of the pumped fluid. For example, the force of water or other fluid pumped by the pumping system can push the flapper 2250 to an open position. The flapper 2250 can include a spring hinge that defaults the flapper 2250 or both flapper parts 2254 and 2255 to a closed position when no fluid is being pumped through the respective flow paths 2210 and 2220. In some situations, the flapper 2250 or its components can be mechanically or electronically controlled via a system that toggles the flap 2250 between positions. The control system may communicate with the pumping system, or may detect that the pumping system is operating in a certain way, and thus move the flap 2250 to an appropriate position. This control feature may allow the system to determine an ideal flapper 2250 location depending on the amount of fluid being pumped from each flow path, and may allow the system to coordinate optimum flow rates. This control may also allow the system to execute an override to move a flapper in a situation when a particular pump is not operating or not functioning properly.

Figure 23:
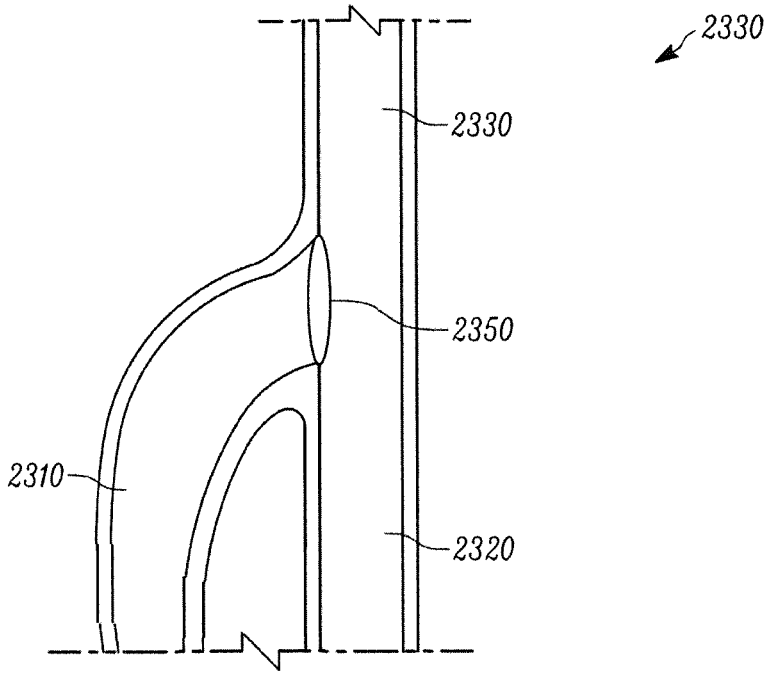
FIG. 23 shows a cross section of one example of an isolation valve described herein.

FIG. 23 shows a cross section of one example of an isolation valve 2200. Unlike the embodiment of FIGS. 21 and 22, which has an inverted U or Y shaped configuration that involves a bend or curve in the outward flow paths from each pump, the isolation valve 2300 of FIG. 23 allows one flow path 2320 to have a straight or linear flow path. In this configuration, a first flow path 2310 coming from a first pump angles toward the discharge portion 2330 of the valve, thereby joining flow paths with the second linear flow path 2320. Because the first flow path 2310 has a bend, the flow resistance may be increased as compared to the second linear flow path 2320. As such, the diameter of this pipe may be increased to account for the flow rate drop. Alternatively, the diameter may be generally the same, but the first flow path 2310 may be configured to attach to a stronger pump, for example, an AC powered pump, which may be more equipped to handle pumping through such a flow path. In this way, the linear flow path 2320 may offer lower flow resistance to a weaker pump, for example, a DC or battery powered pump, or a smaller pump that may be used as a backup or secondary pumping source. In this way, the backup pump can be configured to pump fluid in a "straight shot" configuration, thereby reducing the flow resistance to a pump that may not be equipped to handle as much flow resistance.

The valve 2300 includes a flapper 2350 that rotates between positions that enable flow through the linear flow path 2320 while obstructing recirculated flow through the curved flow path 2310, as shown in FIG. 23. In another configuration, the flapper 2350 may obstruct the flow back into the linear flow path as fluid flows out of the curved path 2310. In still other configurations, the flapper 2350 may be positioned between the two flow paths, thereby enabling outward flow from each path, for example, when both pumps are in operation.

This straight shot configuration can be used in connection with a sump pump system that has dual pumps, as described in accordance with several of the embodiments presented herein. That is, the straight shot configuration may be utilized in an assembly that utilizes a primary pump to pump fluid through a primary outlet pipe or flow path toward a common outlet pipe, and a secondary or backup pump configured to pump fluid through a backup outlet pipe or flow path toward the discharge outlet pipe. The terms primary and secondary or backup here are used for identification purposes, and may not necessarily represent functional roles of the pumps. For example, in some embodiments both pumps may be AC powered pumps that can interchangeably execute "primary" pumping capabilities. In other examples, both pumps could be DC powered pumps that interchangeably execute primary pumping capabilities, or that are both used redundant backups as a part of a larger pumping system.

Figure 26:
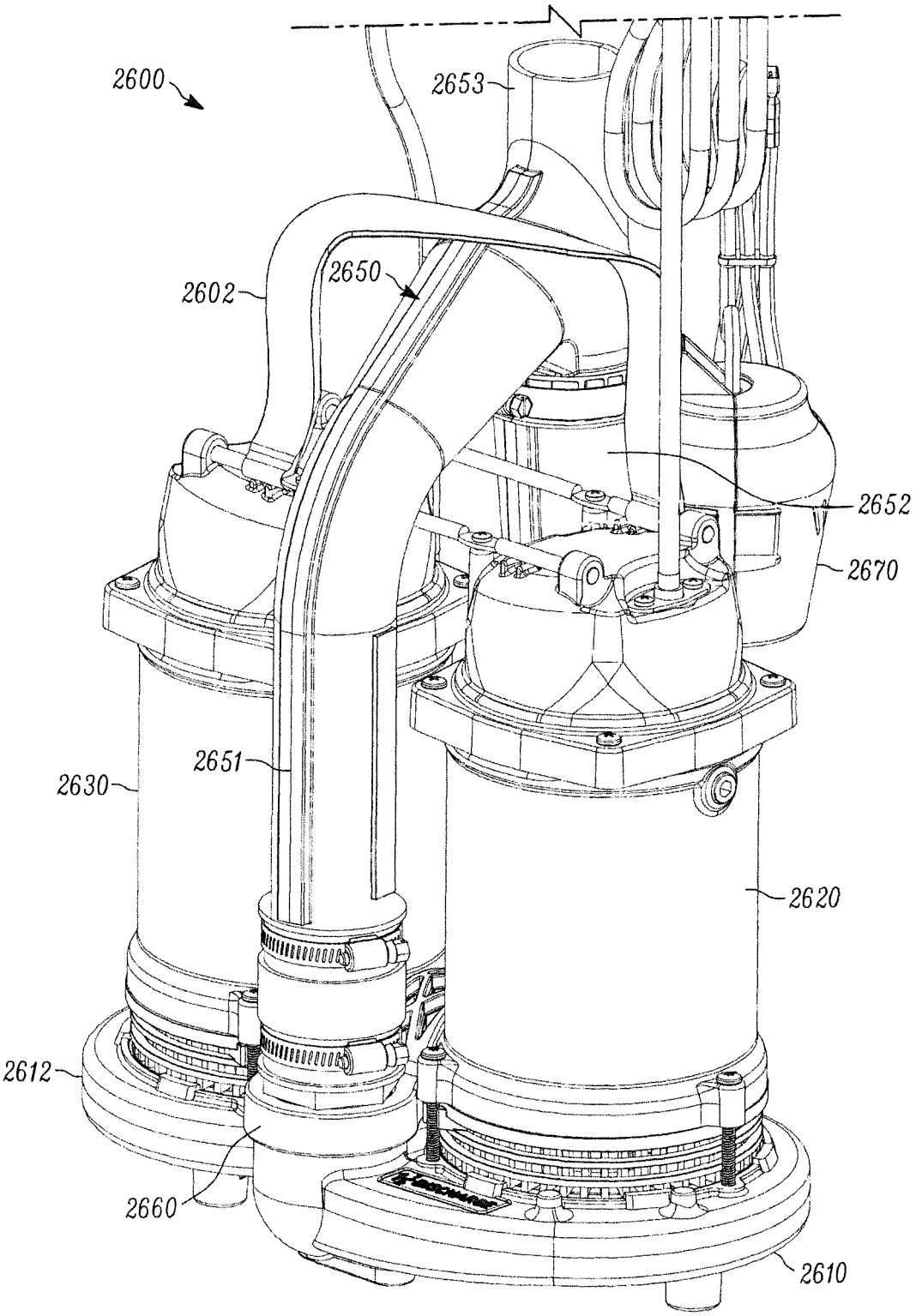
FIG. 26 shows a configuration of a dual pump assembly incorporating a strap handle in addition to other features described in the examples presented herein.

This configuration may employ a straight shot feature so that one of the pumps can pump fluid through an outlet pipe or flow path that runs generally parallel with the discharge outlet pipe, and thus does not experience a substantial pressure drop or increase in flow resistance. This straight shot feature may employ the use of an isolation valve or outlet flow path unit as shown in FIG. 23 or 26. Because this isolation valve includes one straight flow path, a second flow path may include a bend or curve, thereby giving rise to a pressure drop or potential flow resistance. In some situations, the bend can be gradual or angled, as shown in FIG. 23 or 26, but in other examples, other configurations may be used. For instance, the isolation valve may include a curved flow path that intersects a discharge outlet pipe, or an outlet portion of the isolation valve at a right angle. In certain situations, the pumping assembly will be configured so that the straight shot feature aligns with a pump (e.g., the secondary or backup pump) that has a lower pumping power among the multiple pumps. In this way, the weaker or backup pump can pump effectively regardless of which pump is operating. In backup outlet pipe is an extension of the discharge outlet pipe.

Figure 24A:
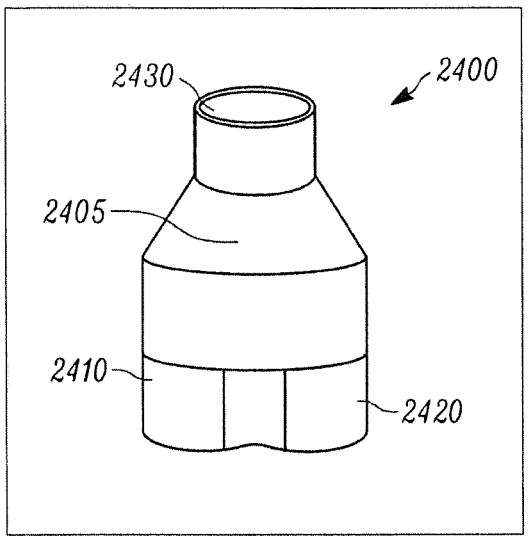
FIG. 24A shows another example of an isolation valve.
Figure 24B:
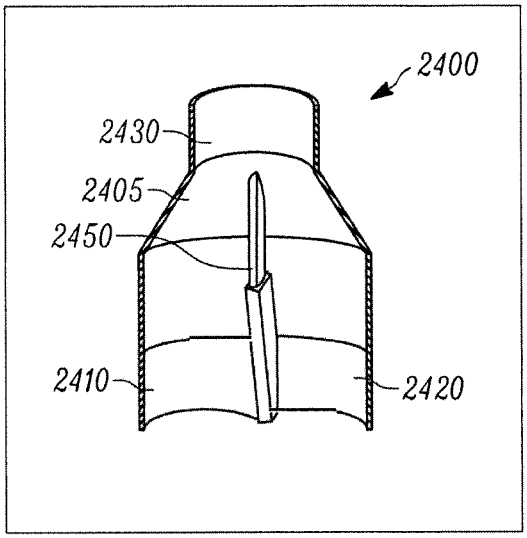
FIGS. 24B-D show cross sections of the isolation valve of FIG. 24A in various states of operation accordance with other examples described herein.
Figure 24C:
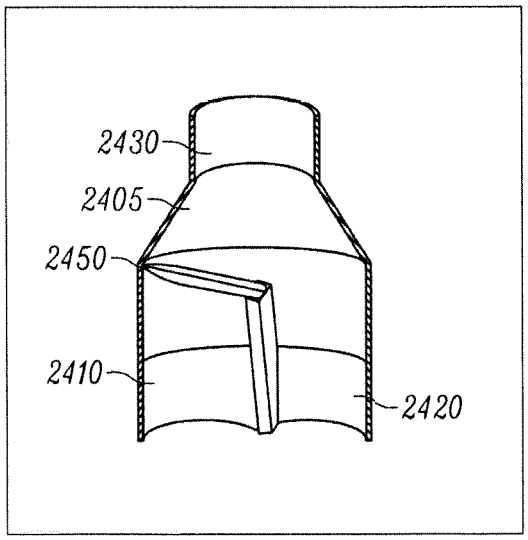
Figure 24D:
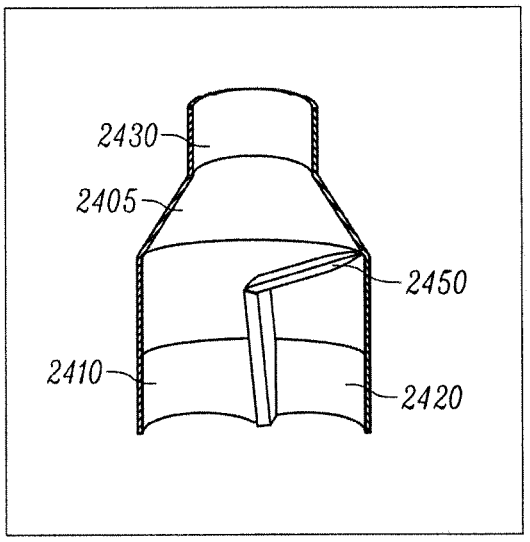

FIG. 24A shows another example of an isolation valve 2400. FIGS. 24B-D show cross sections of the isolation valve of FIG. 24A in various states of operation accordance with other examples described herein. In this configuration, the isolation valve 2400 has two linear and parallel flow paths 2410 and 2420 that meat at a junction 2405 to converge into a single outward flow path 2430. Positioned in the junction 2405 is a flap 2450 that toggles between a position that blocks flow back into path 2410 (FIG. 24C), a position that blocks flow back into path 2420 (FIG. 24D), and a middle position (FIG. 24B) that allows flow out of both paths 2410 and 2420. In this dual flow configuration of FIG. 24B, the configuration of the valve 2400, the junction 2405, and the flap 2450 allows both flow paths 2410 and 2420 to pump fluid at a relatively high flow rate, without experiencing substantial flow resistance and thereby suffering pressure or flow rate drops at the junction.

As noted, various forms of these isolation valves can be used in connection with a variety of the various pumping systems or assemblies described herein. In one example, a sump pump system includes a tandem sump pump unit, which in turn includes a primary pump and a secondary pump, each being arranged to pump fluid toward the discharge outlet. The system also includes an isolation check valve in fluid communication with each of the primary pump, the secondary pump, and the discharge outlet. The isolation check valve operates in multiple operating configurations, including a first configuration where the isolation check valve permits the flow of fluid from the primary pump to the discharge outlet but obstructs the flow of fluid out from or back toward the secondary pump. This configuration can involve the use of a flap that pivots to close and seal a flow path toward the secondary pump, but leaves the flow path from the primary pump generally unobstructed.

The isolation check valve may also operate in a second configuration wherein the isolation check valve permits the flow of fluid from the secondary pump to the discharge outlet but obstructs the flow of fluid out from or back toward the primary pump. This can be achieved, for example, by rotating the flapper unit from the first position where the flow path form the secondary pump is cleared, but the flow path back to the primary pump is obstructed and sealed.

The isolation check valve may also operate in a third configuration that permits the flow of fluid from both of the primary and secondary pumps in the third configuration. This can be achieved, for example, in the configuration shown in FIG. 24B, where a flap is in a position that permits outward flow from both flow paths. Depending on the size, shape, and configuration of the isolation valve, the flow paths, and the flap, this third configuration can be arranged so that pressure drop at the junction is minimized or otherwise arranged to allow flow from both pumps without a substantial pressure drop or flow resistance.

The various configurations of an isolation valve or a diverter valve as described herein can provide specific benefits for a multi-pump system over a system that employs multiple separate check valves. For example, in a dual pump system with check valves, the primary pump (e.g., an AC pump) check valve will typically cycle every time the primary pump runs. This repeated cycling on and off can cause wear and fatigue to the flappers in the valves. After time, this wear and fatigue could result in the flapper and/or the valve failing, thereby giving rise to potential flooding situations. The presently described isolation/diverter valves, however, can inhibit these problems by limiting, inhibiting, delaying, and/or preventing the wear and fatigue on the flapper mechanism of the valve. For example, as described above, the isolation valve can be configured so that the flapper moves to block a flow path when fluid is flowing out of the opposing path. Because a primary pump may run far more frequently than a secondary pump, the flapper may be in the same position (e.g., held in place horizontally like a sewer lid either by gravity and/or water pressure), continually blocking the secondary flow path even after the primary pump has cycled on and off multiple times. In this way, the isolation/diverter valve flapper will not need to move each time the primary pump turns on and off; it can simply remain in place. The isolation valve flapper may only need to move away from its position blocking the secondary flow path when the secondary pump turns on, which for some pumping systems may be only quite rare. As such, the flapper of the isolation/diverter valve can experience far fewer movements than that of a check valve, and thereby experience much less wear and tear.

Figure 25A:
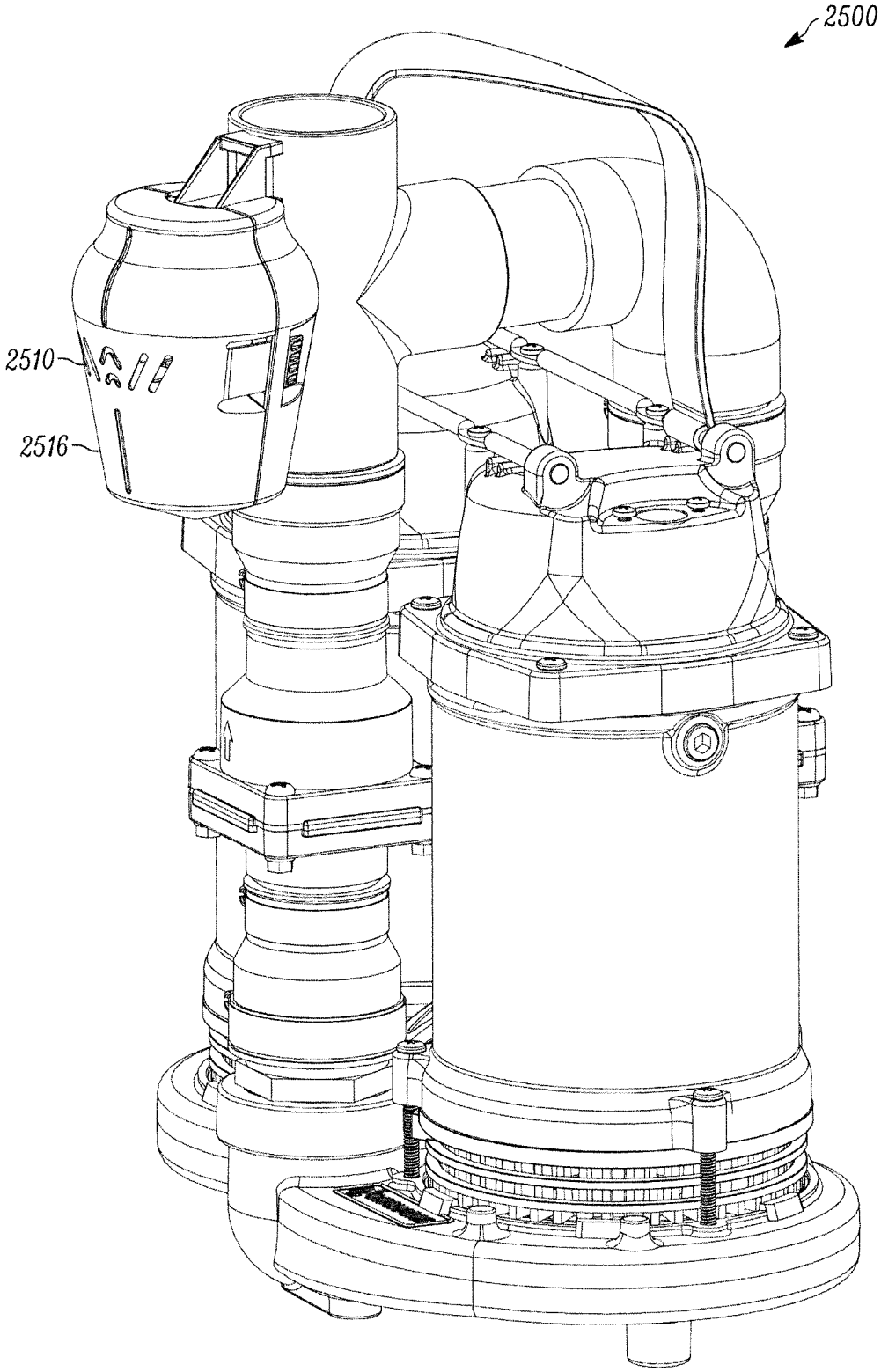
FIG. 25A shows an example of a sump pump system with a redundant high water switch in accordance with aspects described herein.
Figure 25B:
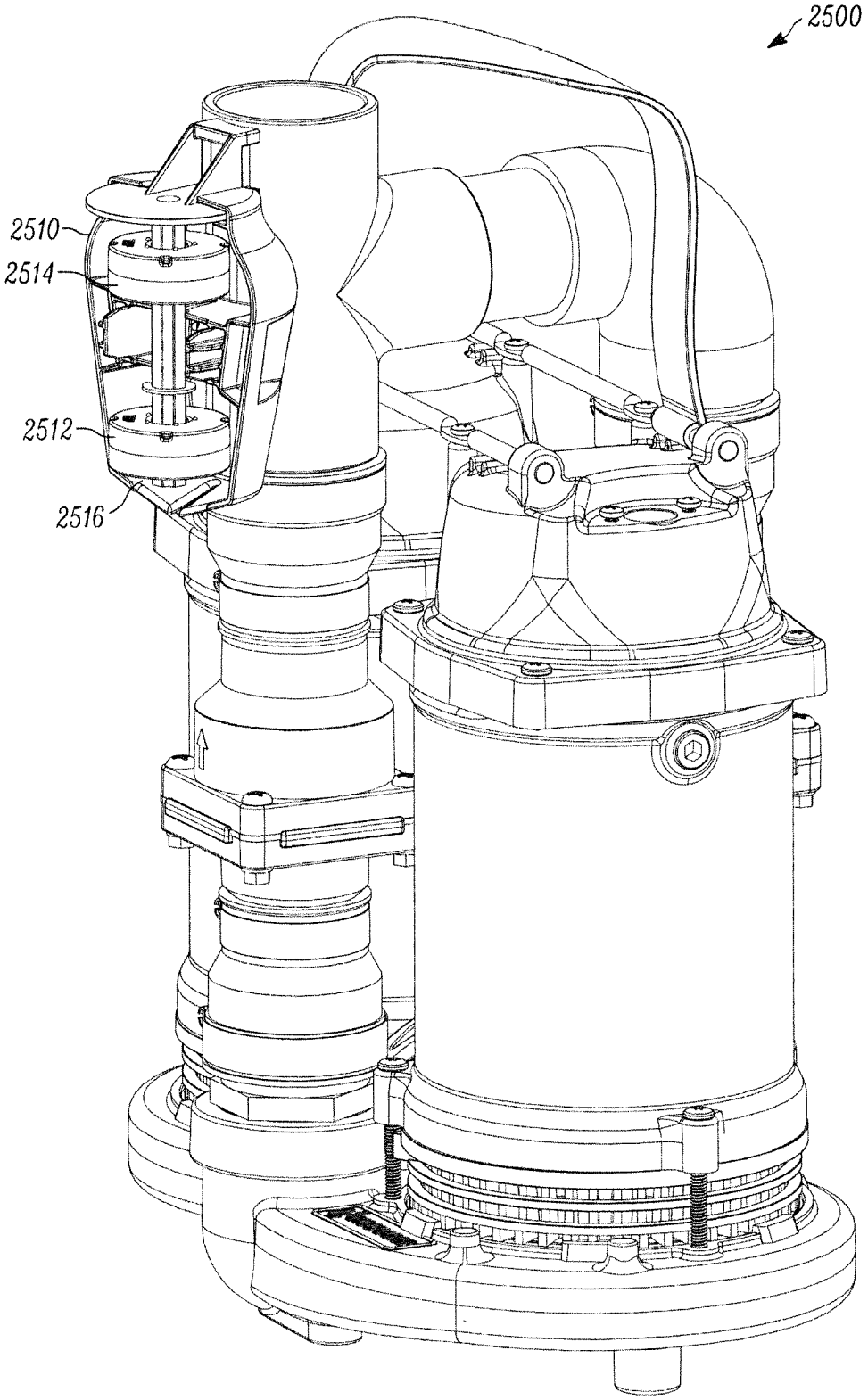
FIG. 25B shows the sump pump system of FIG. 25A, with a cover of the high water switch removed to show the internal components of the high water switch.

This application also describes sump pump systems that employ a redundant high water switch. FIG. 25A shows an example of a sump pump assembly 2500 with a redundant high water switch. FIG. 25B shows the assembly 2500 of FIG. 25A, with a portion of the high water switch housing 2516 removed to show the internal components of the high water switch.

The high water switch 2510 is positioned at a relatively "high" level, above the pumps, and is configured to activate and communicate an instruction or otherwise activate functionality of the assembly 2500 when water rises to or beyond a level that corresponds to the switch 2510. In this way, the high water switch 2510 serves as a failsafe method for activating the pumping assembly 2500 if other means configured to activate the assembly 2500 have failed. That is, where water has risen to the level of the high water switch 2510, it may indicate that one or more pumps of the pump assembly 2500 (e.g., the primary pump) was not properly activated, and will default to automatically activate one or both pumps of the assembly 2500. Additionally and/or alternatively, activation of the high water switch 2510 may suggest that a single pump operating is insufficient to keep up with the current pumping demands. In this way, the high water switch 2510 may be configured to turn on the secondary or backup pump in addition to the primary pump when water levels have risen to the height of the switch 2510.

FIG. 25B shows the internal makeup of the switch 2510 of FIG. 25A, and demonstrates the redundancy features of such a device. The switch 2510 includes a lower float 2512 and a secondary, or higher float 2514. Each float 2512 and 2514 are configured to float on water. The high water switch 2510 is configured so that when the lower float 2512 rises to a certain level above a resting position, for example, because water level has risen to that level, the switch 2510 will activate, thereby effecting functionality of the pump assembly 2500 (e.g., turning on the backup pump). The higher float 2514 serves as a redundant or backup float in the situation where the lower float 2512 fails to operate properly. Additionally and/or alternatively, the higher float 2514 can also be configured to operate as a secondary switch that executes additional or different functionality even when the lower float 2512 operates properly. For example, when the lower float 2512 is activated, the pump assembly 2500 may be configured to activate a backup or secondary pump. When the higher float 2514 is activated, the pump assembly 2500 may be configured to operate one or both pumps at a higher rate, to communicate with another system (e.g., a second backup pumping system) to begin to operate, or to execute a communication device to generate a warning or otherwise transmit a signal to a user.

The redundant high water switch 2510 of FIGS. 25A and B are shown in a housing 2516 that surrounds two floats 2512 and 2514 that serve as the activating mechanisms of the redundant switch 2512. In other examples, a redundant high water switch may include other types of switches (e.g., pressure switches, water detection switches) that operate in a similar fashion.

The present application also describes pump assemblies that include a strap handle for ease of transporting the assemblies, and/or for lowering the assemblies into a reservoir such as a sump pit. FIG. 26 shows a configuration of a dual pump assembly 2600 incorporating a strap handle 2602 in addition to other features. The assembly 2600 includes a first pump 2620 (which may be an AC powered pump) associated with a first volute 2610 and a second pump 2530 (which may be a DC powered pump) associated with a second volute 2612. The two pumps/volutes are cuffed together by a bracket 2660, which cuffs a discharge portion from each of the two pump volutes 2610 and 2612.

The discharge portions are each connected to an isolation discharge unit 2650, which includes two outlet flow paths 2651 and 2652 connected to fluid outlets of each pump, and a discharge flow path 2653. This isolation discharge unit 2650 may be or may include any of the isolation check valves described above. In FIG. 26, the isolation discharge unit 2650 includes a straight outlet flow portion 2652 and a curved outlet flow portion 2651. In this Figure, the straight portion 2652 is connected to the secondary pump 2630, thereby providing lower flow resistance in the discharge path of the secondary pump 2630, which may operate under DC power. 2600 may be removed or replaced out. The assembly also includes a high water switch 2670, which may be similar to, and operate in a similar manner to the redundant high water switch 2510 described above and depicted with respect to FIGS. 25A and B.

The assembly 2600 includes a strap handle 2602, which extends over the isolation discharge unit 2650, thereby allowing the entire assembly 2600, including the isolation discharge unit 2650, to be carried as a single assembly. The strap handle 2602 can be made from a flexible material to allow the handle to be easily gripped, without making the footprint of the assembly 2600 larger. In some examples, the handle 2602 may be formed from a fabric or woven cloth material, a plastic or fiber-based material, or a rubber. The strap handle may be fastened to the tops of the pumps by way of snaps, buttons, rivets, buckles, or other fasteners, stitching or adhesives, or the handle 2602 may be wrapped around bars or other components of the pump assembly 2600. In some aspects, the strap handle may be removable so that certain components of the assembly can be more easily removed or replaced. The strap handle 2602 of FIG. 23 can be used in connection with, or instead of the handles 140 shown in the embodiment of FIG. 1A, which are shown as bar-type handles that may have a more rigid construction.

The present application also provides examples of a battery management system, and related methods, that allows for pumping systems and the control modules to be effectively controlled and operated by a battery or other finite electrical power source. The system facilitates evaluation of the power levels of the batteries, and may determine whether a battery should be charged, replaced, and/or repaired. The battery evaluation system can operate differently depending on the way the battery is being used. In one example, the battery evaluation system can be set up based on a 75 amp-hour deep cycle lead acid battery.

The system may evaluate the charge status of the battery, but it can also evaluate the condition or general health of the battery. For example, as a battery ages, its health will likely deteriorate. Accordingly, a fully charged 8-year old battery will likely not be as useful as a fully charged brand new battery. This is a function of wear and tear and general chemical decomposition of the battery and its components.

When a pumping system is installed, the evaluation system can be configured to operate under an assumption that a new battery is installed and used. Accordingly, a processing unit of the system can be configured to form calculations based on an initial assumption of a new battery, whereas additional uses and tests on the battery will be able to consult with measurements recorded on the battery in previously maintained situations.

A first step for evaluation may be to charge the battery to max capacity, for example, the first step may involve charging the battery for at least 24 hours. After charging, the battery may be allowed to settle for a certain time period (e.g., about six hours) allowing for the removal of excess charge that occurs from the charging process. The evaluation system can then take a voltage measurement with a simulated motor load. Via the processing device (e.g., a computer processor), the voltages measured may then be stored in a database and compared to other data which may be stored in the database. The comparison can yield information about the health and age of the battery.

For example, the evaluation system may compare voltage measurement taken at time X, where X=2 years after the original measurement on a new battery. The evaluation system can then compare this voltage measurement with the information in the database, which may include previous measurements of the battery under test, or other data for reference. Based on the currently measured voltage across the fully charged battery, and the other measurements or information in the database, the system can determine the health or capacity of the battery.

Based on the comparison results, the processor may cause a display to present an indicator showing the status of the battery. For example, the processing device may cause a particular LED indicator or set of LED indicators to operate in a particular manner so as to indicate the battery life level.

For example, a brand new battery may light an LED associated with a "Good" indicator, whereas a partially used battery (e.g., a battery that has been used for a few years), may light an LED associated with an "OK" indicator. An even further used battery toward the end of its life may light an LED associated with "Poor" and a weaker battery still may light an LED associated with a "Replace" or "Dead" indicator. An example of a display unit that provides the battery health information is shown in the remote display panel 2800 of FIG. 28. In the panel 2800, the series 2820 of LED indicators associated are associated with LED lights that indicate the "Good," OK," "Poor," or "Replace" status of the battery being evaluated.

In some forms, the processing device may display the battery level via a display interface, for example, via a display screen that provides the battery level as a percentage, or that presents descriptive terms (e.g., "Good," "OK," "Poor," "Replace," etc.). And in some embodiments, the processing device may operate in connection with an audible alarm that generates an audio signal instead of, or in addition to the generation of these visual indicators.

As a battery ages (e.g., over a period time, such as a few years), the voltages measured under load will reflect lower voltage values as a result of the chemical characteristics of the battery degrading. The battery evaluation system is thus configured to perform repeated periodic voltage measurements. For example, measurements may be repeated about once a month, but in some situations depending on the type of battery and the battery's age, this measurement can be taken more or less frequently. In some forms, this involves subjecting the batter to a load to test battery parameters; however, in a preferred form, the system will use a load-free or no load battery test. For example, in one form, the system is set up based on a seventy-five amp-hour deep discharge lead acid battery. When a system is installed the unit assumes that a new battery is installed. The system's first step is to charge the battery for 24 hours. The battery is then allowed to settle for six hours to remove excess charge from the charging process. An open circuit voltage measurement is made. The voltages measured are compared to stored data and a battery health LED is illuminated to show the status of the battery. In one form, the system will signal the following:

a new battery will illuminate a >4 Hr LED;

a worn batter (e.g., a battery that is a few years old) will illuminate a 2-4 Hr. LED;

a well-used battery (one considered more used than a worn battery) will illuminate a 1-2 Hr. LED; and a weak battery (one more worn than a well-used battery) will illuminate the REPLACE LED.

As the battery ages, over a period of years, the measured open circuit voltages will reflect lower voltages as the chemical characteristics of the battery degrade. In a preferred form, the battery voltage measurement is repeated once a month. The battery must meet the "fully charged" criteria (>13.9V & <0.75 A) before the measurement is performed. The capacity of a fully charged battery is shown by illuminating an LED scale. Charging is done automatically when the pump is not running and charge current is adjusted so as not to damage the battery. When the DC pump is run, the control measures the current used and the amount of time the motor runs. Amp-hours consumed are calculated. The amp-hours used are compared to the latest battery health capacity measurement. An estimate of projected run time is made and the appropriate run time LED is illuminated according to the above. As a depleted battery is being charged, the control keeps track of the charge being added to the battery so the status of available run time is current. In a preferred form, a newer battery, fully charged, will show 6 hours or more run time. A poor battery fully charged may only show 1-2 hours and a newer battery will likely be needed after 4-5 hours of use of a poor battery.

As noted, it can be most efficient if the voltage measurements are taken on batteries that are fully charged (e.g., the battery has been charged for at least 24 hours before performing the measurement). The capacity of the battery can be shown by a different indicator that indicates the battery life (e.g., see interface 2810 in FIG. 28). The evaluation system can also be configured to automatically charge a pump when it is not running. The system can also be configured to change the current, or allow a user to change the current so that the battery does not become damaged.

When a DC operated pump is running, certain features of the evaluation system can be used to measure the current used and the amount of time that the pump motor is running. In this way, the evaluation system can calculate and store information pertaining to the amp-hours used by the pump. This value of amp-hours used can be compared to the latest battery health capacity measurement values. Based on this calculated value, the evaluation system can estimate the projected run time of the pump and communicate a value to a user, for example, by lighting a particular LED, displaying information on an interface, sounding an alarm, generating a notification, or other similar techniques. The calculated value can represent, for example, the expected run time of the battery operating at its current rate without the need for further charging. As a depleted battery is being charged, a control for the evaluation system can keep track of the charge being added to the battery and update the current run time of the battery accordingly.

In some examples, a new battery, fully charged will show a run time of 6 or more hours. An older battery showing a poor status, even when fully charged may only show a run time of 1-2 hours. In some examples, the newer battery, after operating for 4-5 hours, may still show 1-2 hours of available run time. The panel 2800 of FIG. 28 also includes a display 2810 that provides information pertaining to the current anticipated run time of the battery. In the panel 2800, the series 2810 of LED indicators associated are associated with LED lights that indicate the anticipated run time of a pump operating under current operating conditions based on the current status of the battery. The calculated run time can be based on features such as the current operating rate of the pump, the health of the battery, and the current charge level of the battery, for example.

Figure 27A:
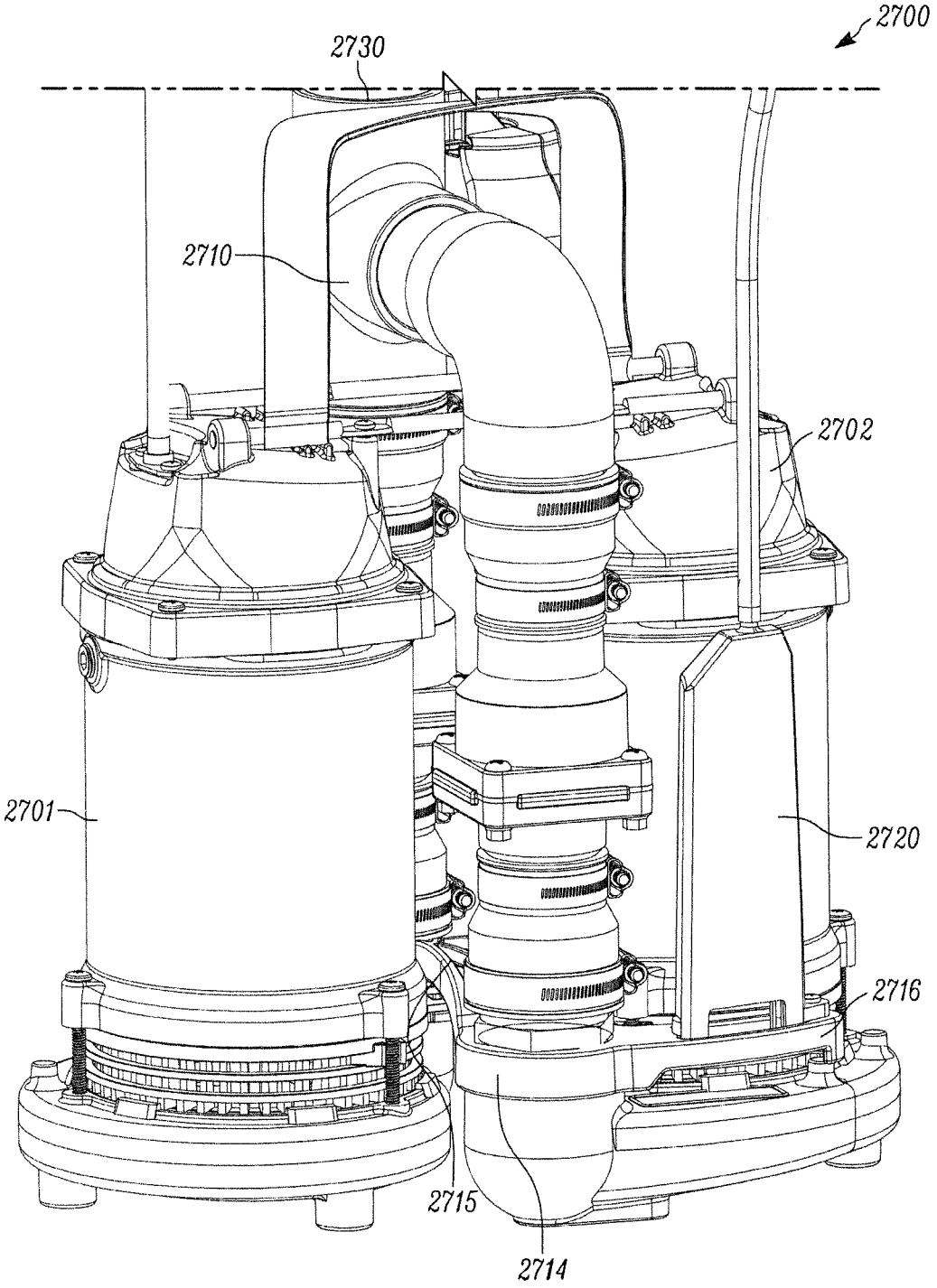
FIG. 27A shows a dual pump assembly with an air switch and a one-piece discharge pipe in accordance with examples described herein.

FIG. 27A shows a dual pump assembly 2700 with two pumps 2701 and 2702, an air switch 2720 and a one-piece discharge pipe 2710. The air switch 2720 includes a pressure tube housing that attaches to the pump assembly about an exterior side of one of the pumps. The air switch can be or can include the air switch depicted in FIG. 18 and described above. The one-piece discharge pipe 2710 can be, or can include the isolation valves or discharge units described above with respect to FIGS. 21-24D and 26. For example, the assembly 2700 may include a one-piece discharge pipe unit that includes the straight shot portion and the curved portion specifically depicted in FIGS. 23 and 26. In other examples. By employing a one-piece unit 2710, the assembly 2700 is "site ready" for a quick and easy installation. That is, the assembly 2700 can be configured to hook up to a discharge pipe at a single location (e.g., via the discharge outlet 2730).

Figure 27B:
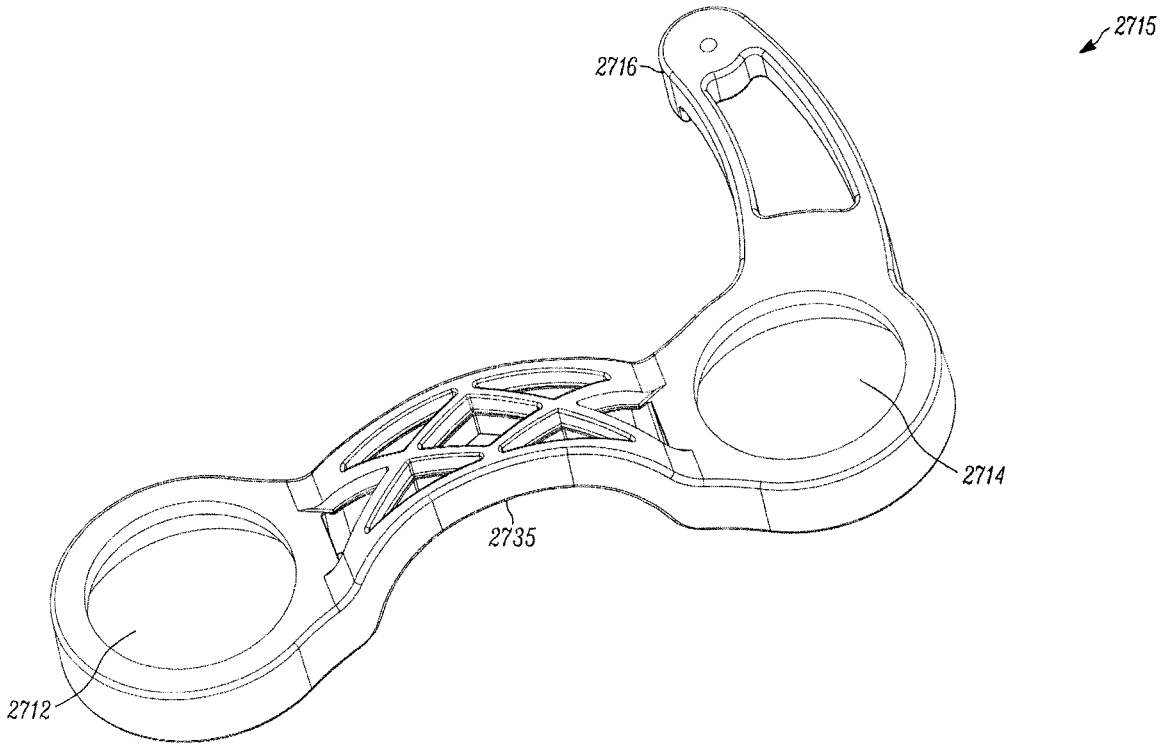
FIG. 27B shows a bracket of the dual pump assembly of FIG. 27A in more detail and separate from the assembly.

In the embodiment of FIG. 27A, the two pumps 2701 and 2702 are cuffed together via a bracket 2715, which can operate in manner similar to that of bracket 1610 shown with respect to FIGS. 16A and B, albeit with a different configuration. The bracket 2715 is shown in more detail in FIG. 27B, separate from the pump assembly 2700. In this example, the bracket 2715 includes opposing annular portions 2712 and 2714 configured to surround collars of the two pumps 2701 and 2701, thereby embracing or "handcuffing" the two pumps together. The bracket 2715 is shown to have a bridge configuration with a rounded or domed raised portion 2735 between the two annular ends 2712 and 2714. Offset from one of the annular portions 2714 is a pressure tube housing support 2712, which is used to support the pressure tube housing of the air switch 2720, as shown in FIG. 27A. In some forms, the pressure tube housing may have the configuration of the housing 1820 shown in FIG. 1820, whereby the housing 1820 attaches to the housing support 2712 by way the connection mechanism 1825.

Figure 28:
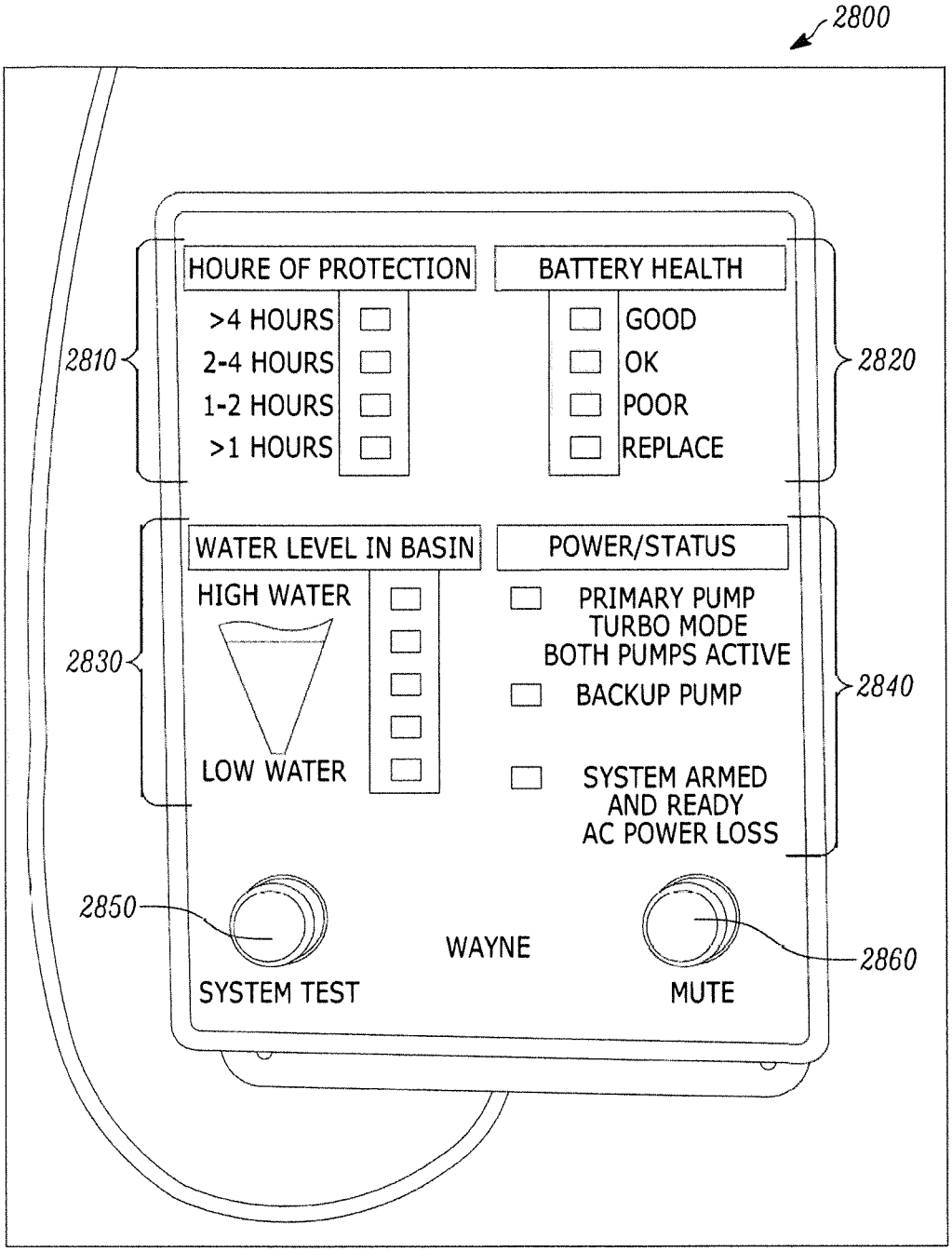
FIG. 28 shows a remote display panel for a pumping system that provides system status and water level information in accordance with examples described herein.

FIG. 28 shows a remote display panel 2800 for a pumping system. The panel 2800 provides system status and water level information as it pertains to a pump assembly. The panel 2800 includes a variety of LED lights that are associated with indicators. For example, the panel 2800 includes a battery charge level section 2810, which includes a series of LED lights that are associated with indicators related to the "Hours of Protection." These indicators may work in conjunction with the battery evaluation system described above. As the pump continues to draw power from the battery and the charge diminishes, the panel 2800 will light different LED lights in the Hours of Protection section 2810 to correspond with the currently calculated expected battery run time.

The panel 2800 also includes a section 2820 configured to display the health of the battery. The series 2820 of LED indicators associated are associated with LED lights that indicate the "Good," OK," "Poor," or "Replace" status of the battery being evaluated. As described above, this battery health level is different from, the battery charge status level indicated in section 2810, but may be used as a basis for determining the hours of protection displayed in section 2810.

The battery health level can be monitored, as described above, by periodically performing a series of steps that include: (1) charging the battery for a predetermined minimum time period is sufficient to fully charge the battery; (2) measuring a voltage across the battery (e.g., via a simulated motor load); (3) comparing, with a processor, the measured voltage with information in the data store; (4) calculating the battery health value based on the comparison of the measured voltage with the information in the data store; and (5) generating a signal via the interface 2820 that indicates the battery health value.

The data store can be an electronic storage device that is in communication with the panel 2800 or other components of the related pump assembly. The data store can include pre-loaded information, such as a look-up table, that corresponds a voltage reading with a particular battery health level. The data store can also be periodically updated with measurements taken according to the periodically performed method, so that the battery health level is based at least in part on the measured voltage for that battery during previously performed measurements. The battery charge value may be configured to approximate a length of time that a pump can operate on the power provided current battery without further charging.

As noted above, the battery health level can be used as a part of the calculation to determine the hours of operation displayed in interface area 2810. For example, a brand new battery having a "Good" health level that is determined to be half-way depleted of charge may display an LED associated with the indicator associated with 2-4 hours. Conversely, an older battery having a "Poor" health level may indicate only a 1-2 hour level when the battery is determined to be fully charged.

The panel 2800 also includes a display area 2830 that provides information pertaining to the water level in the basin. In this region 2830, the panel will light up a certain LED light or series of LED lights to indicate the amount of water currently in the basin or pump associated with the pump assembly. Using sensors associated with the pump assembly (including a number of the sensors described herein), the panel 2800 will determine a detected water level, and generate a display on interface region 2830 that presents that water level to a user.

The display panel 2800 may also include a power/status section 2840 that identifies which pumps, if any, of the pump system are currently operating. For example, the LED associated with the "Primary Pump" indicator will light if the primary pump of the system is operating, the LED associated with the "Backup Pump" indicator will light if the backup pump of the system is operating, and an LED associated with a "Turbo Mode" indicator may light if both pumps are operating. In some examples, a user may be able to control which pumps are operating via the panel 2800, for example, by activating buttons or other input mechanisms.

The display panel 2800 also includes a variety of functional operators, which can be a push-button feature that generates functionality when pressed by a user. In particular, panel 2800 includes a test operator 2850, which generates a test to assure that the system is operating properly when pressed. In some configurations, the panel 2800 or other objects associated with the panel 2800 may be configured to generate audible sounds and warnings, as described herein. Accordingly, the panel 2800 also includes a mute operator 2860, which can be configured to silence or mute all audible sounds when activated by a user.

Figure 29A:
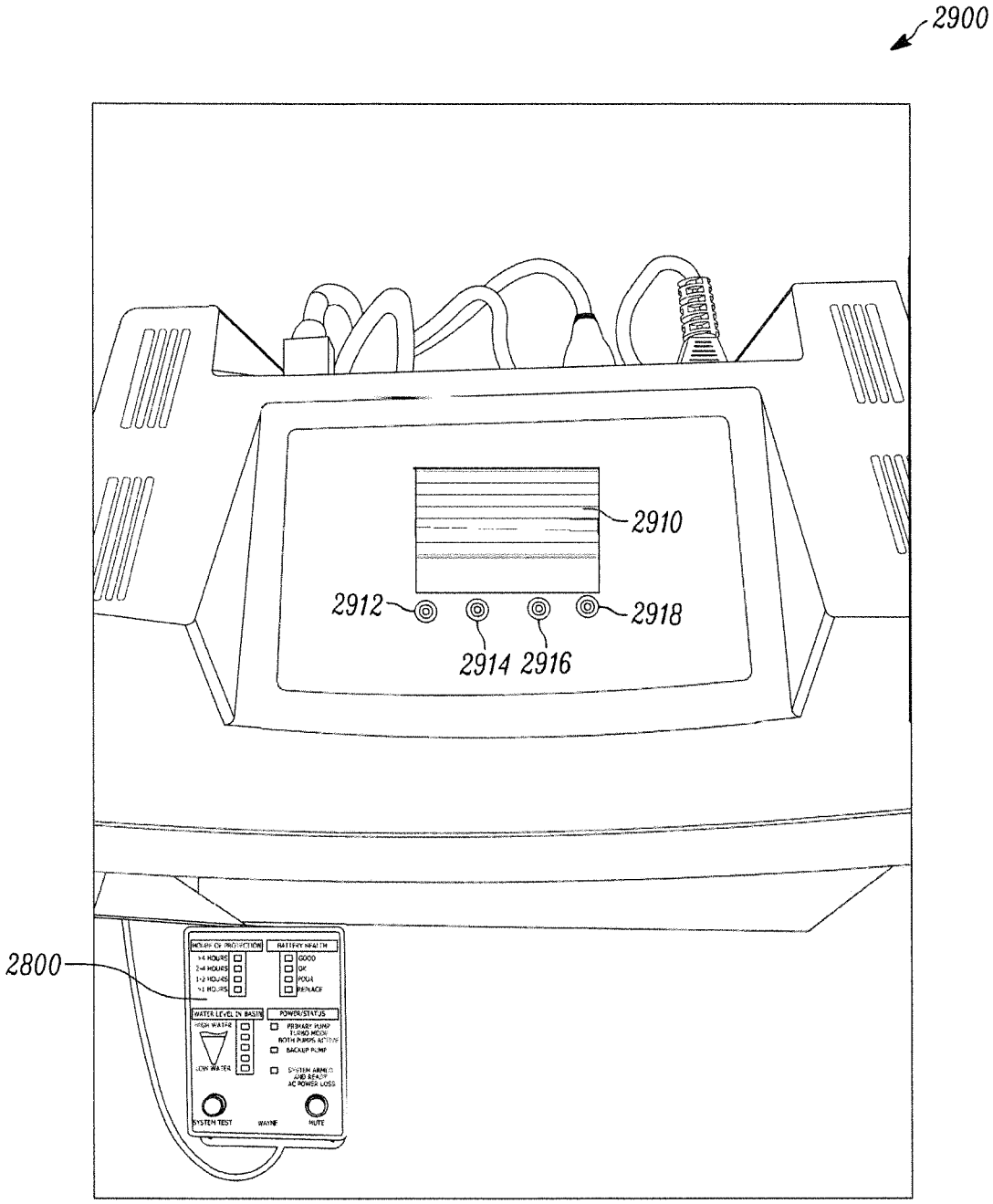
FIG. 29A is a top view of an integrated pump controller and battery management system in accordance with examples described herein.

FIG. 29A is a top view of an integrated pump controller 2900 that operates a battery management system as described above. The controller may 2900 may be attached to, or rest upon a power supply, such as a battery or other DC power source that supplies backup power to a pumping system. The controller 2900 may also include a louvered portion 2910 that allows air to flow to the processing equipment, which can help prevent the control unit from overheating.

As shown in FIG. 29A, the controller 2900 includes an operating interface with a series of operators that can be configured to execute a variety of different functions. For example, the interface can include a reverse battery indicator 2912 that alerts users when the battery is connected to the system wrong or backwards. If the battery is accidently connected wrong (e.g., with the wrong polarity), then the reverse battery (or incorrect battery connection) indicator 2912 is displayed. While in the preferred embodiment this incorrect battery connection signal 2912 includes a displayed signal, such as a light, it should be understood that in alternate embodiments the reverse battery indicator may include (in addition to or in lieu of the visual display) an audible alarm to warn the user the connection is incorrect (preferably immediately).

A battery test/safety reset operator 2914 can perform a test on the battery, for example, determining a current state or health level of the battery and display that value on the interface. The battery test/safety reset operator 2914 can also be configured to perform a safety reset of the pumping system. For example, when a tripping device determines that a thermal load on a portion of the circuit has exceeded a safe operating temperature and trips the circuit, the safety reset button can be operated to reactivate the circuit (e.g., reset may reset the thermal overload protector).

A mute operator 2916 can be configured to silence all audible alarms generated by the controller 2900 or associated units. In some examples, the mute operator can be pressed in advance of an alarm sounding and can have the effect of silencing all alarms that may potentially sound within a given time period. For instance, if a user will be working on or around the controller 2900 for a certain time period and wishes not to be distracted by an alarm, the user may press the mute operator 2916 to deactivate or mute all audible alarms in advance for a predetermined time period. The mute operator 2916 may serve to mute all alarms for a predetermined time period with each press. For example, the controller 2900 may be configured so that one press of the mute operator 2916 will serve to mute all alarms for one hour. The controller 2900 may allow the mute operator 2916 to be pressed multiple times to extend the muted period as desired by the user. For example, the controller 2900 may be configured to allow the mute operator 2916 up to eight times to mute all alarms in advance for up to eight hours.

The display interface may also include the system test operator 2918, which can be configured to effect the performance a test on the pump system to assure that certain features of the system are able to operate as expected. The system test can be configured to operate the primary pump and the backup pump to ensure that the pumps turn on and operate as expected, and that there are no clogs or other obstructions.

The control unit 2900 also may be connected to a display panel, such as panel 2800 as shown with respect to FIG. 28. In other embodiments, rather than (or in addition to) being connected to a display panel, the controller 2900 may communicate wirelessly with a remote device or series of devices to provide the information that could be displayed on the panel. For example, the controller 2900 may communicate with a mobile electronic device (e.g., a smart phone, tablet computer) or other computing device via the internet, a wireless network, or a cellular network. The device can operate an application that will allow the user to receive information and affect control functionality that may otherwise be available via the display panel (e.g., panel 2800). In some forms, the remote device operating the application may be capable of performing additional functionality and displaying additional information beyond that available by a panel.

Figure 29B:
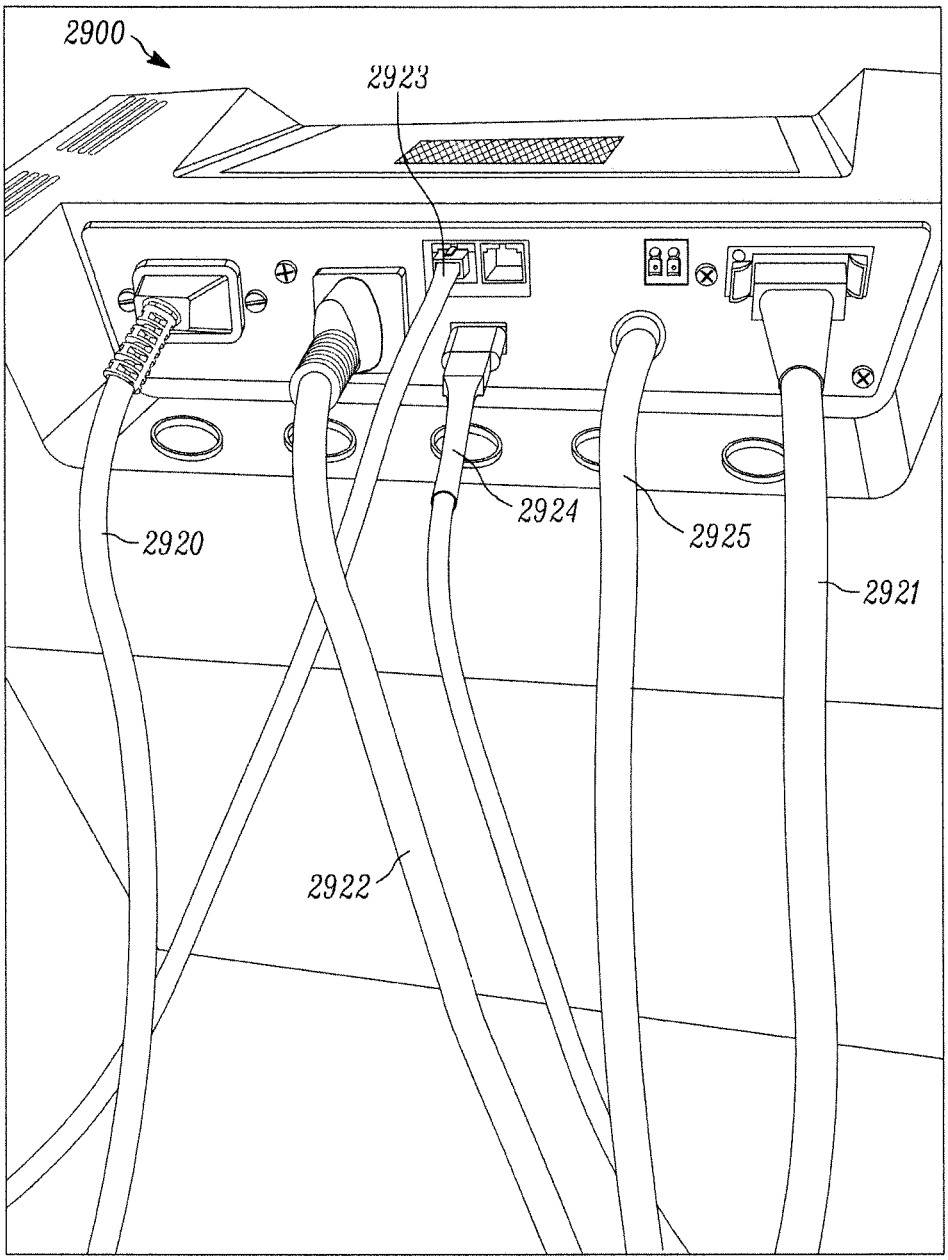
FIG. 29B is a rear view of the integrated pump controller and battery management system of FIG. 29A.

FIG. 29B is a rear view of the integrated pump controller 2900 and battery management system of FIG. 29A. As shown, the controller 2900 includes a variety of connection ports that allow a user to connect a variety of components to the controller. For instance, the controller of FIG. 29B is shown having an AC power in cord 2920 that provides AC power to the controller, for example, via a 120-volt AC outlet or the like. The controller 2900 also includes a power supply line 2921 that delivers electrical power from a battery associated with the controller 2900 to a DC powered device, such as a DC powered sump pump. An AC powered line 2922 provides AC electrical power to another electrically powered device, such as an AC powered sump pump. A remote display line 2923 forms a communication line between the controller 2900 and a display panel, such as panel 2800 shown in FIGS. 28 and 29A. An air switch line 2925 communicates with an air switch associated with the pumping system and facilitates the controller 2900 to effect, cease, or modify the operation status of the pumps of the pumping system. The backup float switch line 2924 communicates with the controller and serves as a redundant backup to assure that the pump operates as desired even where issues may arise with other primary sensors or operating equipment.

Figure 32A:
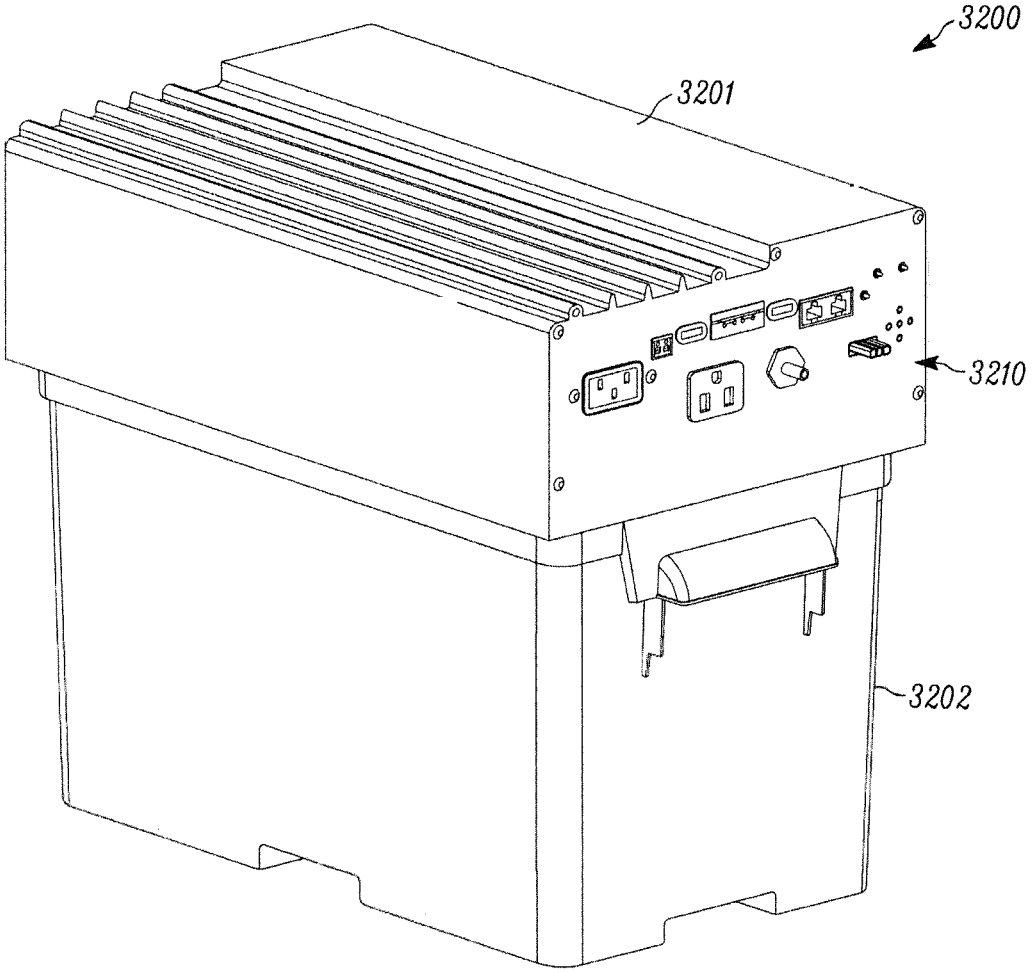
FIGS. 32A and 32B show various views of an integrated pump controller and battery management system in accordance with examples described herein.
Figure 32B:
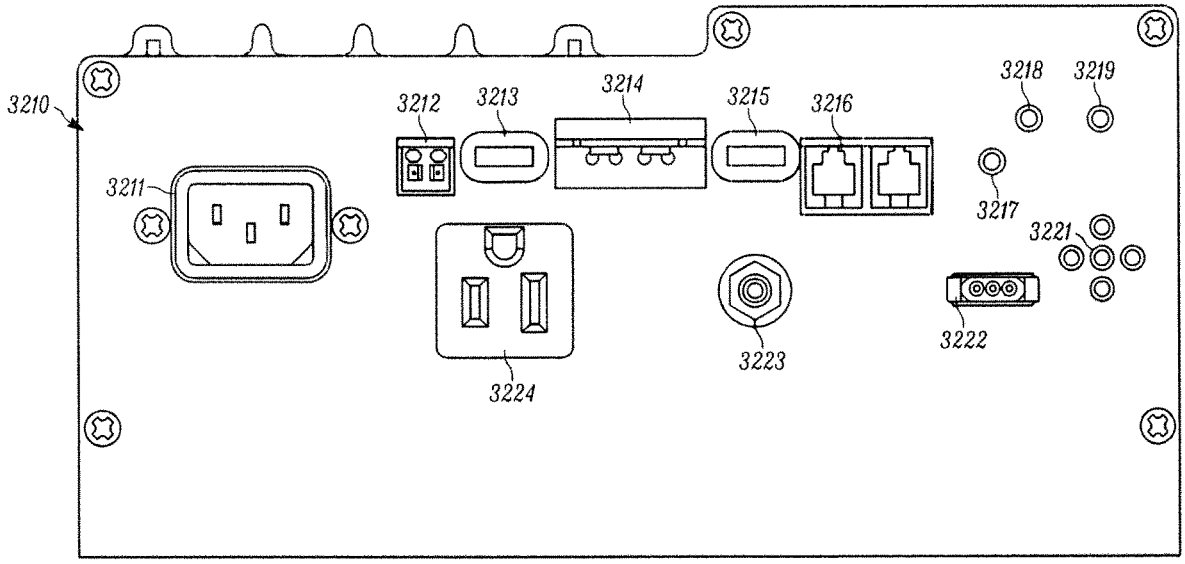

FIGS. 32A and 32B provide another embodiment of a controller/battery assembly 3200 that can be used in connection with a variety of the pumping systems described herein. The assembly 3200 includes a battery 3202 or DC power supply, which can be stored, for example, in a battery housing. A controller 3201 rests upon the battery 3202, and may be attached or attachable thereto. The controller 3201 has a connection panel 3210 that allows the assembly 3200 to connect and communicate with various equipment of the pumping system.

FIG. 32B shows a head on view of the panel 3210 of the pumping system. The panel 3210 comprises a variety of outlets for attachments to various sensors and devices. A 120-volt AC input 3211 allows the controller 3200 to receive electrical power from an AC power source, which AC power can be used to charge the battery 3202. An AC pump outlet 3224 allows an electrical cable to connect with an electrical device (e.g., an AC powered pump) and provide AC power to the device. In some formats, the AC pump outlet 3224 may provide up to four amps of electrical current. A DC pump power outlet 3214 provides DC electrical power from the battery 3202 to a DC powered pump, such as a 12-volt DC pump, which may serve as a backup pump to the pumping system.

The panel 3210 also includes a security alarm port 3212, which can connect to one of various security devices including speakers or sound generating equipment, lights or display equipment, and/or communication devices that can send security signals to other remote devices (e.g., text messages). The panel 3210 may also include a speaker and/or audible alarm system that generates warning sounds in the event of certain detected events (e.g., high water warnings, pumps not operating, battery level low, etc.) In this manner, the panel 3210 may include a mute button 3218, which serves to silence any such alarm, and a test button 3219, which allows the user to test the alarm signal to ensure that it is operating properly.

The panel 3210 may also comprise one or more DC pump fuses, including a primary DC pump fuse 3215 and a spare or backup DC pump fuse 3213. Communication ports 3216 allow the controller 3201 to communicate with various display equipment, such as display panels, monitors, or other interfaces. The communication ports 3216 may also enable communication with other equipment or communication devices, such as an internet router, a telephone line, a cellular network, or the like. The panel 3210 may include ports for connecting to various sensors, such as a water sensor port 3223 that communicates with a sensor that monitors the water level in a sump pit, and a back-up float switch port 3222 that communicates with a backup float switch that serves as a redundant switch to any float switches associated with the pumps of the pumping system. Vent holes 3221 on the panel 3210 allow for air flow into the controller 3201, which helps inhibit overheating. The panel 3210 may also include a warning system that includes a reverse polarity warning light 3217, which may light up or blink when polarity between the battery and the controller and/or pumping systems is not configured properly, thereby warning the user to correct the issue before initiating the supply of power.

Examples described in this application may utilize various techniques for controlling operation of the pumping devices. For instance, sump pump water level can be controlled by a float activated switch. As the water level in the sump rises to a predetermined level, a floating device imposes a change in the state of an electric switch, which switch in turn activates a pump to remove water and reduce the water to a lower level. This level control is normally achieved through hysteresis built into the float mechanism. Many sump pump failures can be traced to a failure of the switch. Accordingly, some aspects described herein relate to an electronic tilt switch that can be used in lieu of a float switch or other device.

Figure 30A:
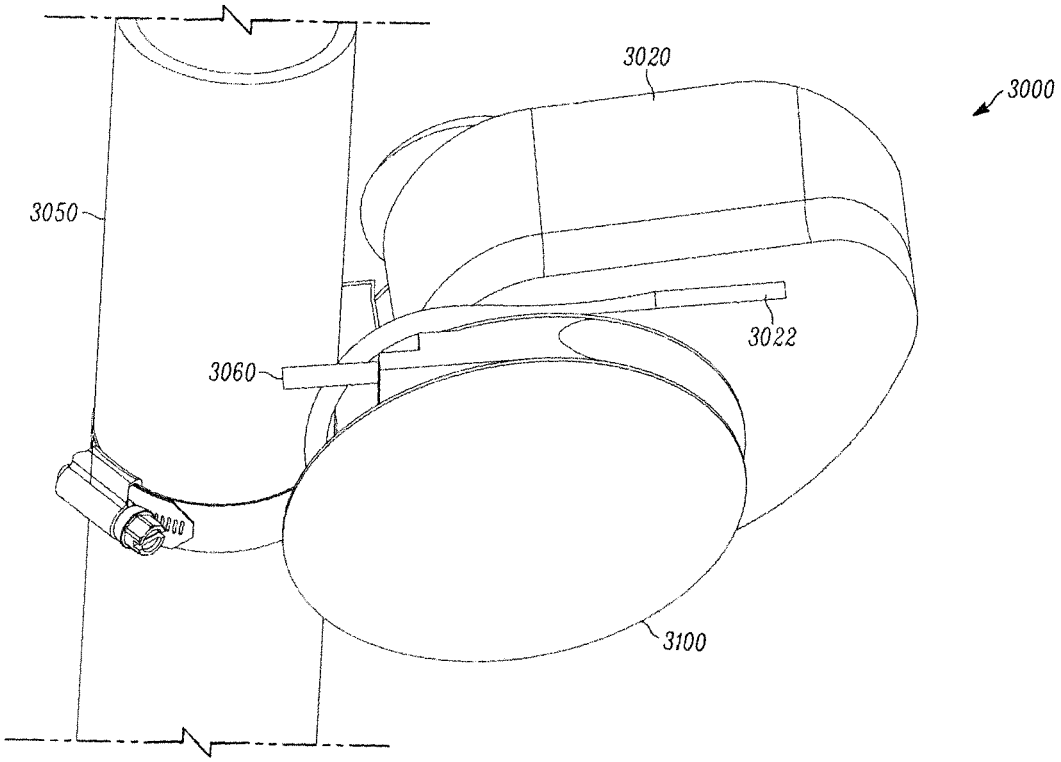
FIGS. 30A and B show an example of a tilt switch utilizing an accelerometer in accordance with examples described in this application.
Figure 30B:
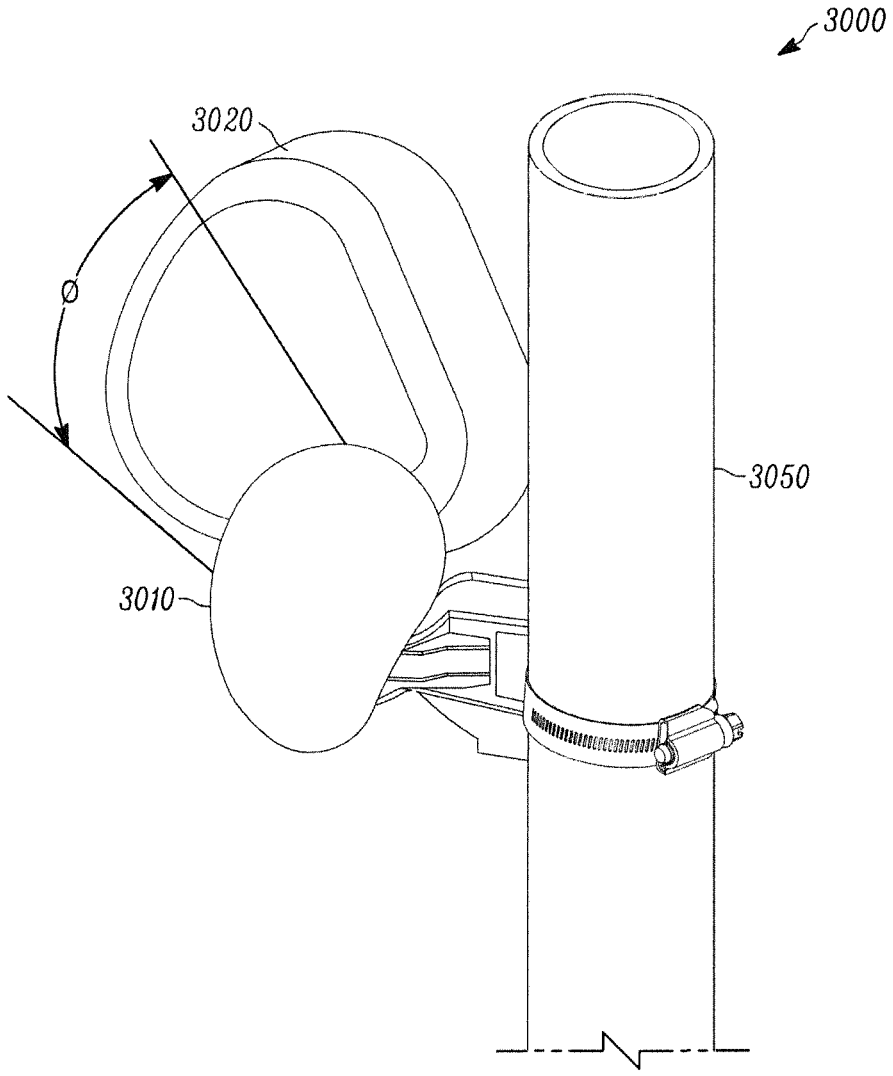

The electronic tilt switch utilizes high volume accelerometer technology, such as those used in portable electronic devices, to create a switch that can control the operation of the pumping system. An example of such an electronic tilt switch is shown in FIGS. 30A and 30B. In FIG. 30A, the tilt switch 3000 takes advantage of a 3-axis accelerometer of the sort that may be used in smart phones or other similar devices. The tilt sensor 3000 can be secured to a fixed structure, such as discharge pipe 3050. The tilt switch 3000 includes a float 3020 and a hinged housing 3010. The float 3020 has an accelerometer, which can be located, for example, within a cavity 3022 of the float. The accelerometer is used measure the tilt angle of the float. Thus, when the water level within the sump rises to the level of the tilt sensor 3000, the float 3020 will rotate with respect to the hinge 3010, and the accelerometer will detect a change, and communicate with a remote circuit board via a cable 3060, or another communication mode (e.g., wireless communication). The supporting circuit board can be located remote to the tilt sensor 3000. That is, in some embodiments, the accelerometer may be in the float 3020, and the remaining supporting circuitry is located remote from the accelerometer, such as in a control unit.

FIG. 30B shows the tilt switch 3000 from a rear view, where the float 3020 is at its highest position, having pivoted about the hinge 3010. In this view, the water level in the sump has risen beyond the location of the tilt switch 3000, thereby causing the float 3020 to pivot upwards by an angle θ. The tilt switch and/or the supporting circuitry (which may be within or remote to the tilt switch) can be configured to effect operation of a pumping device when the accelerometer detects that the float has pivoted by an angle θ, thereby representing a predetermined water level in a sump pit.

Figure 31:
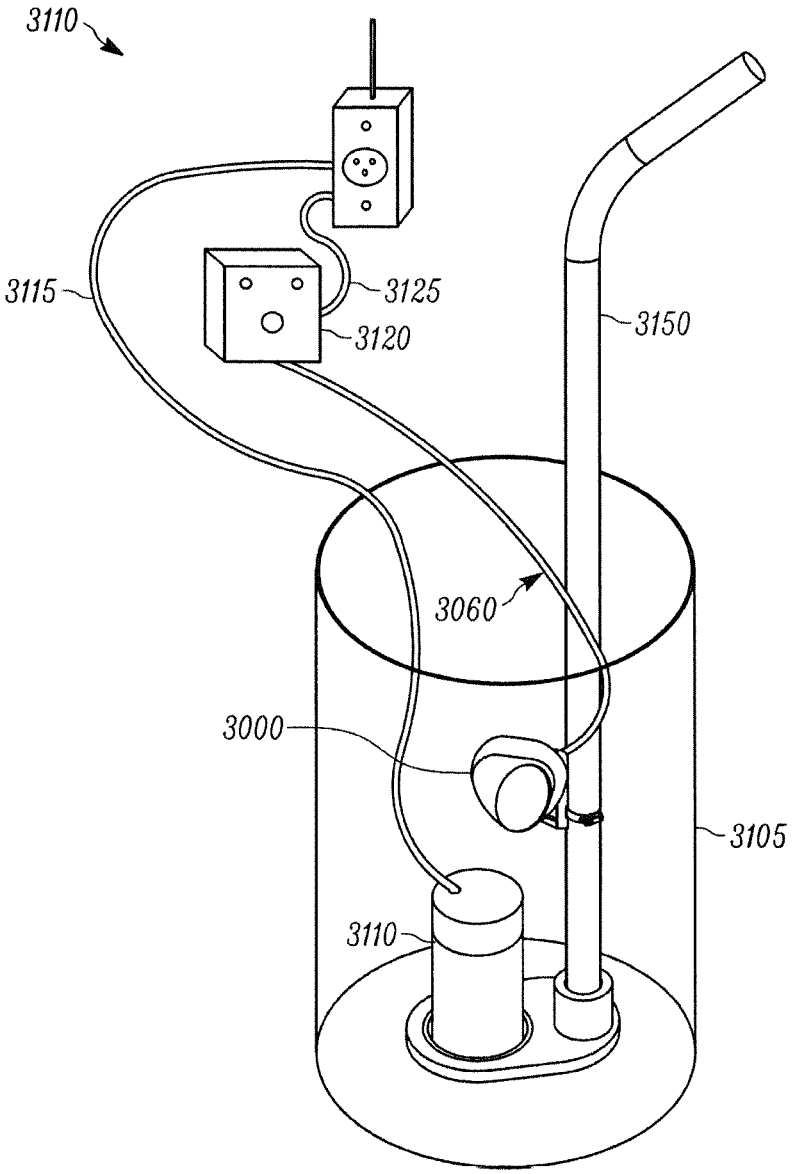
FIG. 31 shows an example pumping system employing a sump pump and the tilt switch of FIGS. 30A and B.

FIG. 31 shows an example set up of a sump system 3100 utilizing the tilt switch 3000 with an accelerometer of FIGS. 30A and B. The system 3100 includes a sump pump 3110 within a sump 3105, supplied with electrical power via a power cord 3115. The tilt switch 3000 is attached to a discharge outlet 3150. The tilt switch 3000 communicates with a control box 3120 via the power cord 3060. The control box 3120, powered via a power cord 3125, can include the various power switching electronics, which can include a single load driving output, such as a triac, a zero crossing device, micro-processor transformers/dropping resistors, a diode bridge, or the like, within a housing. In some examples, the control box 3120 may include or be with associated LED's, alarms, and possible telephone dialer that provide notifications to a user. With a single electronic tilt switch 3000 the water level will be detected by a predetermined angle θ, as measured by the accelerometer and related equipment inside the tilt switch housing 3010.

In one example of operation, when the tilt sensor 3000, via the accelerometer, detects a level change that is greater than a predetermined value (e.g., angle θ), the accelerometer will communicate to the control box 3120 to change the state of the triac, thereby effecting operation of the pump 3110. As the water level in the sump pit 3105 drops, the angle θ will be monitored by the accelerometer. The change in the angle θ over to time can be calculated by a microprocessor within the control box 3120 to establish an appropriate off level for the pump. In some configurations, if the triac can be configured to activate an alarm function to notify a user if the water level does not drop at a predetermined rate, or to a certain level within a predetermined time. In some forms, the system can be configured to activate a second alarm function if the water level continues to rise. For purposes of redundancy or for controlling additional pumps multiple electronic tilt switches could be employed.

Various embodiments described herein include cords that supply electrical power to the pump assembly. The cords may serve to provide AC power to an AC pump, or to provide a charge to a battery of a DC pump, or to connect a DC pump to a battery. In some examples, the various cords of the assembly will be configured so that all cords form the same length. This cord length matching provides users with assurance that a device is installed properly. Some examples of the pump assembly will include cord management systems that facilitate winding or wrapping of cords around the pump assembly or other objects associated with the assembly. The cord management systems may include spring or motor driven cord retraction mechanisms that facilitate winding of the cord about the pump.

Certain examples described herein describe pumps that utilize top suction functionality. That is, the pumps draw in fluid to be pumped from an upper location (e.g., above the volute), and draw in the fluid downward rather than by sucking the fluid upward through a bottom portion of the pump (e.g., from below the volute). This top suction functionality creates a self-venting feature that inhibits air-locking problems that can occur in bottom suction devices. As a result, the top suction functionality allows for the pumping apparatus to operate without applying vent holes in the discharge pipe (which is often necessary for bottom suction devices), or other venting mechanisms.

The presently described technology has several applications for use. For example, the presently described systems and applications can be used in residential sump pits (which are employed in a majority of homes with basements); in rental properties (where the tenants may not be aware of the sump system); in vacation homes (where the occupants may not be present during a high water event); and/or in other locations where rising water could cause damage (crawl spaces, stair wells, etc.).

The present disclosure presents embodiments of tandem sump pump assemblies that refer to primary and secondary pumps. In some aspects the primary pump will be an AC powered pump and the secondary pump will be DC powered. However, in some embodiments both pumps will be AC powered, and in other aspects, both pumps could be DC powered. Depending on the intended use, all embodiments described herein, and all references to AC pumps and/or DC pumps could be substituted for an AC/DC pump unless the context makes clear otherwise.

Thus, in view of the above disclosure, it should be understood that numerous concepts are disclosed herein and intended to be covered herein. For example, in one form and as shown in final FIG. 33, a back-up pump system is disclosed having a primary AC pump and a secondary DC pump, with the primary AC pump having a primary switch for operating at least one of the pumps (e.g., a solid state switch), and the secondary DC pump having a secondary switch for operating at least one of the pumps. We have used similar numbering to that show in FIGS. 1A-G, 16A-B, and 18, but adding the prefix 33 to distinguish one embodiment from the others. The system includes a back-up battery for powering the secondary DC pump when regular power conditions are interrupted (e.g., power outages, unplugged AC cord, other loss of mains power supply, etc.). A primary controller is electrically connected to the pumps for operating same, and a secondary controller, discrete from the primary controller, and electrically connected to at least one of the pumps to operate the at least one of the pumps when the primary controller malfunctions or fails.

In some forms, the solid state primary switch may include a pneumatic pressure transducer sensor that utilizes pressure differentials to determine when one or more of the pumps should be operated. The primary controller may also include a processor programmed to activate the primary AC pump when the pneumatic pressure transducer indicates that a threshold fluid level has been reached. The processor may be programmed to activate the secondary DC pump when the regular power conditions are interrupted and when the threshold fluid level has been reached. In addition or even alternatively, the processor may be programmed to activate the secondary DC pump when the primary AC pump is not lowering the fluid level at a sufficient rate or in a sufficient amount of time. In some forms, the primary controller will include a processor programmed to perform a battery health check.

As mentioned above, some embodiments will have a battery charging circuit electrically connected to the back-up battery for charging the battery and regular power conditions are present, and having a battery health monitoring circuit for monitoring battery health. The battery health monitoring circuit may include a display for displaying indicia indicative of the battery health and an alarm for alerting a user to a problem with the battery based on the monitored battery health. The term alarm is used broadly to mean any type of audible alarm (buzzer, speaker, siren, etc.), visual alarm (e.g., light, flag, display, etc.) and/or an electronic message alarm (e.g., text, app notification, auto-call or voice message, etc.). Similarly, the term display is used broadly to mean any type of light, digital display (e.g., LED display, LCD display, touch screen, plasma display, numeric display, etc.), analog display, and/or a mechanical indicator (e.g., flag, indicator, etc.).

In a preferred form, the primary controller includes a communication device for transmitting notifications about the pump system to a user. The communication device may include a transmitter or transceiver for connecting the primary controller to a wireless network to transmit the notification via the network. A transceiver is preferable to allow two-way communication and user interaction with the pump system to get information from the pump system (e.g., real-time status, diagnostic analysis, historical data, such as performance data, etc.).

In some forms, the pumps system is connected to a discharge pipe via one or more check valves. However, in other forms, the primary AC pump and secondary DC pump are connected to a diverter valve that diverts fluid flowing from one of the pumps toward a discharge pipe that the pump system is connected to and hinders fluid from backflowing or recirculating back into the other pump (e.g., the diverter prevents one pump from pumping fluid back or backwards into the other pump to prevent flooding, etc.). In a preferred form, the diverter valve includes first and second inlets, one common outlet and a diverter body positioned between the inlets, the first inlet being in fluid communication with the primary AC pump and the second inlet being in fluid communication with the secondary DC pump, and the diverter body being movable between: a first position wherein the diverter body blocks the second inlet and allows fluid to flow from the primary AC pump to the common outlet while hindering fluid flow into the second inlet; and a second position wherein the diverter body blocks the first inlet and allows fluid to flow from the secondary DC pump to the common outlet while hindering fluid flow into the first inlet. The first fluid passage extending between the primary AC pump and the common outlet may include a curve or bend, and the second fluid passage extending between the secondary DC pump and the common outlet may form a generally linear fluid passage which allows the second fluid passage to provide less fluid resistance than the first fluid passage to allow the secondary DC pump to operate more efficiently since it is powered by the battery and not an AC power supply. In some instances it is preferable to have the AC pump side of the system deal with plumbing bends and turns that cause loss or greater fluid turbulence and inefficiencies since AC power seemingly is available for extended periods of time compared to the DC power provided by a battery (e.g., batteries have battery life and it is desirable to setup the system to maximize efficiencies that conserve the battery power life). In the forms illustrated, the curve or bend of the first fluid passage is between 45°-90° (e.g., the bend in the plumbing or piping from the AC pump to the outlet pipe) and the second fluid passage is coaxially aligned with the discharge pipe (e.g., a straight or straighter shot).

Also disclosed herein is a pump system having a connector for connecting the primary AC pump to the secondary DC pump so that the pumps may be moved or placed together as an assembly. In the form illustrated in FIG. 33, the connector 33610 is a coupling that has a first interface 33614 for aligning with a first AC pump 33130 outlet and a second interface 33612 for aligning with a second DC pump 33120 outlet so that the pumps may be connected to one another and moved or placed together as an assembly. A raised arch connects the first and second interfaces 33614, 33612 of the coupling 33610. The first interface 33614 is connected to the first AC pump outlet via a first fastener 33631 and the second interface 33612 is connected to the second DC pump outlet via a second fastener 33630. The first AC pump outlet and second DC pump outlet each have internal female pipe threading (FPT) and the first fastener and second fastener are threaded sleeves each having male pipe threading (MPT) on one end that mates with the FPT of the first AC pump outlet and second DC pump outlet, the fasteners further each having a flange portion that engages respective portions of the coupling to secure the coupling to the pumps and the pumps to one another. In the form illustrate in FIG. 33, the flange has flat edges to form a nut-type threading that a wrench can be used with and/or engage to tighten the sleeve to the pump and clamp the coupling between the sleeve and the volute. Seals (e.g., rubber sealing rings, washers, etc.) may also be sued to improve this connection. In the form illustrated in FIG. 33, the coupling further includes a portion for connecting at least a portion of the pneumatic pressure transducer sensor to in order to position the at least a portion of the pneumatic pressure transducer in a desired position in relation to the pumps. The portion protrudes out from one of the interfaces of the coupling (e.g., 33612) to position a hollow housing 33820 of the pneumatic pressure transducer sensor proximate the side wall of one of the pumps (e.g., DC pump 33120).

In other forms mentioned above, the connector may be a first mating member connected to the primary AC pump and a second mating member connected to the secondary DC pump and the first and second mating members mate with one another to connect the pumps to one another. For example, the first mating member may be one of a male or female mating structure and the second mating structure the other of a female or male mating structure so that the mating members interconnect with one another to connect the pumps together. In one earlier form, the volutes were formed with such structures to interconnect the volutes and, thus, the pumps to one another.

The connector may also include other items that also help connect the pumps to one another. For example, in FIG. 33, the connector is also a member that extends from a top or side surface of the primary AC pump to a top or side surface of the secondary DC pump to connect the pumps together. In the form illustrated, the member is a handle 33140 that interconnects the pumps so that they can be carried or placed as a connected assembly. In some forms, two such handles have been shown made from metal and interconnecting the top of the pumps. In other forms illustrated herein, this form of connector has been a fabric strap. Regardless of its ultimate form or shape, it may be helpful to use multiple forms of connectors in order to securely connect one pump to the other so that they travel and place well. For example, having a first connection between the lower portions of the pumps (e.g., the pump outlets, e.g., volute outlets) and a second connection between the upper portions of the pumps (such as the handle interconnecting the tops of the pumps) helps form a stable connection between the pumps and one that allows for easy carry and placement. AC power cord 33104 and DC power cord 33102 are also illustrated in FIG. 33.

Figure 33:
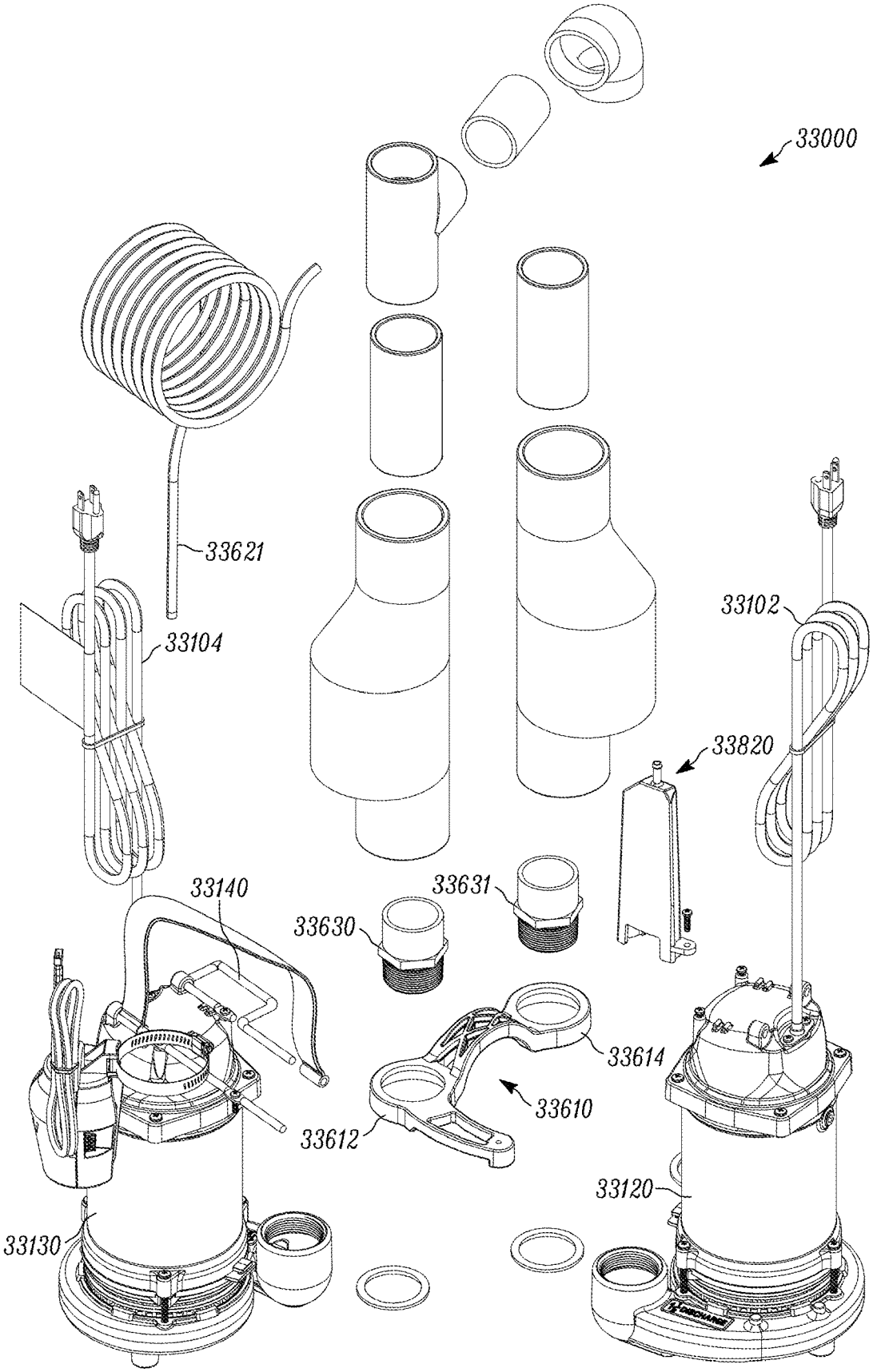
FIG. 33 shows a multi-pump system having a connector for connecting two pumps in accordance with examples described herein.

In addition to the above and as illustrated in FIG. 33, the plumbing or piping of the pumps forms yet another connector that connects the pumps to one another. This PVC piping forms a cross-over connection between the two pumps that establishes yet another connection point or portion between the two pumps. In a preferred form, the handle will extend over the top of this piping in order to encourage the connected pump assembly to be carried by the handle and not the piping or plumbing. In the form illustrated in FIG. 33, each pump has a check valve connected downstream of the pump outlets (e.g., volute exits), and preferably downstream of the coupling that interconnects the volutes. Then the cross-over plumbing or piping connects the respective check valves to a common outlet pipe which can be connected to a common discharge pipe of the system via a simple rubber sleeve connector (or coupling) connected to the discharge pipe and the common outlet pipe via hose clamps or the like. The check valves prevent either pump from pumping fluid backwards into the other pump (e.g., recirculating or backflowing fluid into the other pump). However, in alternate embodiments similar to those discussed above, the pump assembly could be configured with a single isolation valve (e.g., diverter valve) to be used in lieu of the dual check valve configuration.

It should be understood that the embodiments discussed herein are simply meant as representative examples of how the concepts disclosed herein may be utilized and that other system/method/apparatus are contemplated beyond those few examples. For example, while an AC pump and DC pump system is described as preferred, it should be understood that this disclosure contemplates using two AC pumps or two DC pumps, etc. In addition, it should also be understood that features of one embodiment may be combined with features of other embodiments to provide yet other embodiments as desired. Similarly, it should be understood that while the system/method/apparatus embodiments discussed herein have focused on sump pump systems, other uses of the solutions presented herein are contemplated, such as the use of other type of pumping devices.

What is claimed is:

1. A back-up pump system comprising:

a primary AC pump and a secondary DC pump, the primary AC pump having a primary switch for operating at least one of the pumps, the primary switch being a solid state switch, and the secondary DC pump having a secondary switch for operating at least one of the pumps;

a back-up battery for powering the secondary DC pump when regular power conditions are interrupted;

a primary controller electrically connected to and configured to operate both the primary AC pump and the secondary DC pump;

a secondary controller, discrete from the primary controller, and electrically connected to at least one of the pumps to operate the at least one of the pumps when the primary controller malfunctions or fails; and a connector for connecting the primary AC pump to the secondary DC pump so that the pumps may be moved or placed together as an assembly, wherein the connector is a coupling that has a first interface for aligning with a first AC pump outlet and a second interface for aligning with a second DC pump outlet so that the pumps may be connected to one another and moved or placed together as an assembly;

wherein the first interface is connected to the first AC pump outlet via a first fastener and the second interface is connected to the second DC pump outlet via a second fastener; and wherein the first AC pump outlet and second DC pump outlet each have internal female pipe threading (FPT) and the first fastener and second fastener are threaded sleeves each having male pipe threading (MPT) on one end that mates with the FPT of the first AC pump outlet and second DC pump outlet, the fasteners further each having a flange portion that engages respective portions of the coupling to secure the coupling to the pumps and the pumps to one another.

2. The back-up pump system of claim 1 wherein the solid state primary switch includes a pneumatic pressure transducer that utilizes pressure differentials to determine when one or more of the pumps should be operated.

3. The back-up pump system of claim 2 wherein the primary controller includes a processor programmed to activate the primary AC pump when the pneumatic pressure transducer indicates that a threshold fluid level has been reached.

4. The back-up pump system of claim 3 wherein the processor is programmed to activate the secondary DC pump when the regular power conditions are interrupted and when the threshold fluid level has been reached.

5. The back-up pump system of claim 3 wherein the processor is programmed to activate the secondary DC pump when the primary AC pump is not lowering the fluid level at a sufficient rate or in a sufficient amount of time.

6. The back-up pump system of claim 1 wherein the primary controller includes a processor programmed to perform a battery health check.

7. The back-up pump system of claim 1 further including a battery charging circuit electrically connected to the back-up battery for charging the back-up battery when regular power conditions are present, and having a battery health monitoring circuit for monitoring battery health.

8. The back-up pump system of claim 7 wherein the battery health monitoring circuit includes a display for displaying indicia indicative of the battery health and an alarm for alerting a user to a problem with the back-up battery based on the monitored battery health.

9. The back-up pump system of claim 8 wherein the alarm is at least one of an audible alarm, a visual alarm or an electronic message alarm.

10. The back-up pump system of claim 8 wherein the display is at least one of a light, a digital display, an analog display, or a mechanical indicator.

11. The back-up pump system of claim 1 wherein the primary controller includes a communication device for transmitting notifications about the pump system to a user.

12. The back-up pump system of claim 11 wherein the communication device includes a transceiver for connecting the primary controller to a wireless network to transmit the notification via the network.

13. The back-up pump system of claim 1 wherein the primary AC pump and secondary DC pump are connected to a diverter valve that diverts fluid flowing from one of the pumps toward a discharge pipe that the pump system is connected to and hinders fluid from backflowing or recirculating back into the other pump.

14. The back-up pump system of claim 13 wherein the diverter valve includes first and second inlets, one common outlet and a diverter body positioned between the inlets, the first inlet being in fluid communication with the primary AC pump and the second inlet being in fluid communication with the secondary DC pump, and the diverter body being movable between:

a first position wherein the diverter body blocks the second inlet and allows fluid to flow from the primary AC pump to the common outlet while hindering fluid flow into the second inlet; and a second position wherein the diverter body blocks the first inlet and allows fluid to flow from the secondary DC pump to the common outlet while hindering fluid flow into the first inlet.

15. The back-up pump system of claim 14 wherein a first fluid passage extending between the primary AC pump and the common outlet includes a curve or bend, and a second fluid passage extending between the secondary DC pump and the common outlet forms a generally linear fluid passage which allows the second fluid passage to provide less fluid resistance than the first fluid passage to allow the secondary DC pump to operate more efficiently since it is powered by the back-up battery and not an AC power supply.

16. The back-up pump system of claim 15 wherein the curve or bend of the first fluid passage is between 45°-90° and the second fluid passage is coaxially aligned with the discharge pipe.

17. The back-up pump system of claim 1 wherein the solid state primary switch includes a pneumatic pressure transducer sensor and the coupling defines a structure for connecting at least a portion of the pneumatic pressure transducer sensor to position the at least a portion of the pneumatic pressure transducer in a desired position in relation to the pumps.

18. The back-up pump system of claim 1 wherein the connector is a member that extends from a top or side surface of the primary AC pump to a top or side surface of the secondary DC pump to connect the pumps together.

19. The back-up pump system of claim 18 wherein the member is a handle that interconnect the pumps so that they can be carried or placed as a connected assembly.

* * * * *